US007102503B2

(12) United States Patent
Kondo et al.

(10) Patent No.: US 7,102,503 B2
(45) Date of Patent: Sep. 5, 2006

(54) MONITORING SYSTEM, METHOD AND APPARATUS FOR PROCESSING INFORMATION, STORAGE MEDIUM, AND PROGRAM

(75) Inventors: Tetsujiro Kondo, Tokyo (JP); Yoshinori Watanabe, Kanagawa (JP)

(73) Assignee: Sony Corporation, Tokyo (JP)

( * ) Notice: Subject to any disclaimer, the term of this patent is extended or adjusted under 35 U.S.C. 154(b) by 199 days.

(21) Appl. No.: 10/918,338

(22) Filed: Aug. 16, 2004

(65) Prior Publication Data

US 2005/0088295 A1 Apr. 28, 2005

(30) Foreign Application Priority Data

Aug. 20, 2003 (JP) ..... 2003-295906

(51) Int. Cl.
*G08B 23/00* (2006.01)

(52) U.S. Cl. ..... 340/517; 340/506

(58) Field of Classification Search ..... 340/517, 340/521, 522, 506, 525, 541, 552, 554; 702/182, 702/183, 127, 188; 700/17, 83
See application file for complete search history.

(56) References Cited

U.S. PATENT DOCUMENTS 4,772,875 A * 9/1988 Maddox et al. ..... 340/522
6,127,926 A * 10/2000 Dando ..... 340/541
6,525,658 B1 * 2/2003 Streetman et al. ..... 340/522
6,690,411 B1 * 2/2004 Naidoo et al. ..... 348/143
6,972,676 B1 * 12/2005 Kimmel et al. ..... 340/506
6,977,585 B1 * 12/2005 Falk et al. ..... 340/506
2003/0025599 A1 * 2/2003 Monroe ..... 340/531

* cited by examiner

*Primary Examiner*—John Tweel, Jr.
(74) *Attorney, Agent, or Firm*—Oblon, Spivak, McClelland, Maier & Neustadt, P.C.

(57) ABSTRACT

A monitoring system monitors a region. When an event that needs to be presented to a user occurs in the region, the event is presented to the user. State history data associated with event detection states of one or more multi-sensor cameras is generated on the basis of a state change notification received from one or more multi-sensor cameras. A determination as to whether or not a currently occurring event should be notified to the user is made on the basis of a notification-unnecessary event table. If the event is determined as needing to be notified to the user, the event is presented on a presentation unit. The user is allowed to input, via a user input unit, an evaluation on the presented event. Further event detection is performed based on the evaluation made by the user.

60 Claims, 47 Drawing Sheets

FIG. 8

| TIME | T=t | T=t+m | T=t+m+n | T=t+m+n+p |
|---|---|---|---|---|
| SINGLE STATE NUMBER OF MULTI SENSOR CAMERA 1-1 | 0x01 | 0x01 | 0x00 | 0x00 |
| SINGLE STATE NUMBER OF MULTI SENSOR CAMERA 1-2 | 0x00 | 0x01 | 0x01 | 0x00 |
| COMBINED STATE NUMBER OF MULTI SENSOR CAMERA 1-1 | 0x01 | 0x11 | 0x10 | 0x00 |
| COMBINED STATE NUMBER OF MULTI SENSOR CAMERA 1-2 | 0x10 | 0x11 | 0x01 | 0x00 |
| COMBINED STATE NUMBER OF SERVER 31 | 0x01 | 0x11 | 0x10 | 0x00 |

FIG. 13

| STATE TRANSITION PATTERN | DURATION | |
|---|---|---|
| | MINIMUM VALUE | MAXIMUM VALUE |
| COMBINED STATE 0x01 | 0.5 SEC | 3.0 SEC |
| COMBINED STATE 0x11 | 1.0 SEC | 2.5 SEC |

FIG. 18

| STATE TRANSITION PATTERN | DURATION |
|---|---|
| SINGLE STATE 0x01 | 0 SEC |

FIG. 19

| STATE TRANSITION PATTERN | DURATION |
|---|---|
| SINGLE STATE 0x00 | — |

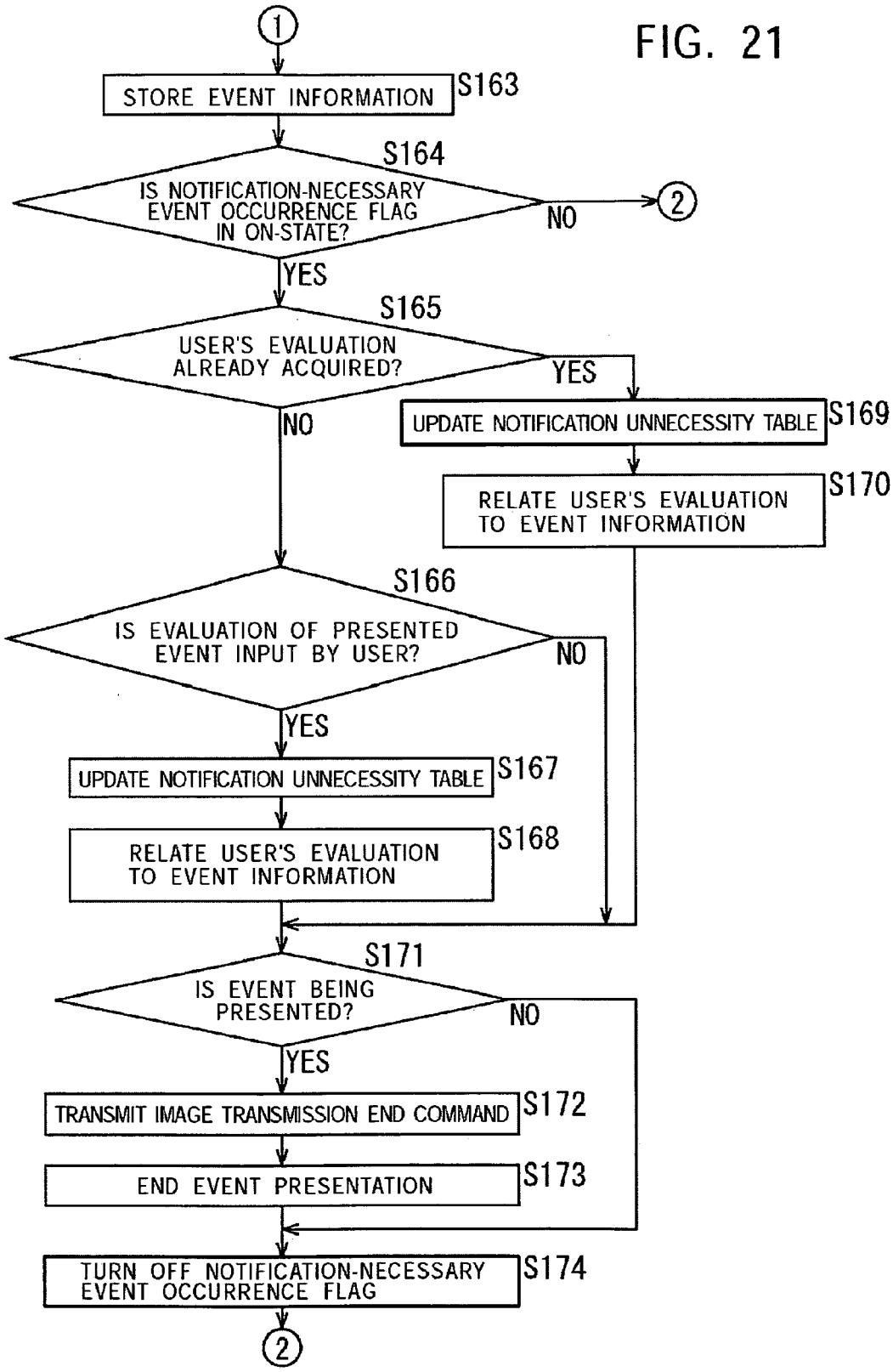
FIG. 21
1
STORE EVENT INFORMATION
S163
S164
IS NOTIFICATION-NECESSARY EVENT OCCURRENCE FLAG IN ON-STATE?
NO
2
YES
S165
USER'S EVALUATION ALREADY ACQUIRED?
YES
NO
UPDATE NOTIFICATION UNNECESSITY TABLE
S169
RELATE USER'S EVALUATION TO EVENT INFORMATION
S170
S166
IS EVALUATION OF PRESENTED EVENT INPUT BY USER?
NO
YES
UPDATE NOTIFICATION UNNECESSITY TABLE
S167
RELATE USER'S EVALUATION TO EVENT INFORMATION
S168
S171
IS EVENT BEING PRESENTED?
NO
YES
TRANSMIT IMAGE TRANSMISSION END COMMAND
S172
END EVENT PRESENTATION
S173
TURN OFF NOTIFICATION-NECESSARY EVENT OCCURRENCE FLAG
S174
2

FIG. 23

| STATE TRANSITION PATTERN | DURATION |
|---|---|
| COMBINED STATE 0x01 | 0 SEC |

FIG. 24

| STATE TRANSITION PATTERN | DURATION |
|---|---|
| SINGLE STATE 0x01 | m SEC |

FIG. 25

| STATE TRANSITION PATTERN | DURATION |
|---|---|
| SINGLE STATE 0x01 | 0 SEC |

FIG. 26

| STATE TRANSITION PATTERN | DURATION |
|---|---|
| COMBINED STATE 0x01 | m SEC |
| COMBINED STATE 0x11 | 0 SEC |

FIG. 27

| STATE TRANSITION PATTERN | DURATION |
|---|---|
| SINGLE STATE 0x01 | m+n SEC |

FIG. 28

| STATE TRANSITION PATTERN | DURATION |
|---|---|
| SINGLE STATE 0x01 | n SEC |

FIG. 29

| STATE TRANSITION PATTERN | DURATION |
|---|---|
| COMBINED STATE 0x01 | m SEC |
| COMBINED STATE 0x11 | n SEC |
| COMBINED STATE 0x10 | 0 SEC |

FIG. 30

| STATE TRANSITION PATTERN | DURATION |
|---|---|
| SINGLE STATE 0x00 | — |

FIG. 31

| STATE TRANSITION PATTERN | DURATION |
|---|---|
| SINGLE STATE 0x01 | n+p SEC |

FIG. 32

| STATE TRANSITION PATTERN | DURATION |
|---|---|
| COMBINED STATE 0x01 | m SEC |
| COMBINED STATE 0x11 | n SEC |
| COMBINED STATE 0x10 | p SEC |

FIG. 34

| STATE TRANSITION PATTERN | DURATION | |
|---|---|---|
| | MINIMUM VALUE | MAXTIMUM VALUE |
| SINGLE STATE 0x01 | 0.5 SEC | 2.0 SEC |

FIG. 35

| STATE TRANSITION PATTERN | DURATION |
|---|---|
| COMBINED STATE 0x01 | 2.0 SEC |
| COMBINED STATE 0x11 | 1.0 SEC |

FIG. 36

| STATE TRANSITION PATTERN | DURATION |
|---|---|
| SINGLE STATE 0x01 | 3.0 SEC |

FIG. 37

| STATE TRANSITION PATTERN | DURATION |
|---|---|
| COMBINED STATE 0x10 | 2.0 SEC |
| COMBINED STATE 0x11 | 1.0 SEC |

FIG. 38

| STATE TRANSITION PATTERN | DURATION |
|---|---|
| SINGLE STATE 0x01 | 1.0 SEC |

FIG. 45

| | |
|---|---|
| STATE TRANSITION PATTERN OF SINGLE STATE OF PRESENT CAMERA | SINGLE STATE 0x01 |
| STATE TRANSITION PATTERN OF SINGLE STATE OF ANOTHER MULTI SENSOR CAMERA | SINGLE STATE 0x00 |
| STATE TRANSITION PATTERN OF COMBINED STATE | COMBINED STATE 0x01 |
| DURATION | 0 SEC |

FIG. 46

| | |
|---|---|
| STATE TRANSITION PATTERN OF SINGLE STATE OF PRESENT CAMERA | SINGLE STATE 0x00 |
| STATE TRANSITION PATTERN OF SINGLE STATE OF ANOTHER MULTI SENSOR CAMERA | SINGLE STATE 0x01 |
| STATE TRANSITION PATTERN OF COMBINED STATE | COMBINED STATE 0x10 |
| DURATION | 0 SEC |

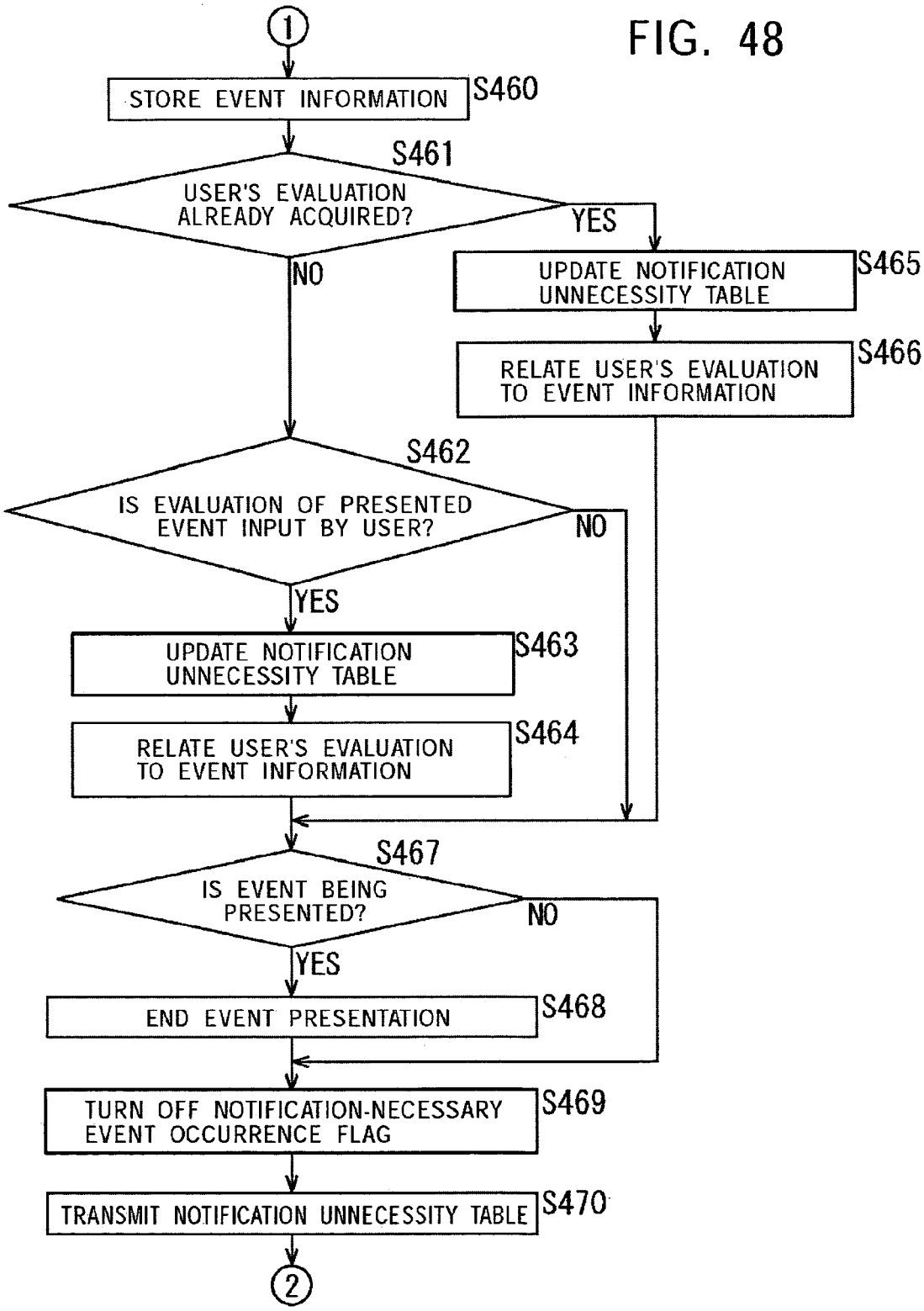
FIG. 48
1
STORE EVENT INFORMATION
S460
S461
USER'S EVALUATION ALREADY ACQUIRED?
YES
NO
UPDATE NOTIFICATION UNNECESSITY TABLE
S465
RELATE USER'S EVALUATION TO EVENT INFORMATION
S466
S462
IS EVALUATION OF PRESENTED EVENT INPUT BY USER?
NO
YES
UPDATE NOTIFICATION UNNECESSITY TABLE
S463
RELATE USER'S EVALUATION TO EVENT INFORMATION
S464
S467
IS EVENT BEING PRESENTED?
NO
YES
END EVENT PRESENTATION
S468
TURN OFF NOTIFICATION-NECESSARY EVENT OCCURRENCE FLAG
S469
TRANSMIT NOTIFICATION UNNECESSITY TABLE
S470
2

FIG. 49

| | | |
|---|---|---|
| STATE TRANSITION PATTERN OF SINGLE STATE OF PRESENT CAMERA | SINGLE STATE 0x01 | SINGLE STATE 0x01 |
| STATE TRANSITION PATTERN OF SINGLE STATE OF ANOTHER MULTI SENSOR CAMERA | SINGLE STATE 0x00 | SINGLE STATE 0x01 |
| STATE TRANSITION PATTERN OF COMBINED STATE | COMBINED STATE 0x01 | COMBINED STATE 0x11 |
| DURATION | m SEC | 0 SEC |

FIG. 50

| | | |
|---|---|---|
| STATE TRANSITION PATTERN OF SINGLE STATE OF PRESENT CAMERA | SINGLE STATE 0x00 | SINGLE STATE 0x01 |
| STATE TRANSITION PATTERN OF SINGLE STATE OF ANOTHER MULTI SENSOR CAMERA | SINGLE STATE 0x01 | SINGLE STATE 0x01 |
| STATE TRANSITION PATTERN OF COMBINED STATE | COMBINED STATE 0x10 | COMBINED STATE 0x11 |
| DURATION | m SEC | 0 SEC |

FIG. 51

| | | | |
|---|---|---|---|
| STATE TRANSITION PATTERN OF SINGLE STATE OF PRESENT CAMERA | SINGLE STATE 0x01 | SINGLE STATE 0x01 | SINGLE STATE 0x00 |
| STATE TRANSITION PATTERN OF SINGLE STATE OF ANOTHER MULTI SENSOR CAMERA | SINGLE STATE 0x00 | SINGLE STATE 0x01 | SINGLE STATE 0x01 |
| STATE TRANSITION PATTERN OF COMBINED STATE | COMBINED STATE 0x01 | COMBINED STATE 0x11 | COMBINED STATE 0x10 |
| DURATION | m SEC | n SEC | 0 SEC |

FIG. 52

| | | | |
|---|---|---|---|
| STATE TRANSITION PATTERN OF SINGLE STATE OF PRESENT CAMERA | SINGLE STATE 0x00 | SINGLE STATE 0x01 | SINGLE STATE 0x01 |
| STATE TRANSITION PATTERN OF SINGLE STATE OF ANOTHER MULTI SENSOR CAMERA | SINGLE STATE 0x01 | SINGLE STATE 0x01 | SINGLE STATE 0x00 |
| STATE TRANSITION PATTERN OF COMBINED STATE | COMBINED STATE 0x10 | COMBINED STATE 0x11 | COMBINED STATE 0x01 |
| DURATION | m SEC | n SEC | 0 SEC |

FIG. 53

| | | | |
|---|---|---|---|
| STATE TRANSITION PATTERN OF SINGLE STATE OF PRESENT CAMERA | SINGLE STATE 0x01 | SINGLE STATE 0x01 | SINGLE STATE 0x00 |
| STATE TRANSITION PATTERN OF SINGLE STATE OF ANOTHER MULTI SENSOR CAMERA | SINGLE STATE 0x00 | SINGLE STATE 0x01 | SINGLE STATE 0x01 |
| STATE TRANSITION PATTERN OF COMBINED STATE | COMBINED STATE 0x01 | COMBINED STATE 0x11 | COMBINED STATE 0x10 |
| DURATION | m SEC | n SEC | p SEC |

FIG. 54

| | | | |
|---|---|---|---|
| STATE TRANSITION PATTERN OF SINGLE STATE OF PRESENT CAMERA | SINGLE STATE 0x00 | SINGLE STATE 0x01 | SINGLE STATE 0x01 |
| STATE TRANSITION PATTERN OF SINGLE STATE OF ANOTHER MULTI SENSOR CAMERA | SINGLE STATE 0x01 | SINGLE STATE 0x01 | SINGLE STATE 0x00 |
| STATE TRANSITION PATTERN OF COMBINED STATE | COMBINED STATE 0x10 | COMBINED STATE 0x11 | COMBINED STATE 0x01 |
| DURATION | m SEC | n SEC | p SEC |

FIG. 55

| | | | |
|---|---|---|---|
| STATE TRANSITION PATTERN OF SINGLE STATE OF MULTI SENSOR CAMERA 1-1 | SINGLE STATE 0x01 | SINGLE STATE 0x01 | SINGLE STATE 0x00 |
| STATE TRANSITION PATTERN OF COMBINED STATE OF MULTI SENSOR CAMERA 1-1 | COMBINED STATE 0x01 | COMBINED STATE 0x11 | COMBINED STATE 0x10 |
| STATE TRANSITION PATTERN OF SINGLE STATE OF MULTI SENSOR CAMERA 1-2 | SINGLE STATE 0x00 | SINGLE STATE 0x01 | SINGLE STATE 0x01 |
| STATE TRANSITION PATTERN OF COMBINED STATE OF MULTI SENSOR CAMERA 1-2 | COMBINED STATE 0x10 | COMBINED STATE 0x11 | COMBINED STATE 0x01 |
| DURATION | m SEC | n SEC | p SEC |

MONITORING SYSTEM, METHOD AND APPARATUS FOR PROCESSING INFORMATION, STORAGE MEDIUM, AND PROGRAM

BACKGROUND OF THE INVENTION

1. Field of the Invention

The present invention relates to a monitoring system, a method and apparatus for processing information, a storage medium, and a program, and more particularly to a monitoring system, a method and apparatus for processing information, a storage medium, and a program, capable of informing a user of an occurrence of an event that needs to be notified to the user, in an easy and highly reliable fashion with low power consumption.

2. Description of the Related Art

A system has been proposed which detects anomalous motion in a particular region by monitoring the region using a plurality of monitoring cameras each including a motion sensor capable of sensing a moving object (Japanese Unexamined Patent Application Publication No. 7-212748). In this system, outputting of a signal from each monitoring camera is controlled depending on the output level of the corresponding motion sensor.

However, in the system disclosed in the Japanese Unexamined Patent Application Publication No. 7-212748 cited above, all monitoring cameras operate independently, and images are transmitted for all events detected by monitoring cameras. Thus, a great number of events are notified to a user. This makes it difficult for the user to correctly extract events that must really be caught, and a large amount of electric power is wasted.

SUMMARY OF THE INVENTION

In view of the above, it is an object of the present invention to provide a monitoring system and associated techniques that make it possible to catch an occurrence of an event that really must be caught and present an image of the event to a user.

In an aspect, the present invention provides a monitoring system comprising a first sensor for outputting first data based on monitoring of a region monitored by the first sensor, a second sensor for outputting first data based on monitoring of a region monitored by the second sensor, a third sensor for outputting first data based on monitoring of a region monitored by the third sensor, a fourth sensor for outputting first data based on monitoring of a region monitored by the fourth sensor, a first event detector for detecting, on the basis of the first data output from the first sensor, an occurrence and an property of a first event in response to a change in state of the region being monitored, a second event detector for detecting, on the basis of the second data output from the second sensor, an occurrence and a property of a second event in response to a change in state of the monitored region, a notification controller for controlling a notification of the first event and the second event based on data indicating the property of the first event detected by the first event detector and data indicating the property of the second event detected by the second event detector, and a presentation controller for controlling presentation of data such that if the first event and/or the second event are controlled, by the notification controller, to be notified, the third data, relating to the first event, output by the third sensor and/or the fourth data, relating to the second event, output by the fourth sensor are presented.

The monitoring system according to the present invention may further comprise an input acquisition unit for acquiring information input by a user.

In this monitoring system according to the present invention, the input acquisition unit may acquire an input of user's evaluation on a presentation provided under the control of the presentation controller, the monitoring system may further comprise an event classification information generator for generating event classification information on the basis of data indicating a property of the first event, data indicating a property of the second event, combined data produced by combining the data indicating the property of the first event and the data indicating the property of the second event, and the input of the user's evaluation acquired by the input acquisition unit, and the notification controller may control the notification of the first event and the second event based on the event classification information.

In this monitoring system according to the present invention, the input acquisition unit may acquire an input of user's evaluation as to whether or not a notification is necessary at least for one of the third data and the fourth data presented under the control of the presentation controller, and the event classification information generator may generate event classification information indicating whether or not a notification of an event is necessary, on the basis of not only the data indicating the property of the first event, the data indicating the property of the second event, and the combined data, but also the input of the evaluation as to whether or not the notification is necessary.

The monitoring system according to the present invention may further comprise an event classification information storage unit for storing the event classification information generated by the event classification information generator.

The monitoring system according to the present invention may further comprise an information recording unit for recording, as event information, at least one of the data indicating the property of the first event, the data indicating the property of the second event, and the combined data, in relationship to the input of user's evaluation acquired by the input acquisition unit.

The monitoring system according to the present invention may further comprise a mode selector for selecting a mode in which a notification of an event is controlled, on the basis of the event information recorded by the information recording unit and the event classification information, wherein the notification controller may determine, based on the mode selected by the mode selection, which one of the data indicating the property of the first event, the data indicating the property of the second event, and the combined data should be used as data according to which to control the event notification.

In this monitoring system according to the present invention, the input acquisition unit may acquire a command associated with the mode issued by a user, and the mode selector may select a mode based on the command issued by the user and acquired by the input acquisition unit.

In this monitoring system according to the present invention, the notification controller may control the notification of the first event and the second event based on combined data obtained by combining the data indicating the property of the first event detected by the first event detector and the data indicating the property of the second event detected by the second event detector.

In this monitoring system according to the present invention, the first sensor and the second sensor may each include a photosensor.

In this monitoring system according to the present invention, the third sensor and the fourth sensor may each include a camera.

In this monitoring system according to the present invention, the first sensor, the second sensor, the third sensor, the fourth sensor, the first event detector, the second event detector, the notification controller, and the presentation controller may be disposed separately in a first information processing apparatus, a second information processing apparatus, or a third information processing apparatus.

In this monitoring system according to the present invention, communication among the first information processing apparatus the second information processing apparatus and the third information processing apparatus may be performed by means of wireless communication.

In this monitoring system according to the present invention, the first information processing apparatus and the second information processing apparatus may be driven by a battery.

In this monitoring system according to the present invention, the event notification controller may include a first notification controller, a second notification controller, and a third notification controller. The first sensor, the third sensor, the first event detector, and the first notification controller may be disposed in the first information processing apparatus. The second sensor, the fourth sensor, the second event detector, and the second notification controller may be disposed in the second information processing apparatus. The third notification controller, the presentation controller, the input acquisition unit, the event classification information generator, the information recording unit, and the mode selector may be disposed in the third information processing apparatus.

In this monitoring system according to the present invention, communication among the first information processing apparatus, the second information processing apparatus and the third information processing apparatus may be performed by means of wireless communication.

In this monitoring system according to the present invention, the first information processing apparatus and the second information processing apparatus may be driven by a battery.

In this monitoring system according to the present invention, at least one notification controller selected, depending on the mode, from the first notification controller, the second notification controller, and the third notification controller may control the notification of the first event and the second event.

In this monitoring system according to the present invention, the first event detector may determine to which one of the first, second, and third notification controllers the data indicating the property of the first event should be transmitted, based on the mode, and the second event detector may determine to which one of the first, second, and third notification controllers the data indicating the property of the second event should be transmitted, based on the mode.

In this monitoring system according to the present invention, the mode selector may select a mode based on the power consumption of the first information processing apparatus and the second information processing apparatus.

In this monitoring system according to the present invention, the mode selector may select a mode based on the remaining capacity of the battery of the first information processing apparatus and the second information processing apparatus.

In another aspect, the present invention provides an information processing method comprising a first event detection step of detecting an occurrence and a property of a first event in response to a change in state of a region being monitored, on the basis of first data output from a first sensor based on monitoring the region monitored by the first sensor, a second event detection step of detecting an occurrence and a property of a second event in response to a change in state of a region being monitored, on the basis of second data output from a second sensor based on monitoring the region monitored by the second sensor, a notification control step of controlling a notification of the first event and the second event based on data indicating the property of the first event detected in the first event detection step and data indicating the property of the second event detected in the second event detection step, and a presentation control step of controlling presentation of data such that if, in the notification control step, the first event and/or the second event are controlled to be notified, third data relating to the first event output by a third sensor based on monitoring of a region monitored by the third sensor and/or fourth data relating to the second event output by a fourth sensor based on monitoring of a region monitored by the fourth sensor are presented.

In another aspect, the present invention provides a storage medium in which a computer-readable program is stored, the program comprising a first event detection step of detecting an occurrence and a property of a first event in response to a change in state of a region being monitored, on the basis of first data output from a first sensor based on monitoring the region monitored by the first sensor, a second event detection step of detecting an occurrence and a property of a second event in response to a change in state of a region being monitored, on the basis of second data output from a second sensor based on monitoring the region monitored by the second sensor, a notification control step of controlling a notification of the first event and the second event based on data indicating the property of the first event detected in the first event detection step and data indicating the property of the second event detected in the second event detection step, and a presentation control step of controlling presentation of data such that if, in the notification control step, the first event and/or the second event are controlled to be notified, third data relating to the first event output by a third sensor based on monitoring of a region monitored by the third sensor and/or fourth data relating to the second event output by a fourth sensor based on monitoring of a region monitored by the fourth sensor are presented.

In another aspect, the present invention provides a program for causing a computer to execute a process comprising a first event detection step of detecting an occurrence and a property of a first event in response to a change in state of a region being monitored, on the basis of first data output from a first sensor based on monitoring the region monitored by the first sensor, a second event detection step of detecting an occurrence and a property of a second event in response to a change in state of a region being monitored, on the basis of second data output from a second sensor based on monitoring the region monitored by the second sensor, a notification control step of controlling a notification of the first event and the second event based on data indicating the property of the first event detected in the first event detection step and data indicating the property of the second event detected in the second event detection step, a presentation control step of controlling presentation of data such that if, in the notification control step, the first event and/or the second event are controlled to be notified, third data relating to the first event output by a third sensor based on monitoring of a region monitored by the third sensor and/or fourth data relating to the second event output by a fourth sensor based on monitoring of a region monitored by the fourth sensor are presented.

In another aspect, the present invention provides a monitoring system comprising a first sensor for outputting first data based on monitoring of a region monitored by the first sensor, a second sensor for outputting first data based on monitoring of a region monitored by the second sensor, a third sensor for outputting first data based on monitoring of a region monitored by the third sensor, a fourth sensor for outputting first data based on monitoring of a region monitored by the fourth sensor, first event detecting means for detecting, on the basis of the first data output from the first sensor, an occurrence and a property of a first event in response to a change in state of the monitored region, second event detecting means for detecting, on the basis of the second data output from the second sensor, an occurrence and a property of a second event in response to a change in state of the monitored region, notification control means for controlling a notification of the first event and the second event based on data indicating the property of the first event detected by the first event detecting means and data indicating the property of the second event detected by the second event detecting means, and presentation control means for controlling presentation of data such that if the first event and/or the second event are controlled, by the notification control means, to be notified, the third data, relating to the first event, output by the third sensor and/or the fourth data, relating to the second event, output by the fourth sensor are presented.

In another aspect, the present invention provides an information processing apparatus comprising a first sensor for outputting first data based on monitoring of a region monitored by the first sensor, a second sensor for outputting first data based on monitoring of a region monitored by the second sensor, an event detector for detecting, on the basis of the first data output from the first sensor, an occurrence and a property of a first event in response to a change in state of the monitored region, a receiver for receiving data indicating a property of a second event detected by a first information processing apparatus other than the present information processing apparatus, a notification controller for controlling a notification of the first event based on the data indicating the property of the first event and the data indicating the property of the second event, and a transmitter for transmitting such that if the first event is controlled, by the notification controller, to be notified, the second data, relating to the first event, output by the second sensor is transmitted to a second information processing apparatus other than the present information processing apparatus, and the data indicating the property of the first event is also transmitted to the second information processing apparatus.

In the information processing apparatus according to the present invention, the notification controller may control the notification of the first event detected by the event detector, on the basis of the data indicating the property of the first event, the data indicating the property of the second event, combined data obtained by combining the data indicating the property of the first event and the data indicating the property of the second event, and event classification information based on a command issued by a user.

In the information processing apparatus according to the present invention, the notification controller may determine whether the notification of an event should be controlled on the basis of the data indicating the property of the first event or combined data, based on the data indicating the property of the first event, the data indicating the property of the second event, combined data obtained by combining the data indicating the property of the first event and the data indicating the property of the second event, and an event notification control mode selected based on a command issued by a user.

In the information processing apparatus according to the present invention, the notification controller may determine whether the first event should be notified, based on the data indicating the property of the first event, the data indicating the property of the second event, combined data obtained by combining the data indicating the property of the first event and the data indicating the property of the second event, and an event notification control mode selected based on a command issued by a user.

In the information processing apparatus according to the present invention, the notification controller may control the notification of the first event based on combined data obtained by combining the data indicating the property of the first event and the data indicating the property of the second event.

In the information processing apparatus according to the present invention, the event detector may control whether or not to transmit the data indicating the property of the first event to the first information processing apparatus other than the present information processing apparatus or the second information processing apparatus other than the present information processing apparatus, based on the data indicating the property of the first event, the data indicating the property of the second event, combined data obtained by combining the data indicating the property of the first event and the data indicating the property of the second event, and an event notification control mode selected based on a command issued by a user.

In the information processing apparatus according to the present invention, the transmitter may transmit the data indicating the property of the first event to the first information processing apparatus other than the present information processing apparatus.

In the information processing apparatus according to the present invention, communication by the transmitter may be performed by means of wireless communication.

In the information processing apparatus according to the present invention, the information processing apparatus may be driven by a battery.

In the information processing apparatus according to the present invention, the first sensor may include a photosensor.

In the information processing apparatus according to the present invention, the second sensor may include a camera.

In another aspect, the present invention provides an information processing apparatus comprising a first sensor for outputting first data based on monitoring of a region monitored by the first sensor, a second sensor for outputting first data based on monitoring of a region monitored by the second sensor, event detection means for detecting, on the basis of the first data output from the first sensor, an occurrence and a property of a first event in response to a change in state of the monitored region, receiving means for receiving data indicating a property of a second event detected by a first information processing apparatus other than the present information processing apparatus, notification control means for controlling a notification of the first event based on the data indicating the property of the first event and the data indicating the property of the second event, and presentation control means for controlling presentation of data such that if the first event and/or the second event are controlled, by the notification control means, to be notified, the second data, relating to the first event, output by the second sensor is transmitted to a second information processing apparatus other than the present information processing apparatus and the data indicating the property of the first event is also transmitted to the second information processing apparatus.

In another aspect, the present invention provides a method of processing information, comprising an event detection step of detecting an occurrence and a property of a first event in response to a change in state of a region being monitored, on the basis of first data output from a first sensor based on monitoring of the region monitored by the first sensor, a receiving step of receiving data indicating a property of a second event detected by a first information processing apparatus other than a present information processing apparatus, a notification control step of controlling a notification of the first event based on the data indicating the property of the first event and the data indicating the property of the second event, and a transmission step of transmitting data such that if, in the notification control step, the first event is controlled to be notified, second data relating to the first event output by a second sensor based on monitoring of a region monitored by the second sensor is transmitted to a second information processing apparatus other than the present information processing apparatus, and the data indicating the property of the first event is transmitted to the first information processing apparatus and the second information processing apparatus.

In another aspect, the present invention provides a storage medium in which a computer-readable program is stored, the program comprising an event detection step of detecting an occurrence and a property of a first event in response to a change in state of a region being monitored, on the basis of first data output from a first sensor based on monitoring of the region monitored by the first sensor, a receiving step of receiving data indicating a property of a second event detected by a first information processing apparatus other than a present information processing apparatus, a notification control step of controlling a notification of the first event based on the data indicating the property of the first event and the data indicating the property of the second event, and a transmission step of transmitting data such that if, in the notification control step, the first event is controlled to be notified, second data relating to the first event output by a second sensor based on monitoring of a region monitored by the second sensor is transmitted to a second information processing apparatus other than the present information processing apparatus, and the data indicating the property of the first event is transmitted to the first information processing apparatus and the second information processing apparatus.

In another aspect, the present invention provides a program for causing a computer to execute a process comprising an event detection step of detecting an occurrence and a property of a first event in response to a change in state of a region being monitored, on the basis of first data output from a first sensor based on monitoring of the region monitored by the first sensor, a receiving step of receiving data indicating a property of a second event detected by a first information processing apparatus other than a present information processing apparatus, a notification control step of controlling a notification of the first event based on the data indicating the property of the first event and the data indicating the property of the second event, and a transmission step of transmitting data such that if, in the notification control step, the first event is controlled to be notified, second data relating to the first event output by a second sensor based on monitoring of a region monitored by the second sensor is transmitted to a second information processing apparatus other than the present information processing apparatus, and the data indicating the property of the first event is transmitted to the first information processing apparatus and the second information processing apparatus.

In another aspect, the present invention provides an information processing apparatus comprising a first sensor for outputting first data based on monitoring of a region monitored by the first sensor, a second sensor for outputting first data based on monitoring of a region monitored by the second sensor, an event detector for detecting, on the basis of the first data output from the first sensor, an occurrence and a property of a first event in response to a change in state of the monitored region, a receiver for receiving event classification information from a second information processing apparatus different from the present processing apparatus, a notification controller for controlling a notification of the first event based on the received event classification information, and a transmitter for transmitting data such that if the first event is controlled to be notified by the notification controller, the second data, relating to the first event, output by the second sensor and the data indicating the property of the first event are transmitted to the second information processing apparatus.

In another aspect, the present invention provides an information processing method comprising an event detection step of detecting an occurrence and a property of a first event in response to a change in state of a region being monitored, on the basis of first data output from a first sensor based on monitoring of the region monitored by the first sensor, a receiving step of receiving event classification information from a second information processing apparatus different from the present processing apparatus, a notification control step of controlling a notification of the first event based on the received event classification information, and a transmission step of transmitting data such that if, in the notification control step, the first event is controlled to be notified, second data relating to the first event output by a second sensor based on monitoring of a region monitored by the second sensor and the data indicating the property of the first event are transmitted to the second information processing apparatus.

In another aspect, the present invention provides an information processing apparatus comprising a receiver for receiving first data produced according to monitoring of a region monitored by a first sensor so as to indicate a property of a first event, second data produced according to monitoring of a region monitored by a second sensor so as to indicate a property of a second event, third data produced by a third sensor in response to a change in a region monitored by the third sensor, and fourth data produced by a fourth sensor in response to a change in a region monitored by the fourth sensor, a notification controller for controlling a notification of the first event and the second event based on the data indicating the property of the first event and the data indicating the property of the second event, and presentation control means for controlling presentation of data such that if the first event and/or the second event are controlled, by the notification control means, to be notified, the third data, relating to the first event, output by the third sensor and/or the fourth data, relating to the second event, output by the fourth sensor are presented.

The information processing apparatus according to the present invention may further comprise an input acquisition unit for acquiring information input by a user.

In the information processing apparatus according to the present invention, the input acquisition unit may acquire an input of user's evaluation on a presentation provided under the control of the presentation controller, the monitoring system may further comprise an event classification information generator for generating event classification information on the basis of data indicating a property of the first event, data indicating a property of the second event, combined data produced by combining the data indicating the property of the first event and the data indicating the property of the second event, and the input of the user's evaluation acquired by the input acquisition unit, and the notification controller may control the notification of the first event and the second event based on the event classification information.

In the information processing apparatus according to the present invention, the input acquisition unit may acquire an input of user's evaluation as to whether or not a notification is necessary at least for one of the third data and the fourth data presented under the control of the presentation controller.

The information processing apparatus according to the present invention may further comprise an event classification information storage unit for storing the event classification information generated by the event classification information generator.

The information processing apparatus according to the present invention may further comprise an information recording unit for recording, as event information, at least one of the data indicating the property of the first event, the data indicating the property of the second event, and the combined data, in relationship to the input of user's evaluation acquired by the input acquisition unit.

The information processing apparatus according to the present invention may further comprise a mode selector for selecting a mode in which a notification of an event is controlled, on the basis of the event information recorded by the information recording unit and the event classification information, wherein the notification controller may determine, based on the mode selected by the mode selection, which one of the data indicating the property of the first event, the data indicating the second event detected by the second event detector, and the combined data should be used as data according to which to control the event notification.

In the information processing apparatus according to the present invention, the input acquisition unit may acquire a command associated with the mode issued by a user, and the mode selector may select a mode based on the command issued by the user and acquired by the input acquisition unit.

In the information processing apparatus according to the present invention, the notification controller may control the notification of the first event and the second event based on the mode.

In the information processing apparatus according to the present invention, the mode selector may select a mode based on the power consumption of a second information processing apparatus different from the present information processing apparatus.

In the information processing apparatus according to the present invention, the notification controller may control a notification of the first event and the second event based on combined data obtained by combining the data indicating the property of the first event and the data indicating the property of the second event.

In another aspect, the present invention provides an information processing apparatus comprising receiving means for receiving first data produced according to monitoring of a region monitored by a first sensor so as to indicate a property of a first event, second data produced according to monitoring of a region monitored by a second sensor so as to indicate a property of a second event, third data produced by a third sensor in response to a change in a region monitored by the third sensor, and fourth data produced by a fourth sensor in response to a change in a region monitored by the fourth sensor, notification control means for controlling a notification of the first event and the second event based on the data indicating the property of the first event and the data indicating the property of the second event, and presentation control means for controlling presentation of data such that if the first event and/or the second event are controlled, by the notification control means, to be notified, the third data, relating to the first event, output by the third sensor and/or the fourth data, relating to the second event, output by the fourth sensor are presented.

In another aspect, the present invention provides an information processing method comprising an acquisition step of acquiring first data produced according to monitoring of a region monitored by a first sensor so as to indicate a property of a first event, second data produced according to monitoring of a region monitored by a second sensor so as to indicate a property of a second event, third data produced by a third sensor in response to a change in a region monitored by the third sensor, and fourth data produced by a fourth sensor in response to a change in a region monitored by the fourth sensor, a notification control step of controlling a notification of the first event and the second event based on the data indicating the property of the first event and the data indicating the property of the second event, and a presentation control step of controlling presentation of data such that if, in the notification control step, the first event and/or the second event are controlled to be notified, the third data, relating to the first event, output by the third sensor and/or the fourth data, relating to the second event, output by the fourth sensor are presented.

In another aspect, the present invention provides a storage medium in which a computer-readable program is stored, the program comprising an acquisition step of acquiring first data produced according to monitoring of a region monitored by a first sensor so as to indicate a property of a first event, second data produced according to monitoring of a region monitored by a second sensor so as to indicate a property of a second event, third data produced by a third sensor in response to a change in a region monitored by the third sensor, and fourth data produced by a fourth sensor in response to a change in a region monitored by the fourth sensor, a notification control step of controlling a notification of the first event and the second event based on combined data obtained by combining the data indicating the property of the first event and the data indicating the property of the second event, and a presentation control step of controlling presentation of data such that if, in the notification control step, the first event and/or the second event are controlled to be notified, the third data, relating to the first event, output by the third sensor and/or the fourth data, relating to the second event, output by the fourth sensor are presented.

In another aspect, the present invention provides a program for causing a computer to execute a process comprising an acquisition step of acquiring first data produced according to monitoring of a region monitored by a first sensor so as to indicate a property of a first event, second data produced according to monitoring of a region monitored by a second sensor so as to indicate a property of a second event, third data produced by a third sensor in response to a change in a region monitored by the third sensor, and fourth data produced by a fourth sensor in response to a change in a region monitored by the fourth sensor, a notification control step of controlling a notification of the first event and the second event based on the data indicating the property of the first event and the data indicating the property of the second event, a presentation control step of controlling presentation of data such that if, in the notification control step, the first event and/or the second event are controlled to be notified, the third data, relating to the first event, output by the third sensor and/or the fourth data, relating to the second event, output by the fourth sensor are presented.

In an aspect, the present invention provides a monitoring system comprising a first sensor for outputting first data based on monitoring of a region monitored by the first sensor, a second sensor for outputting first data based on monitoring of a region monitored by the second sensor, a third sensor for outputting first data based on monitoring of a region monitored by the third sensor, a fourth sensor for outputting first data based on monitoring of a region monitored by the fourth sensor, a first event detector for detecting, on the basis of the first data output from the first sensor, a first event in response to a change in state of the region being monitored, a second event detector for detecting, on the basis of the second data output from the second sensor, a second event in response to a change in state of the monitored region, a notification controller for controlling a notification of the first event and the second event based on data indicating the first event detected by the first event detector and data indicating the second event detected by the second event detector, and a presentation controller for controlling presentation of data such that if the first event and/or the second event are controlled, by the notification controller, to be notified, the third data, relating to the first event, output by the third sensor and/or the fourth data, relating to the second event, output by the fourth sensor are presented.

In another aspect, the present invention provides an information processing method comprising a first event detection step of detecting a first event in response to a change in state of a region being monitored, on the basis of first data output from a first sensor based on monitoring the region monitored by the first sensor, a second event detection step of detecting a second event in response to a change in state of a region being monitored, on the basis of second data output from a second sensor based on monitoring the region monitored by the second sensor, a notification control step of controlling a notification of the first event and the second event based on data indicating the first event detected in the first event detection step and data indicating the second event detected in the second event detection step, and a presentation control step of controlling presentation of data such that if, in the notification control step, the first event and/or the second event are controlled to be notified, third data relating to the first event output by a third sensor in accordance with monitoring of a region monitored by the third sensor and/or fourth data relating to the second event output by a fourth sensor in accordance with monitoring of a region monitored by the fourth sensor are presented.

BRIEF DESCRIPTION OF THE DRAWINGS

FIG. 8 is a diagram showing an example of a state number transition pattern of the monitoring system shown in FIG. 3A;

FIG. 13 is a diagram showing an example of data in a notification-unnecessary event table used by the monitoring system shown in FIG. 3A according to the present invention;

FIG. 18 is a diagram showing an example of data in state history data used by the monitoring system shown in FIG. 3A according to the present invention;

FIG. 19 is a diagram showing an example of data in state history data used by the monitoring system shown in FIG. 3A according to the present invention;

FIG. 21 is a flow chart showing a monitoring process performed by a server in step S23 in FIG. 15;

FIG. 23 is a diagram showing an example of data in state history data used by the monitoring system shown in FIG. 3A according to the present invention;

FIG. 24 is a diagram showing an example of data in state history data used by the monitoring system shown in FIG. 3A according to the present invention;

FIG. 25 is a diagram showing an example of data in state history data used by the monitoring system shown in FIG. 3A according to the present invention;

FIG. 26 is a diagram showing an example of data in state history data used by the monitoring system shown in FIG. 3A according to the present invention;

FIG. 27 is a diagram showing an example of data in state history data used by the monitoring system shown in FIG. 3A according to the present invention;

FIG. 28 is a diagram showing an example of data in state history data used by the monitoring system shown in FIG. 3A according to the present invention;

FIG. 29 is a diagram showing an example of data in state history data used by the monitoring system shown in FIG. 3A according to the present invention;

FIG. 30 is a diagram showing an example of data in state history data used by the monitoring system shown in FIG. 3A according to the present invention;

FIG. 31 is a diagram showing an example of data in state history data used by the monitoring system shown in FIG. 3A according to the present invention;

FIG. 32 is a diagram showing an example of data in state history data used by the monitoring system shown in FIG. 3A according to the present invention;

FIG. 34 is a diagram showing an example of data in a notification-unnecessary event table used by the monitoring system shown in FIG. 3A according to the present invention;

FIG. 35 is a diagram showing an example of data in state history data used by the monitoring system shown in FIG. 3A according to the present invention;

FIG. 36 is a diagram showing an example of data in state history data used by the monitoring system shown in FIG. 3A according to the present invention;

FIG. 37 is a diagram showing an example of data in state history data used by the monitoring system shown in FIG. 3A according to the present invention;

FIG. 38 is a diagram showing an example of data in state history data used by the monitoring system shown in FIG. 3A according to the present invention;

FIG. 45 is a diagram showing an example of data in state history data used by the monitoring system shown in FIG. 3A according to the present invention;

FIG. 46 is a diagram showing an example of data in state history data used by the monitoring system shown in FIG. 3A according to the present invention;

FIG. 48 is a flow chart showing a monitoring process performed by a server in step S24 in FIG. 15;

FIG. 49 is a diagram showing an example of data in state history data used by the monitoring system shown in FIG. 3A according to the present invention;

FIG. 50 is a diagram showing an example of data in state history data used by the monitoring system shown in FIG. 3A according to the present invention;

FIG. 51 is a diagram showing an example of data in status wish career data used by the monitoring system shown in FIG. 3A according to the present invention;

FIG. 52 is a diagram showing an example of data in state history data used by the monitoring system shown in FIG. 3A according to the present invention;

FIG. 53 is a diagram showing an example of data in state history data used by the monitoring system shown in FIG. 3A according to the present invention;

FIG. 54 is a diagram showing an example of data in state history data used by the monitoring system shown in FIG. 3A according to the present invention;

FIG. 55 is a diagram showing an example of data in state history data used by the monitoring system shown in FIG. 3A according to the present invention;

DESCRIPTION OF THE PREFERRED EMBODIMENTS

The present invention is described in further detail below with reference to preferred embodiments in conjunction with the accompanying drawings.

Figure 1:
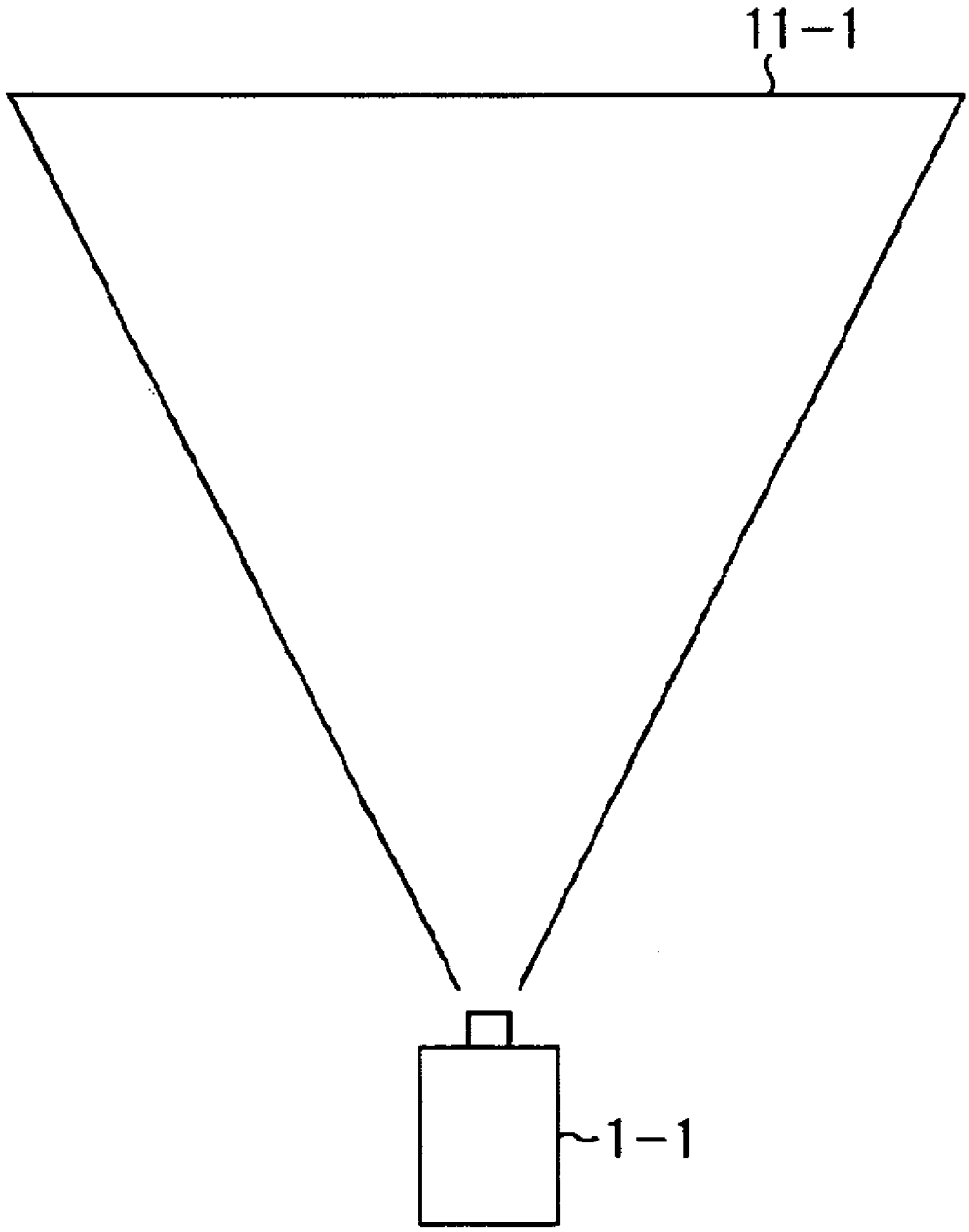
FIG. 1 is a diagram showing a region monitored by a multi-sensor camera.
Figure 2:
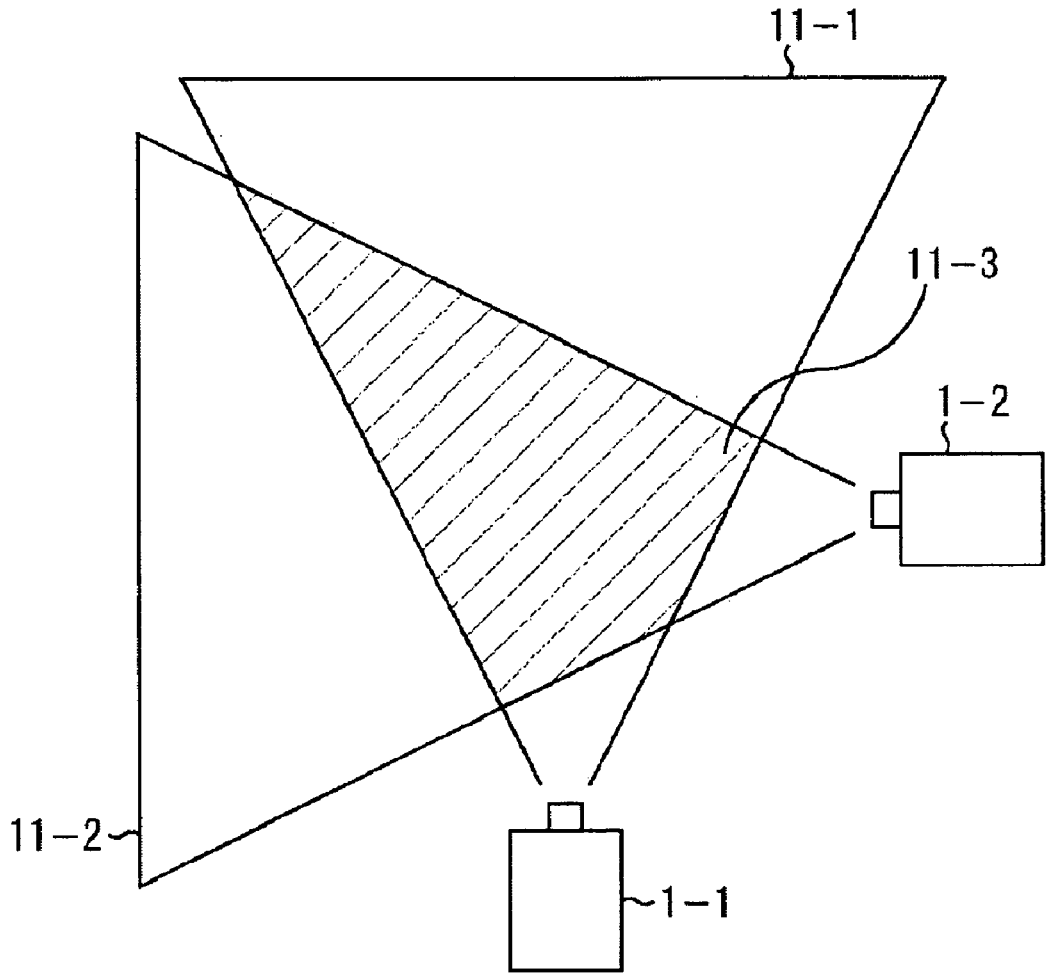
FIG. 2 is a diagram showing a region monitored by a multi-sensor camera.

FIG. 1 shows a region monitored by a single multi-sensor camera 1-1 in a monitoring system. FIG. 2 shows regions monitored by two multi-sensor cameras 1-1 and 1-2 in a monitoring system. In the monitoring system shown in FIG. 1, the monitorable region is limited to the region 11-1 monitored by the multi-sensor camera 1-1. In contrast, in the monitoring system shown in FIG. 2, the provision of the additional multi-sensor camera 1-2 for monitoring a region 11-2 allows a wider region to be covered and allows a greater number of events to be detected.

In the monitoring system shown in FIG. 2, it is possible to distinguish various states in which an event is detected. The distinguishable states include a state in which an event is detected only by the multi-sensor camera 1-1 (this can occur when an event occurs in the monitored region 11-1 other than a monitored region 11-3 (where the monitored regions 11-1 and 11-2 overlap each other) shown in FIG. 2), a state in which an event is detected only by the multi-sensor camera 1-2 (this can occur when an event occurs in the monitored region 11-2 other than the monitored region 11-3 (where the monitored regions 11-1 and 11-2 overlap each other) shown in FIG. 2), and a state in which an event is detected by both multi-sensor cameras 1-1 and 1-2 (this can occur when an event occurs in the monitored region 11-3 shown in FIG. 2). Thus, the monitoring system shown in FIG. 2 can analyze an event in greater detail by detecting in which region the event occurs than can be by the monitoring system shown in FIG. 1. On the basis of the analysis result, it is determined whether it is necessary to notify the user of the occurrence of the event, and the event is notified to the user according to the determination result. Thus, it is possible to provide necessary and sufficient information to the user.

Figure 3A:
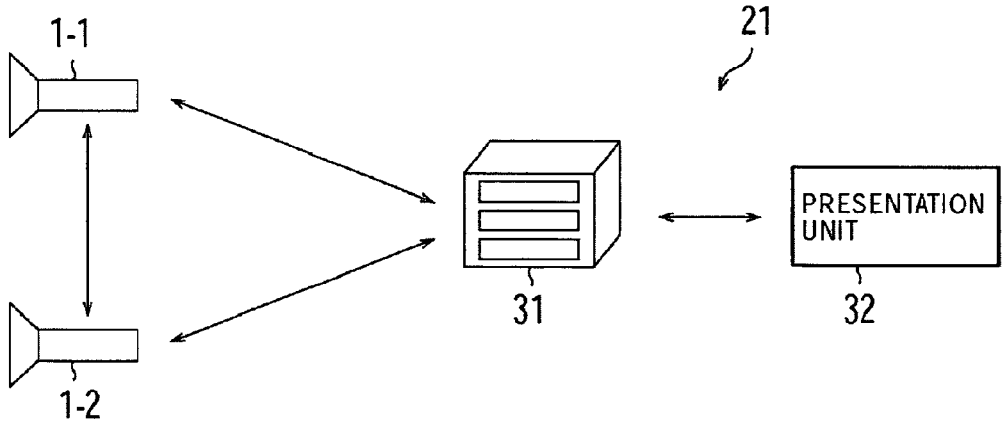
FIG. 3A is a diagram showing an embodiment of a monitoring system according to the present invention.
Figure 3B:
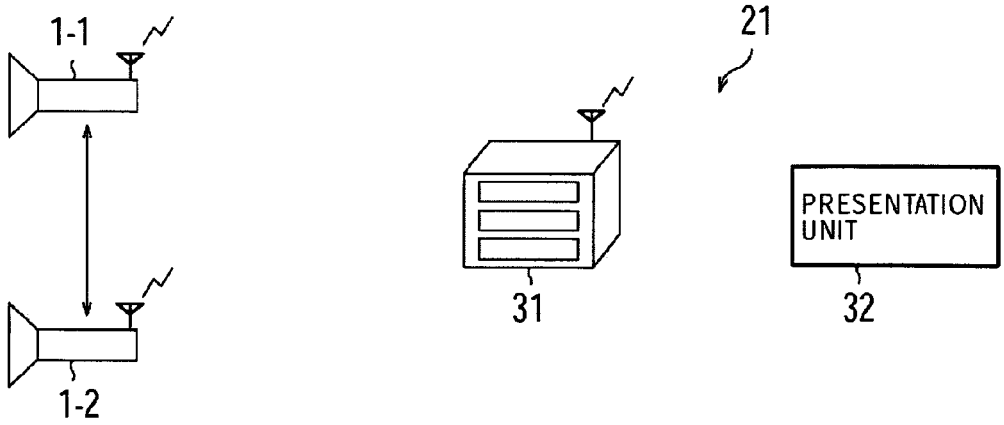
FIG. 3B is a diagram showing an embodiment of a monitoring system according to the present invention.

FIG. 3A shows an example of a configuration of a monitoring system 21 according to the present invention. In this example, multi-sensor cameras 1-1 and 1-2 are disposed so as to monitor a region on the left-hand side of the figure, and a server 31 and a presentation unit 32 are disposed on the right-hand side of the figure. As shown in FIG. 3B, the multi-sensor camera 1-1, the multi-sensor camera 1-2, and the server 31 communicate with each other by means of wireless communication. The presentation unit 32 wirelessly connected with the server 31 may be a common television receiver or a dedicated monitor.

Each of the multi-sensor cameras 1-1 and 1-2 includes a sensor for monitoring a particular region (that should be monitored) to detect an event in that region. In the following description, it is assumed that regions monitored by the respective multi-sensor cameras 1-1 and 1-2 are located such that they extend in directions substantially perpendicular to each other and they partially overlap each other as shown in FIG. 2.

FIGS. 4 to 7 show examples of regions monitored by the respective multi-sensor cameras 1-1 and 1-2 and also show examples of events occurring in the monitored regions. First, referring to FIG. 4, the regions monitored by the monitoring system 21 and classification of event states are described.

The multi-sensor camera 1-1 has a photosensor 51-1 and the multi-sensor camera 1-2 has a photosensor 51-2. As described above with reference to FIG. 2, the photosensor 51-1 monitors a region 11-1 and the photosensor 51-2 monitors a region 11-2. A region where the monitored regions 11-1 and 11-2 overlap each other is referred to as a monitored region 11-3. If the change in amount of light sensed by the photosensor 51-1 or 51-2 is greater than a predetermined threshold value, it is determined that an event occurs.

In the monitoring system 21, states of events are classified according to the state in which an event is detected by the photosensor 51-1 of the multi-sensor camera 1-1 and/or the photosensor 51-2 of the multi-sensor camera 1-2. For a single event, three states are defined as follows. A first one is a state of the event detected by the single multi-sensor camera 1-1 (hereinafter, referred to simply as a single state). A second one is a state of the event detected by the single multi-sensor camera 1-2 (this state is also a single state). A third one is a combination of states detected by both multi-sensor cameras 1-1 and 1-2 (hereinafter referred to simply as a combined state). Each classified state is assigned a number (state number). A state number assigned to a single state detected by the multi-sensor camera 1-1 is referred to as a single state number of the multi-sensor camera 1-1. A state number assigned to a single state detected by the multi-sensor camera 1-2 is referred to as a single state number of the multi-sensor camera 1-2. A state number assigned to a combination of states (combined state) detected by the multi-sensor cameras 1-1 and 1-2 is referred to as a combined state number.

The single state number of the multi-sensor camera 1-1 is assigned as follows. When an event occurs in the monitored region 11-1 (when an event is detected by the photosensor 51-1), 0x01 is assigned as the single state number. When there is no event in the monitored region 11-1 (when no event is detected by the photosensor 51-1), 0x00 is assigned as the single state number. Similarly, the single state number of the multi-sensor camera 1-2 is assigned as follows. When an event occurs in the monitored region 11-2 (when an event is detected by the photosensor 51-2), 0x01 is assigned as the single state number. When there is no event in the monitored region 11-2 (when no event is detected by the photosensor 51-2), 0x00 is assigned as the single state number.

As for combined states, combined state numbers are assigned differently depending on whether control/decision is performed by the server 31 or the multi-sensor cameras 1-1 and 1-2. In the case in which the control/decision is performed by the server 31, 0x01 is assigned as the combined state number of the server 31 when an event occurs only in the monitored region 11-1 (when an event is detected only by the photosensor 51-1), 0x10 when an event occurs only in the monitored region 11-2 (when an event is detected only by the photosensor 51-2), 0x11 when an event occurs in the monitored region 11-3 (when an event is detected by both photosensors 51-1 and 51-2), and 0x00 when there is no event (when no event is detected by the photosensors 51-1 and 51-2).

In the case in which the control/decision is performed by the multi-sensor camera 1-1 or 1-2, 0x01 is assigned as the combined state number of the multi-sensor camera (1-1 or 1-2) when an event occurs only in the region monitored by the present multi-sensor camera (1-1 or 1-2), 0x10 when an event occurs only in the region monitored by the other multi-sensor camera, 0x11 when an event occurs in the region (monitored region 11-3) where the region monitored by the present multi-sensor camera and the region monitored by the other multi-sensor camera overlap each other, and 0x00 when there is no event.

Figure 4:
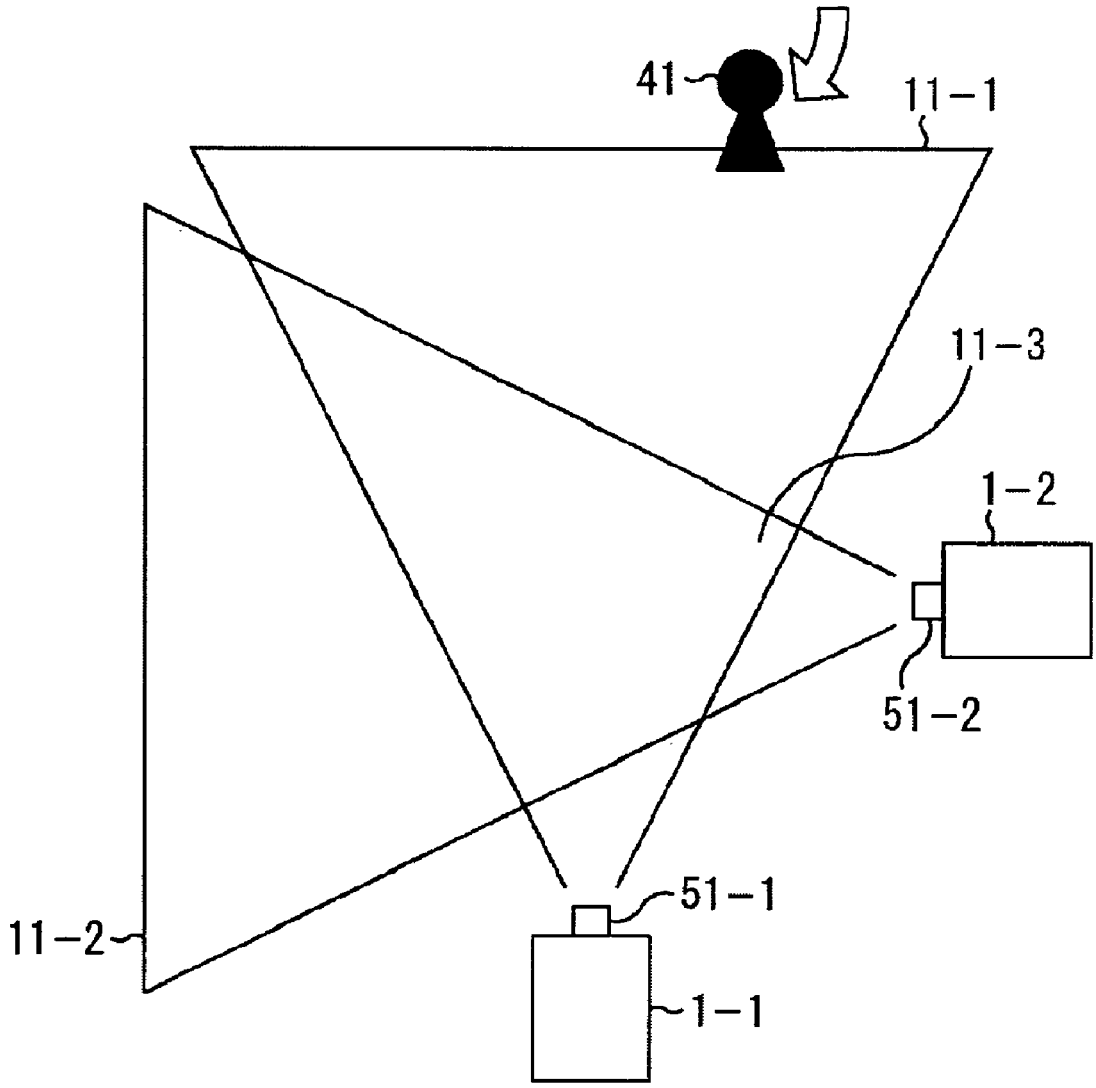
FIG. 4 is a diagram showing an example of an event detected by the monitoring system shown in FIG. 3A.
Figure 5:
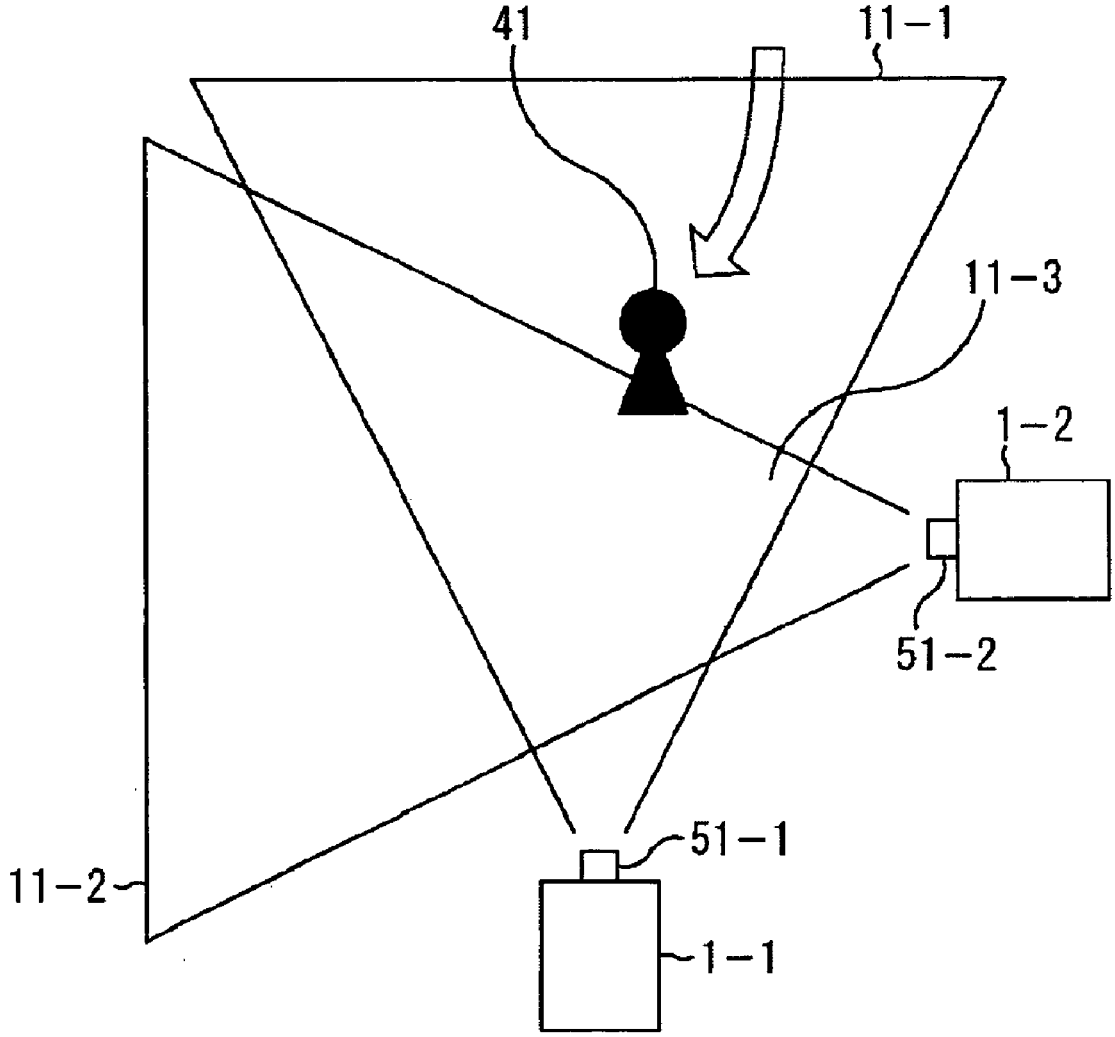
FIG. 5 is a diagram showing an example of an event detected by the monitoring system shown in FIG. 3A.
Figure 6:
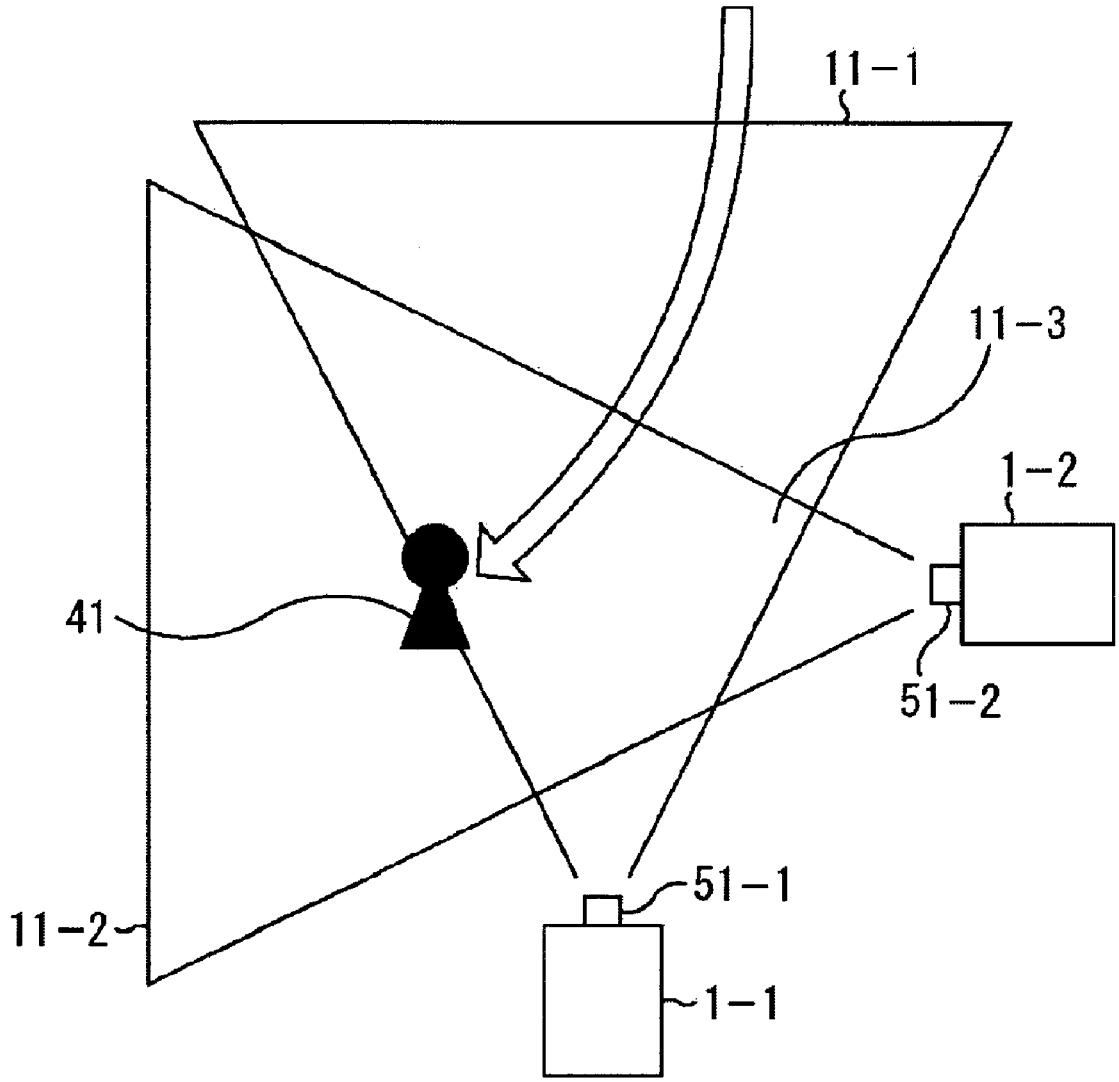
FIG. 6 is a diagram showing an example of an event detected by the monitoring system shown in FIG. 3A.
Figure 7:
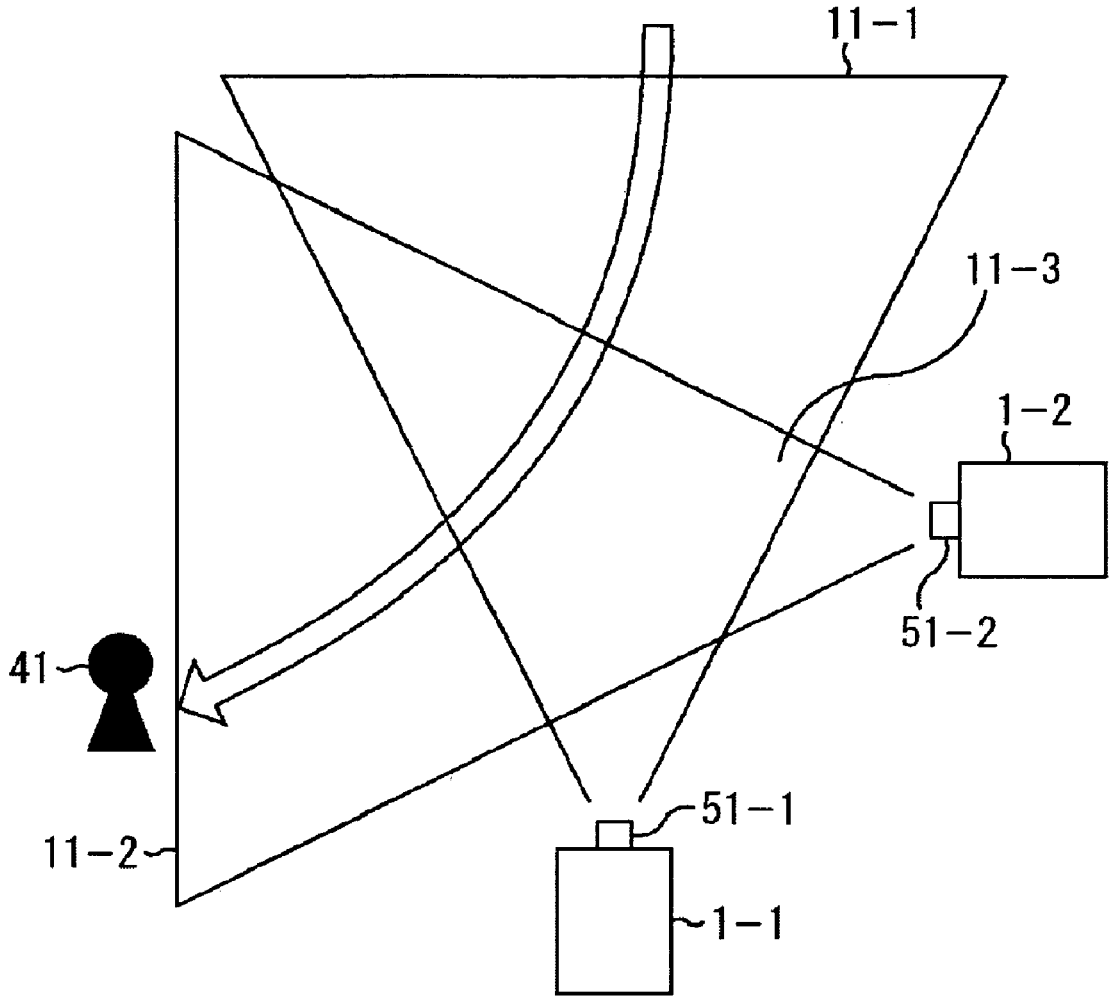
FIG. 7 is a diagram showing an example of an event detected by the monitoring system shown in FIG. 3A.

Herein let us assume that an event is detected in a region monitored by the monitoring system 21, and the state of the event changes in the order as shown in FIGS. 4 to 7. FIG. 4 shows a state in which a person 41 enters the monitored region 11-1 at a time T=t1, and thus an event occurs in the region monitored by the monitoring system 21. FIG. 5 shows a state in which the person 41 enters the monitored region 11-3, m sec after the state shown in FIG. 4, that is, at a time T=t+m. FIG. 6 shows a state in which the person 41 goes out of the monitored regions 11-1 and enters the monitored region 11-2 at T=t+m+n, that is, n sec after the state shown in FIG. 5. FIG. 7 shows a state in which the person 41 goes out of the region covered by the monitoring system 21 and thus the event is over at T=t+m+n+p, that is, p sec after the state shown in FIG. 6.

FIG. 8 is a table showing event state numbers associated with the events at respective times (in the respective states) shown in FIGS. 4 to 7. The first row of the table shown in FIG. 8 represents the time. Herein, the state at T=t corresponds to the state shown in FIG. 4, the state at T=t+m in FIG. 5, the state at T=t+m+n in FIG. 6, and the state at T=t+m+n+o in FIG. 7. Specific values of state numbers are described in respective rows from the second row to the bottom row in FIG. 8. For example, at T=t, the single state number of the multi-sensor camera 1-1 is 0x01, the single state number of the multi-sensor camera 1-2 is 0x00, the combined state number of the multi-sensor camera 1-1 is 0x01, the combined state number of the multi-sensor camera 1-2 is 0x10, and the combined state number of the server 31 is 0x01.

Herein, a sequence of transitions of event state numbers from the start to the end of an event refers to as a state transition pattern. Each state transition pattern includes a sequence of transitions of state numbers in a period during which an event occurs but does not include state numbers in a period during which no event occurs. In the example shown in FIGS. 4 to 7, when an event occurs in the monitored region 11-2 at a time T=t+m, the single state number of the multi-sensor camera 1-2 changes from 0x00 to 0x01, and the single state number changes from 0x01 to 0x00 when the event in the monitored region 11-2 ends at a time T=t+m+n+p. When an event is occurring in the monitored region 11-2, the single state number of the multi-sensor camera 1-2 remains in 0x01 without changing into another state number. Therefore, the single state transition pattern of the multi-sensor camera 1-2 includes only a single state number 0x01.

In the example shown in FIGS. 4 to 7, the combined state number of the server 31 is 0x01 at T=t and changes from 0x01 to 0x11 at T=t+m, and from 0x11 to 0x10 at T=t+m+n. When the event ends at T=t+m+n+p, the combined state number changes from 0x10 to 0x00. Thus, the combined state transition pattern of the server 31 is given by a sequence of combined states 0x01, 0x11, and 0x10.

Similarly, in the example shown in FIGS. 4 to 7, the single state transition pattern of the multi-sensor camera 1-1 is given by a single state 0x01, the combined state transition pattern of the multi-sensor camera 1-1 is given by a sequence of combined state 0x01, combined state 0x11, and combined state 0x10, and the combined state transition pattern of the multi-sensor camera 1-2 is given by a sequence of combined state 0x10, combined state 0x11, and combined state 0x01.

Herein, data indicating an event state transition pattern and durations of respective states is referred to as state history data. In the example shown in FIGS. 4 to 7, the single state 0x01 described in the state transition pattern of the multi-sensor camera 1-2 remains in this state for a period of n+p sec from T=t+m, at which the single state changes from 0x00 to 0x01, to T=t+m+n+p at which the single state changes from 0x01 to 0x00. Thus, the single state history data of the multi-sensor camera 1-2 is given by a combination of single state 0x01 and a duration n+p sec (hereinafter, a combination of a state number and a duration will be represented in a simple form of "state number (duration)" such as "single state 0x01 (n+p sec)".

On the other hand, in the example shown in FIGS. 4 to 7, the combined state of the server 31 is in 0x01 for m sec, 0x11 for n sec, and 0x10 for p sec, and thus the combined state history data of the server 31 is given by a sequence of combined state 0x01 (m sec), combined state 0x11 (n sec), and combined state 0x10 (p sec).

In the example shown in FIGS. 4 to 7, the single state history data of the multi-sensor camera 1-1 is described as single state 0x01 (m+n sec). Furthermore, in this example, the combined state history data of the multi-sensor camera 1-1 is described by a sequence of combined state 0x01 (m sec), combined state 0x11 (n sec), and combined state 0x10 (p sec), and the combined state history data of the multi-sensor camera 1-2 is described by a sequence of combined state 0x10 (m sec), combined state 0x11 (n sec), and combined state 0x01 (p sec).

The monitoring operation of the monitoring system 21 is performed in one of two operation modes depending on whether a decision on whether to notify a user of an occurrence of an event in a monitored region is made on the basis of a combined state of the multi-sensor cameras 1-1 and 1-2 or on the basis of a single state of each of the multi-sensor cameras 1-1 and 1-2 (hereinafter, the decision will be referred to as event notification decision). The former mode is referred to as a combined mode and the latter mode is referred to as a single mode. The combined mode has two sub modes depending on whether the event notification decision in the combined mode is made by a multi-sensor camera (1-1 or 1-2) or the server 31. The former refers to as a controlled-by-camera mode, and the latter refers to as a controlled-by-server mode. In the single mode, the event notification decision is always made by the multi-sensor camera 1-1 or 1-2, and the server 31 is not concerned with the event notification decision (that is, in the single mode, only the controlled-by-camera mode is allowed). Thus, the monitoring operation by the monitoring system 21 has a total of three modes: controlled-by-server combined mode (combined mode and controlled-by-server mode), controlled-by-camera combined mode (combined mode and controlled-by-camera mode), and controlled-by-camera single mode (single mode and controlled-by-camera mode).

FIG. 3A show a flow of information in the monitoring system 21 in the controlled-by-camera combined mode. If the multi-sensor camera 1-1 or 1-2 detects a change in state of event in the region assigned to the multi-sensor camera 1-1 or 1-2, the multi-sensor camera 1-1 or 1-2 notifies the other camera of the change in state of event. A notification signal transmitted to the other camera is referred to as a state change notification. The state change notification includes data indicating a single state number of the multi-sensor camera 1-1 or 1-2 at that time. If the multi-sensor camera 1-1 or 1-2 receives a state change notification, the multi-sensor camera produces combined state history data of the multi-sensor cameras 1-1 and 1-2 on the basis of the state of an event detected by the present multi-sensor camera and the state change notification received from the other multi-sensor camera. The multi-sensor camera 1-1 or 1-2 makes the event notification decision on the basis of the resultant combined state history data. The details of the event notification decision will be described later with reference to FIG. 13. If it is determined that it is necessary to notify the user of the occurrence of the event, the multi-sensor camera 1-1 or 1-2 transmits image data to the server 31. The server 31 generates presentation data from the received image data and supplies the generated presentation data to the presentation unit 32. The presentation unit 32 performs presentation based on the received presentation data.

Figure 9:
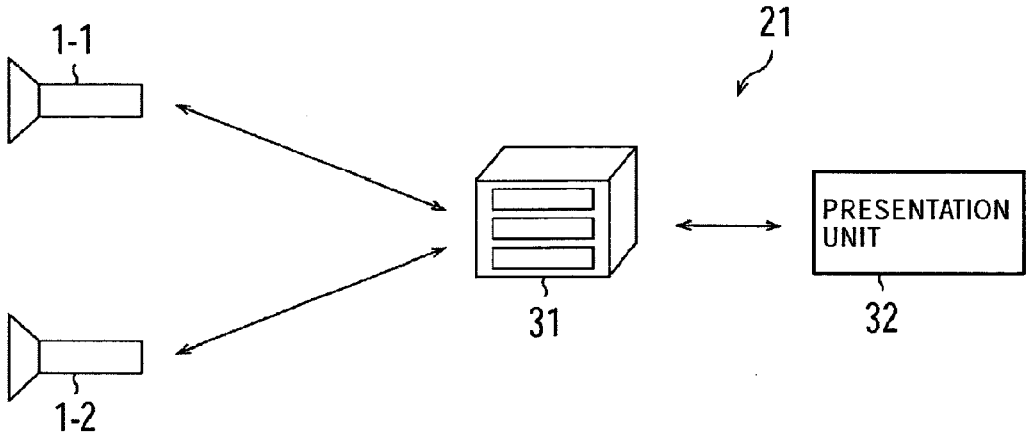
FIG. 9 is a diagram showing an example of a flow of information in the monitoring system shown in FIG. 3A.

FIG. 9 show a flow of information in the monitoring system 21 in the controlled-by-server combined mode. If the multi-sensor camera 1-1 or 1-2 detects a change in state of event in the region assigned to the multi-sensor camera 1-1 or 1-2, the multi-sensor camera 1-1 or 1-2 transmits a state change notification to the server 31. The server 31 produces combined state history data of the multi-sensor cameras 1-1 and 1-2 on the basis of the state change notification received from the multi-sensor cameras 1-1 and 1-2, and the server 31 makes the event notification decision on the basis of the resultant combined state history data. If it is determined that it is necessary to notify the user of the occurrence of the event, the server 31 requests the multi-sensor cameras 1-1 and 1-2 to transmit image data. In response, the multi-sensor cameras 1-1 and 1-2 transmit image data to the server 31. The server 31 generates presentation data from the received image data and supplies the generated presentation data to the presentation unit 32. The presentation unit 32 performs presentation based on the received presentation data.

Figure 10:
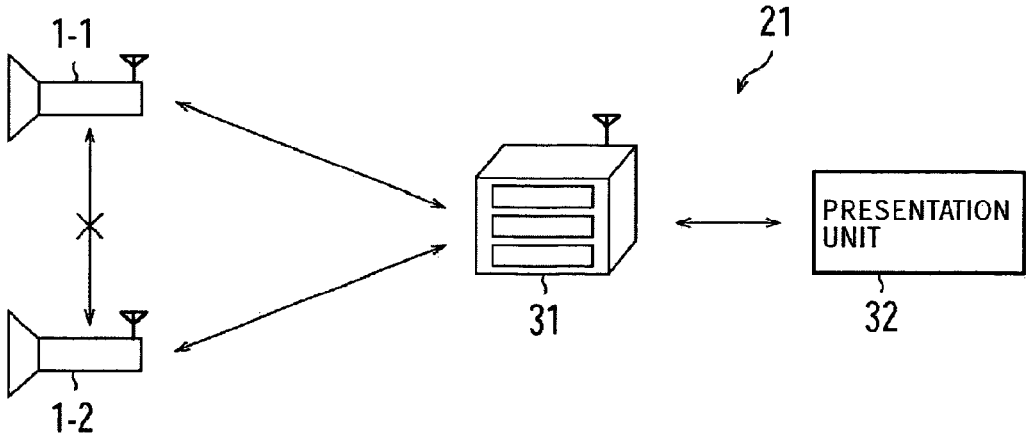
FIG. 10 is a diagram showing an example of a flow of information in the monitoring system shown in FIG. 3A.

FIG. 10 shows a flow of information in the monitoring system 21 in the controlled-by-camera single mode. In the controlled-by-camera single mode, unlike the controlled-by-server combined mode and the controlled-by-camera combined mode, the multi-sensor cameras 1-1 and 1-2 do not transmit a state change notification even if a change in state of event occurs in a monitored region. When a multi-sensor camera (1-1 or 1-2) detects a change in state of event in a monitored region, the multi-sensor camera (1-1 or 1-2) determines, on the basis of its single state history data, whether it is necessary to notify the user of the change in state of event. If it is determined that it is necessary to notify the user of the occurrence of the event, the multi-sensor camera, which is detecting the event of interest, transmits image data to the server 31. The server 31 generates presentation data from the received image data and supplies the generated presentation data to the presentation unit 32. The presentation unit 32 performs presentation based on the received presentation data.

In the controlled-by-server combined mode and also in the controlled-by-camera combined mode, when an event occurs which should be notified to the user, the event is not necessarily detected by all multi-sensor cameras. Therefore, in the monitoring system 21, transmission of image is controlled such that image data is transmitted only from a multi-sensor camera or multi-sensor cameras actually detecting the event.

For example, in the event shown in FIGS. 4 to 7, when the monitoring system 21 operates in the controlled-by-server combined mode or controlled-by-camera combined mode, if the event shown in FIG. 4 is evaluated such that it is necessary to notify the user of the occurrence of the event, only the multi-sensor camera 1-1 starts transmitting image data to the server 31 because the event is occurring only in the region 11-1 monitored by the multi-sensor camera 1-1, and the multi-sensor camera 1-2 transmits no image data.

In the state shown in FIG. 5, the event is also detected in the region 11-2 monitored by the multi-sensor camera 1-2, and thus image data is also transmitted from the multi-sensor camera 1-2 to the server 31. Thus image data is transmitted to the server 31 from both multi-sensor cameras 1-1 and 1-2.

In the state shown in FIG. 6, the event is over in the region 11-1 monitored by the multi-sensor camera 1-1, and thus transmission of image data from the multi-sensor camera 1-1 is stopped. Thus, thereafter, image data is transmitted to the server 31 only from the multi-sensor camera 1-2. This makes it possible to present an event that should be presented to the user while minimizing the power consumed by the multi-sensor cameras 1-1 and 1-2.

In the controlled-by-server combined mode and controlled-by-camera combined mode, because the event notification decision is made on the basis of the combination of states of the multi-sensor cameras 1-1 and 1-2, it is possible to analyze the details of the state of an event and determine whether to notify the event to a user on the basis of the result of detailed analysis. This allows an increase in event detection accuracy (that is defined as the ratio of the number of correctly detected events that should be notified to the user to the total number of events actually notified to the user by the monitoring system 21). Furthermore, the reduction in the number of events actually notified to the user allows a reduction in power consumption. However, a state change notification is transmitted between the multi-sensor cameras 1-1 and 1-2 or between the server 31 and the multi-sensor cameras 1-1 and 1-2 each time a change occurs in the state of the multi-sensor camera 1-1 or 1-2, and thus the state change notification can cause an increase in power consumed by the multi-sensor cameras 1-1 and 1-2.

In the controlled-by-server combined mode, because the process of detecting an occurrence of an event is performed by the server 31, the multi-sensor cameras 1-1 and 1-2 need lower power than in the controlled-by-camera combined mode. However, in the controlled-by-server combined mode, because the server 31 is concerned with the detection of events, there is a risk that powering-off of the server 31 may make it impossible for the monitoring system 21 to detect events. In the controlled-by-camera combined mode, in contrast, even when the server 31 is powered off, detection of events is continued although presentation of events is impossible. Storing data indicating detected events can reduce the risk that events may not be detected.

In the monitoring system 21, as will be described later with reference to FIG. 33, an operation mode selection process is performed to select a most suitable operation mode from the three modes described above depending on a request from a user or the state of a detected event, and the monitoring operation is continued in the selected operation mode.

Figure 11:
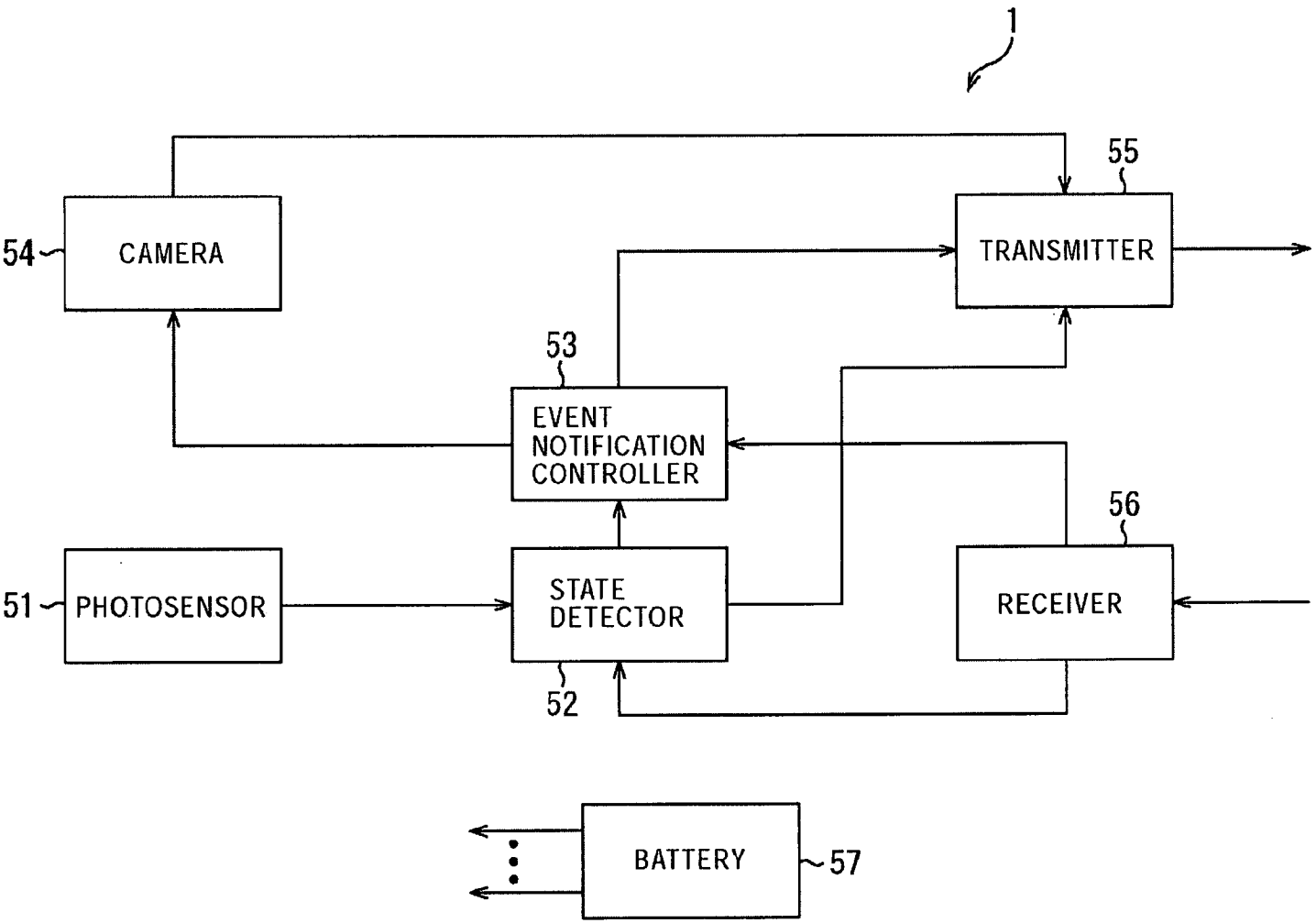
FIG. 11 is a diagram showing functional blocks of a multi-sensor camera shown in FIG. 1.

FIG. 11 is a diagram showing functional blocks of each of multi-sensor cameras 1-1 and 1-2 shown in FIG. 3A.

Each of multi-sensor cameras 1-1 and 1-2 includes a photosensor 51, a state detector 52, an event notification controller 53, a camera 54, a transmitter 55, a receiver 56, and a battery 57.

The state detector 52 detects an event on the basis of data (sensor data) supplied from the photosensor 51 and records/updates the single state history data associated with the occurring event. When the state detector 52 detects a change in the state of the event in the region being monitored, the state detector 52 transmits, via the transmitter 55, a state change notification to the server 31 if the operation is performed in the controlled-by-server combined mode or to the other multi-sensor camera if the operation is performed in the controlled-by-camera combined mode. In the controlled-by-camera combined mode, the state detector 52 transmits the state change notification also to the event notification controller 53.

In the controlled-by-server combined mode, the event notification controller 53 controls the operation such that if an image transmission start command is received from the server 31 via the receiver 56, the power of the camera 54 is turned on depending on whether an event is occurring in the assigned region, and image data taken by the camera 54 is transmitted to the server 31 via the transmitter 55. The event notification controller 53 also controls the operation such that if an image transmission end command is received from the server 31 via the receiver 56, the power of the camera 54 is turned off and transmission of image data to the server 31 is ended based on the received image transmission end command.

In the controlled-by-camera combined mode, the event notification controller 53 receives a state change notification from the other multi-sensor camera via the receiver 56. The event notification controller 53 determines the combined state history data of the present multi-sensor camera on the basis of the state change notification received from the other multi-sensor camera and the state change notification of the present multi-sensor camera acquired from the state detector 52. The event notification controller 53 makes the event notification decision on the basis of the resultant combined state history data and the notification-unnecessary event table (described later) acquired from the server 31. If, it is determined, in the event notification decision, that an event currently occurring is an event that should be notified to the user, the event notification controller 53 controls the operation such that the power of the camera 54 is turned on depending on whether the event is occurring in the assigned region, and image data taken by the camera 54 is transmitted to the server 31 via the transmitter 55.

If the event notification controller 53 receives an image transmission end command from the server 31 via the receiver 56, the event notification controller 53 controls the operation such that the power of the camera 54 is turned off and transmission of image data to the server 31 is ended based on the received image transmission end command. When the event whose image data is being transmitted based on the affirmative event notification decision is over, the event notification controller 53 controls the operation such that an end-of-event notification including the single state history data of the present multi-sensor camera and the combined state history data is transmitted to the server 31 via the transmitter 55, and the power of the camera 54 is turned off thereby ending the transmission of image data to the server 31.

In the controlled-by-camera single mode, the event notification controller 53 acquires the single state history data associated with the present multi-sensor camera from the state detector 52 and makes the event notification decision on the basis of the acquired single state history data and the notification-unnecessary event table. If, it is determined, in the event notification decision, that an event currently occurring in the monitored region assigned to the present multi-sensor camera is an event that should be notified to the user, the event notification controller 53 controls the operation such that the power of the camera 54 is turned on, and image data taken by the camera 54 is transmitted to the server 31 via the transmitter 55.

If the event notification controller 53 receives an image transmission end command from the server 31 via the receiver 56, the event notification controller 53 controls the operation such that the power of the camera 54 is turned off and transmission of image data to the server 31 is ended based on the received image transmission end command. When the event whose image data is being transmitted based on the affirmative event notification decision is over, the event notification controller 53 controls the operation such that an end-of-event notification including the single state history data of the present multi-sensor camera is transmitted to the server 31 via the transmitter 55, and the power of the camera 54 is turned off thereby ending the transmission of image data to the server 31.

The event notification controller 53 sets the notification-necessary event occurrence flag and the image transmission enable flag and stores them, as will be described in detail later. The event notification controller 53 receives a notification-unnecessary event table from the server 31 via the receiver 56 and stores the received table.

The transmitter 55 communicates via a wireless communication channel with the receiver 72 of the server 31 or the receiver 56 of the other multi-sensor camera to transmit a state change notification to the server 31 or the other multi-sensor camera or to transmit image data or an end-of-event notification to the server 31.

The receiver 56 communicates via a wireless communication channel with the transmitter 71 of the server 31 or the transmitter 55 of the other multi-sensor camera to receive an image transmission start command, an image transmission end command, or a notification-unnecessary event table from the server 31 or to receive a state change notification from the other multi-sensor camera. After completion of the mode selection process, the receiver 56 receives an operation mode notification from the server 31 and transfers the received operation mode notification to the state detector 52 and the event notification controller 53.

The battery 57 supplies necessary electric power to various parts of the multi-sensor cameras 1-1 and 1-2.

Figure 12:
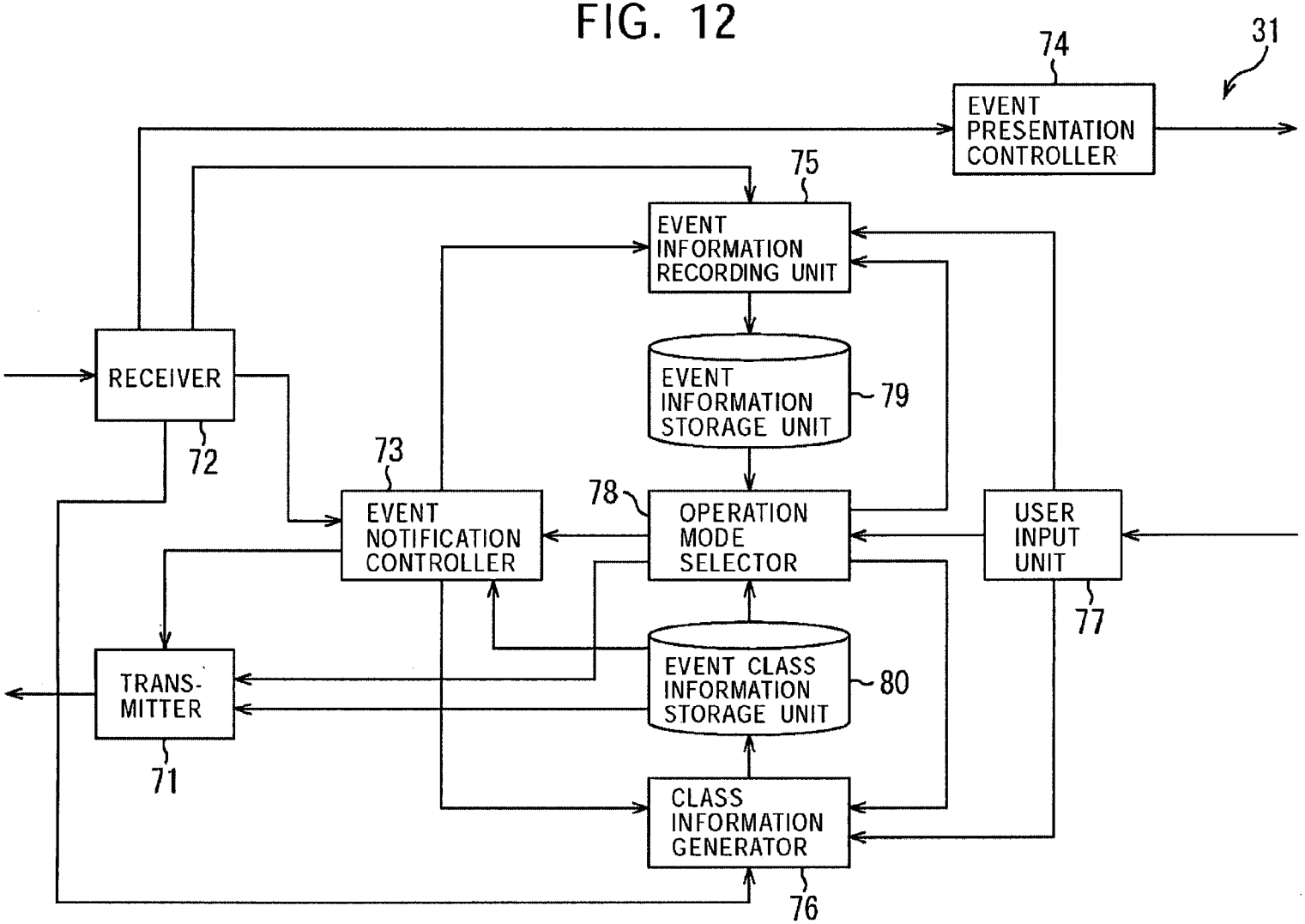
FIG. 12 is a diagram showing functional blocks of a server shown in FIG. 1.

FIG. 12 is a diagram showing functional blocks of the server 31 shown in FIG. 3A.

The server 31 includes a transmitter 71, a receiver 72, an event notification controller 73, the event presentation controller 74, an event information recording unit 75, a classification information generator 76, a user input unit 77, an operation mode selector 78, an event information storage area 79, and an event classification information storage unit 80.

The transmitter 71 communicates via a wireless communication channel with the receiver 56 of the multi-sensor cameras 1-1 and 1-2 to transmit an image transmission start command, an image transmission end command, a notification-unnecessary event table, and an operation mode notification to the multi-sensor cameras 1-1 and 1-2.

The receiver 72 communicates via a wireless communication channel with the transmitter 55 of the multi-sensor cameras 1-1 and 1-2 to receive a state change notification, image data, and an end-of-event notification from the multi-sensor cameras 1-1 and 1-2.

In the controlled-by-server combined mode, the event notification controller 73 generates combined state history data associated with the multi-sensor cameras 1-1 and 1-2 on the basis of the state change notification received, via the receiver 72, from the multi-sensor cameras 1-1 and 1-2. The event notification controller 73 makes the event notification decision on the basis of the resultant combined state history data and the notification-unnecessary event table stored in the event classification information storage unit 80. If it is determined that it is necessary to notify the user of an occurrence of a current event, the event notification controller 73 transmits an image transmission start command to the multi-sensor cameras 1-1 and 1-2 via the transmitter 71. When the event whose image data is being transmitted is over, the event notification controller 73 transmits an image transmission end command to the multi-sensor cameras 1-1 and 1-2 via the transmitter 71.

When an event is being presented, if an input indicating that a notification of the event is unnecessary is given by a user via the user input unit 77, the event notification controller 73 transmits an image transmission end command to the multi-sensor cameras 1-1 and 1-2 via the transmitter 71 regardless of the operation mode.

The event notification controller 73 sets the notification-necessary event occurrence flag and stores it, as will be described in detail later.

The event presentation controller 74 receives image data transmitted from the multi-sensor cameras 1-1 and 1-2 via the receiver 72. The event presentation controller 74 produces presentation data on the basis of the acquired image data and outputs the produced presentation data to the presentation unit 32.

In the controlled-by-server combined mode, when an event is over, the event information recording unit 75 generates event information on the basis of combined state history data associated with the event acquired from the event notification controller 73 and on the basis of the evaluation input via the user input unit 77 indicating whether notification is necessary, and the event information recording unit 75 stores the generated event information in the event information storage unit 79.

In the controlled-by-camera combined mode, on the other hand, when an event is over, the event information recording unit 75 generates event information on the basis of single state history data and combined state history data associated with the multi-sensor cameras 1-1 and 1-2, which are included in an end-of-event notification acquired via the receiver 72 from the multi-sensor cameras 1-1 and 1-2, and on the basis of the evaluation input via the user input unit 77 indicating whether notification is necessary, and the event information recording unit 75 stores the generated event information in the event information storage unit 79.

In the controlled-by-camera single mode, when an event is over, the event information recording unit 75 generates event information on the basis of single state history data associated with the multi-sensor camera 1-1 or 1-2, which is included in an end-of-event notification acquired via the receiver 72 from the multi-sensor camera 1-1 or 1-2, and on the basis of the evaluation input via the user input unit 77 indicating whether notification is necessary, and the event information recording unit 75 stores the generated event information in the event information storage unit 79.

In the controlled-by-server combined mode, when an event is over, the event classification information generator 76 generates a notification-unnecessary event table indicating events that do not need to be notified, on the basis of combined state history data associated with the event acquired from the event notification controller 73 and on the basis of the evaluation input via the user input unit 77 indicating whether notification is necessary, and the event classification information generator 76 stores the generated notification-unnecessary event table in the event classification information storage unit 80.

In the controlled-by-camera combined mode, when an event is over, the event classification information generator 76 generates a notification-unnecessary event table indicating events that do not need to be notified, on the basis of single state history data and combined state history data associated with the multi-sensor cameras 1-1 and 1-2, which are included in an end-of-event notification acquired via the receiver 72 from the multi-sensor cameras 1-1 and 1-2 and on the basis of the evaluation input via the user input unit 77 indicating whether notification is necessary, and the event classification information generator 76 stores the generated notification-unnecessary event table in the event classification information storage unit 80.

In the controlled-by-camera single mode, when an event is over, the event classification information generator 76 generates a notification-unnecessary event table indicating events that do not need to be notified, on the basis of single state history data associated with the multi-sensor camera 1-1 or 1-2, which is included in an end-of-event notification acquired via the receiver 72 from the multi-sensor camera 1-1 or 1-2, and on the basis of the evaluation input via the user input unit 77 indicating whether notification is necessary, and the event classification information generator 76 stores the generated notification-unnecessary event table in the event classification information storage unit 80.

The user input unit 77 receives an input given by a user to indicate an evaluation of whether or not a further notification of a presented event is necessary, and the user input unit 77 transfers the given input to the event information recording unit 75 and the classification information generator 76. In the operation mode selection process, the user input unit 77 may receive an input given by a user to specify whether to select a low-power mode and may transfer the given input to the operation mode selector 78.

The operation mode selector 78 selects an operation mode on the basis of the event information stored in the event information storage unit 79, the notification-unnecessary table stored in the event classification information storage unit 80, and information input by the user via the user input unit 77 to specify whether to select the low-power mode. The operation mode selector 78 sends a notification indicating the operation mode selected in the operation mode selection process to the multi-sensor cameras 1-1 and 1-2 via the event notification controller 73, the event information recording unit 75, the classification information generator 76, and the transmitter 71.

The notification-unnecessary event table is a table in which a pattern of an event that does not need to be notified is described. One pattern of event that does not need to be notified is described in one notification-unnecessary event table. Each time a new pattern of event that does not need to be notified appears, one new notification-unnecessary event table is created. There are three types of notification-unnecessary event tables. They are a notification-unnecessary event table used by the server 31 in the controlled-by-server combined mode, a notification-unnecessary event table used by the multi-sensor cameras 1-1 and 1-2 in the controlled-by-camera combined mode, and a notification-unnecessary event table used by the multi-sensor cameras 1-1 and 1-2 in the controlled-by-camera single mode. FIG. 13 shows an example of a notification-unnecessary event table used in the controlled-by-camera combined mode.

In each notification-unnecessary event table, a state transition pattern of an event that does not need to be notified is described together with minimum and maximum durations of each state. In the example of the notification-unnecessary event table shown in FIG. 13, the state transition pattern consists of "combined state 0x01" and "combined state 0x11", the minimum and maximum durations of "combined state 0x01" are respectively specified as 0.5 sec and 3.0 sec, and the minimum and maximum durations of "combined state 0x11" are respectively specified as 1.0 sec and 2.5 sec. Note that any type of notification-unnecessary event table is described in the same form. In the case of notification-unnecessary event tables used by the multi-sensor cameras 1-1 and 1-2 in the controlled-by-camera combined mode, a combined-state transition pattern associated with the multi-sensor camera 1-1 and 1-2 is described. On the other hand, in notification-unnecessary event tables used by the multi-sensor cameras 1-1 and 1-2 in the controlled-by-camera single mode, a single-state transition pattern associated with the multi-sensor camera 1-1 or 1-2 is described.

When an event is detected, a determination of whether the detected event satisfies the condition specified by a notification-unnecessary event table is made by checking whether the state transition pattern of the detected event is completely identical to the state transition pattern described in a notification-unnecessary event table (that is, whether the state transition pattern of the detected event includes all transitions described in the notification-unnecessary event table and includes no additional transitions) and the duration of each state of the detected event falls within the range from the minimum value to the maximum value described in the notification-unnecessary event table. For example, when combined state history data of an event consists of combined state 0x01 (1 sec) and combined state 0x11 (2 sec), this event satisfies the condition described in the notification-unnecessary event table shown in FIG. 13. An event having only a combined state 0x01 or an event having a sequence of state transitions of combined state 0x01, combined state 0x11, and combined state 0x10 does not satisfy the condition described in the notification-unnecessary event table shown in FIG. 13. In a case in which combined state history data of an event consists of a sequence of combined state 0x01 (5 sec) and combined state 0x11 (2 sec), the duration of combined state 0x01 is not within the range of the duration of the combined state 0x01 specified in the notification-unnecessary event table shown in FIG. 13, and thus this event does not satisfy the condition specified in the notification-unnecessary event table shown in FIG. 13.

When a determination of whether or not a notification of an event is necessary is made at a time at which the event is still in progress, even if the event does not satisfy any notification-unnecessary event table at that time, the event is not necessarily regarded as an event that needs to be notified, as long as there is a possibility that the event may satisfy some notification-unnecessary event table. At the point of time at which it is determined that there is no longer possibility that the event will satisfy any notification-unnecessary event table, the event is determined to be an event that needs to be notified.

For example, when the server 31 has only the notification-unnecessary event table shown in FIG. 13, if an event occurs and is detected as being in a combined state 0x01, this event is not determined to be an event that needs to be informed at the point of time at which the event is detected, because there is a possibility that the event will satisfy the condition specified by the notification-unnecessary event table shown in FIG. 13. However, if the duration of the combined state 0x01 of the event becomes longer than 3 sec or if the state changes into a combined state 0x11, the above possibility disappears, that is, there is no longer possibility that the event will satisfy the condition specified in the notification-unnecessary event table shown in FIG. 13. Thus, the event is determined to be an event that needs to be notified.

In the controlled-by-server combined mode, when an event occurs, the event notification controller 73 of the server 31 determines whether the event is an event that needs to be notified by examining notification-unnecessary event tables for use in the controlled-by-server combined mode to check whether or not combined state history data, updated by the event notification controller 73, of the current event satisfies some notification-unnecessary event table.

In the controlled-by-camera combined mode, when an event occurs, the event notification controller 53 of each of the multi-sensor cameras 1-1 and 1-2 determines whether the event is an event that needs to be notified by examining notification-unnecessary event tables for use in the controlled-by-camera combined mode to check whether or not combined state history data, updated by the event notification controller 53, of the current event satisfies some notification-unnecessary event table.

In the controlled-by-camera single mode, when an event occurs, the event notification controller 53 of each of the multi-sensor cameras 1-1 and 1-2 determines whether the event is an event that needs to be notified by examining notification-unnecessary event tables for use in the controlled-by-camera single mode to check whether or not single state history data, updated by the state detector 52, of the current event satisfies some notification-unnecessary event table.

When an event is being presented to a user, if the user inputs an evaluation indicating that notification of the event is not necessary, a notification-unnecessary event table is created or updated after the event is over. When an event is evaluated by the user as not needing to be notified, if there is no notification-unnecessary event table having a state transition pattern identical to the state transition pattern of the event evaluated as not needing to be notified, a new notification-unnecessary event table is created on the basis of the state history data of the event. In a case in which there is a notification-unnecessary event table having a state transition pattern identical to the state transition pattern of the event evaluated as not needing to be notified, the duration of each state described in the state history data of the event is compared with the duration of the corresponding state of the state transition pattern described in the notification-unnecessary event table. If the duration of some state of the state history data of the event is greater than the duration of the corresponding state in the state transition pattern described in the notification-unnecessary event table, the duration of that state of the transition pattern of the notification-unnecessary event table is updated.

In the controlled-by-server combined mode, when an event is being presented to a user, if the user inputs an evaluation indicating that notification of the event is not necessary, a notification-unnecessary event table is created or updated on the basis of a state transition pattern of combined states of the event detected by the multi-sensor cameras 1-1 and 1-2. Similarly, in the controlled-by-camera combined mode, when an event is being presented to a user, if the user inputs an evaluation indicating that notification of the event is not necessary, a notification-unnecessary event table is created or updated on the basis of a single-state transition pattern of the event detected by the multi-sensor camera 1-1 or 1-2. In the controlled-by-camera single mode, when an event is being presented to a user, if the user inputs an evaluation indicating that notification of the event is not necessary, a notification-unnecessary event table is created or updated on the basis of a single-state transition pattern of the event detected by the multi-sensor camera 1-1 or 1-2.

The notification-necessary event occurrence flag is a flag indicating whether or not an event needing to be notified to a user is occurring in the region monitored by the monitoring system 21. The multi-sensor cameras 1-1 and 1-2 and the server 31 have their own notification-necessary event occurrence flag and manage their own notification-necessary event occurrence flag. When an event occurs, if the event is determined as an event needing to be notified to a user, the notification-necessary event occurrence flag is turned on and maintained in the on-state until the event is over.

The image transmission enable flag is a flag indicating whether or not the multi-sensor camera 1-1 or 1-2 is allowed to transmit image data to the server. When an event needing to be notified to a user occurs in a region monitored by the multi-sensor camera 1-1 or 1-2, the multi-sensor camera 1-1 or 1-2 determines whether to transmit image data depending on the value of the image transmission enable flag. In the controlled-by-server combined mode, the notification-necessary event occurrence flag is turned on when an image transmission start command is received from the server 31 and is maintained in the on-state until an image transmission end command is received. In the controlled-by-camera combined mode and also in the controlled-by-camera single mode, the notification-necessary event occurrence flag is turned on when an event needing to be notified to a user is detected and is maintained in the on-state until the event is over or until an image transmission end command is received from the server 31. In the controlled-by-camera combined mode and also in the controlled-by-camera single mode, when an event is being presented to a user, if the user inputs an evaluation indicating that notification of the event is not necessary, an image transmission end command is transmitted from the server 31, and the notification-necessary event occurrence flag is turned off even if the event is not yet over, and transmission of image data to the server 31 is stopped.

Now, various processes performed by the monitoring system 21 shown in FIG. 3A are described below with reference to FIGS. 14 to 59. The processes described below include a monitoring process after the process is started and before an operation mode selection process is performed, the operation mode selection process, and a monitoring process performed in a selected operation mode after the completion of the operation mode selection process, which will be described below in this order.

First, the monitoring operation performed by the multi-sensor cameras 1-1 and 1-2 at the beginning of the monitoring operation is described below with reference to FIG. 14. This process is started when the user issues a command to start the operation of monitoring the region to be monitored.

In step S1, the event notification controller 53 performs initialization. In this initialization process, the operation mode of each of the multi-sensor cameras 1-1 and 1-2 is set to the controlled-by-server combined mode as an initial operation mode, and the notification-necessary event occurrence flag and the image transmission enable flag are both initialized into the off-state.

In step S2, the receiver 56 determines whether a notification indicating the operation mode has been received from the server 31. Note that the operation mode notification is transmitted from the server 31 when the operation mode selection process is performed in step S210 in FIG. 33 as will be described later. In this specific case, the monitoring operation is just started and the operation mode selection process has not yet been executed. Thus, the operation mode notification is not received, and the process proceeds to step S4 without performing step S3.

In step S4, the receiver 56 determines whether a notification-unnecessary event table has been received from the server 31. Note that the notification-unnecessary event table is transmitted from the server 31 in step S211 in FIG. 33 after the operation mode selection process, as will be described later. In this specific case, the monitoring operation is just started and the operation mode selection process has not yet been executed. Thus, the notification-unnecessary event table is not received, and the process proceeds to step S6 without performing step S5.

In step S6, the event notification controller 53 determines which operation mode is specified. In this specific case, it is determined that the operation mode is set in the controlled-by-server combined mode, and thus the process proceeds to step S7. In step S7, the monitoring operation is performed in the controlled-by-server combined mode, as will be described later in further detail with reference to FIGS. 16 and 17.

In step S7, the monitoring operation is performed in the controlled-by-server combined mode. Thereafter, the process proceeds to step S10. In step S10, the event notification controller 53 determines whether a command to end the monitoring operation has been issued by the user. If it is determined that the end command has not been issued, the operation flow returns to step S2, and the process is repeated from step S2. If it is determined that the command to end the monitoring operation has been issued by the user, the monitoring operation is ended.

As described above, after the monitoring operation by the multi-sensor cameras 1-1 and 1-2 is started, the monitoring operation is performed repeatedly in the controlled-by-server combined mode until the operation mode selection process is executed.

Now, the operation performed by the server 31 at the beginning of the monitoring operation is described below with reference to FIG. 15. This process is started when the user issues a command to start the operation of monitoring particular regions.

In step S21, initialization of the server 31 is performed. More specifically, the operation mode selector 78 sets the operation mode of the server 31 to controlled-by-server combined mode as an initial operation mode, and the operation mode selector 78 sends a notification indicating the operation mode to the event notification controller 73, the event information recording unit 75, and the classification information generator 76. The event notification controller 73 initializes the notification-necessary event occurrence flag into the off-state.

In step S22, the operation mode selector 78 determines which operation mode is currently specified. In this specific case, it is determined that the operation mode is set in the controlled-by-server combined mode, and thus the process proceeds to step S23. In step S23, the monitoring operation is performed in the controlled-by-server combined mode, as will be described later in further detail with reference to FIGS. 20 and 22.

In step S23, the monitoring operation is performed in the controlled-by-server combined mode. Thereafter, the process proceeds to step S26. In step S26, the event notification controller 73 determines whether a command to end the monitoring operation has been issued by the user. If it is determined that the end command has not been issued, the operation flow returns to step S22, and the process is repeated from step S22. If it is determined that the command to end the monitoring operation has been issued by the user, the monitoring operation is ended.

As described above, after the monitoring operation by the server 31 is started, the monitoring operation is performed repeatedly in the controlled-by-server combined mode until the operation mode selection process is executed.

In the controlled-by-server combined mode which is set when the monitoring operation is started by the monitoring system 21, the monitoring operation (the monitoring operation by the multi-sensor cameras in step S7 of FIG. 14 and the monitoring operation by the server in step S23 of FIG. 15) is performed by the monitoring system 21 as is described below with reference to FIGS. 16 to 32. In the following description, it is assumed that an event occurs in a similar manner as described earlier with reference to FIGS. 4 to 7. It is also assumed that the event in the state shown in FIG. 4 is evaluated such that it is not necessary to notify the user of the occurrence of the event, but it is determined that it is necessary to notify the user of the occurrence of the event in the state shown in FIG. 5.

Steps S2 to S6 and step S10 (shown in FIG. 14) performed by the multi-sensor cameras 1-1 and 1-2 and steps S22 and S26 (shown in FIG. 15) performed by the server 31 are performed in a similar manner to the manner in which the operation is performed at the beginning of the monitoring operation as described earlier until the operation mode selection process is executed, and thus those steps are not described further herein.

In the controlled-by-server combined mode, if an event occurs as shown in FIG. 4, the monitoring operation is performed by the monitoring system 21 as described below. In FIG. 4, as described earlier, the person 41 enters the monitored region 11-1 at time T=t, and thus an event occurs in the region monitored by the monitoring system 21.

The monitoring operation performed in this situation by the multi-sensor camera 1-1 in the controlled-by-camera combined mode (monitoring operation by multi-sensor camera in step S7 in FIG. 14) is described below with reference to FIGS. 16 and 17. In this situation, at the beginning of the process, the notification-necessary event occurrence flag and the image transmission enable flag are both in the off-state.

In step S101, the state detector 52 acquires sensor data from the photosensor 51.

In step S102, the state detector 52 updates the single state history data associated with the present camera (multi-sensor camera 1-1) on the basis of the sensor data acquired in step S101. FIG. 18 shows the resultant updated single state history data associated with the multi-sensor camera 1-1. In the state shown in FIG. 4, the person 41 enters the region 11-1 monitored by the multi-sensor camera 1-1, and 0x01 is assigned as the single state number of the multi-sensor camera 1-1. Thus, in the single state history data associated with the multi-sensor camera 1-1, "single state 0x01" is recorded as the state transition pattern and "0 sec" is recorded as the duration.

In step S103, the state detector 52 determines whether a change has occurred in the state (single state number) of the region 11-1 monitored by the present multi-sensor camera (multi-sensor camera 1-1) after the last updating of the state history data in step S102. In this specific case, it is determined that a change is detected in the state of the region 11-1 monitored by the present camera, and thus the process proceeds to step S104.

In step S104, the state detector 52 transmits a state change notification to the server 31 via the transmitter 55. The state change notification includes data indicating the single state number of the present camera (multi-sensor camera 1-1) as of this time. Thus, a notification indicating that the single state number of the multi-sensor camera 1-1 is 0x01 as of this time is sent to the server 31.

In step S105, the receiver 56 determines whether an image transmission start command has been received from the server 31. Note that the image transmission start command is transmitted in step S160 from the server 31 to the multi-sensor cameras 1-1 and 1-2 when the server 31 determines in step S159 in FIG. 20 (described later) that an event is occurring that should be notified to the user. In this specific case, it is determined that there is no event which should be notified to the user, and thus the image transmission start command is not transmitted from the server 31. Thus, it is determined that the image transmission start command has not been received, and the process proceeds to step S106.

In step S106, the receiver 56 determines whether an image transmission end command has been received from the server 31. Note that the image transmission end command is transmitted in step S172 (FIG. 21) or step S157 (FIG. 20) when the server 31 determines in step S153 in FIG. 20 (described later) that the event whose image data is being presented to the user is over or when it is determined in step S156 in FIG. 20 (described later) that the user's evaluation indicates that notification of the event is not necessary. In this specific case, there is no event that should be notified to the user, and thus the image transmission end command is not transmitted from the server 31. Thus, it is determined that the image transmission end command has not been received, and the process proceeds to step S109 without performing step S107.

In step S109, the event notification controller 53 determines whether image data is being transmitted to the server 31. In this specific case, it is determined that transmission of image data to the server 31 has not been started and thus no image data is being transmitted to the server 31. Thus, the process proceeds to step S110.

In step S110, the event notification controller 53 determines whether (i) an event is occurring in the region 11-1 monitored by the present camera (multi-sensor camera 1-1) and (ii) the image transmission enable flag is in the on-state. In this specific case, although an event is occurring in the region 11-1 monitored by the present camera, the image transmission enable flag is in the off-state, and thus the process proceeds to step S10 in FIG. 14 without performing step S111.

Thus, as described above, the multi-sensor camera 1-1 detects an event, updates the single state history data, and transmits the state change notification to the server 31. Thereafter, if the server 31 determines that there is no event that should be notified to the user, no particular processing is performed.

Now, the monitoring operation performed by the multi-sensor camera 1-2 in the controlled-by-server combined mode (monitoring operation by multi-sensor camera in step S7 in FIG. 14) is described. At the beginning of the process, the notification-necessary event occurrence flag and the image transmission enable flag are both in the off-state.

As in the case of the multi-sensor camera 1-1, in step S101, the state detector 52 acquires sensor data from the photosensor 51. In step S102, the state detector 52 updates the single state history data of the present camera (multi-sensor camera 1-2). FIG. 19 shows the resultant updated single state history data associated with the multi-sensor camera 1-2. In the state shown in FIG. 4, the person 41 is not in the region 11-2 monitored by the multi-sensor camera 1-2, and thus no event occurs yet at this stage in the monitored region 11-2. Thus, in the single state history data associated with the multi-sensor camera 1-2, "single state 0x00" indicating that no event is detected in the region 11-2 monitored by the multi-sensor camera 1-2 is recorded in the state transition pattern.

In step S103, as in the case of the multi-sensor camera 1-1, it is determined whether a change has occurred in the state (single state number) of the region 11-2 monitored by the present camera (multi-sensor camera 1-2). In this specific case, it is determined that no change occurs in the state of the region 11-2 monitored by the present camera, and thus step S104 is skipped and the process proceeds to step S105 without transmitting a state change notification.

Steps S105 to S109 are performed in a similar manner as in the case of the multi-sensor camera 1-1. That is, neither the image transmission start command nor the image transmission end command has been received from the server 31, and thus no image data is transmitted to the server 31 from the multi-sensor camera 1-2. Thus, the process directly proceeds to step S110.

In step S110, as in the case of the multi-sensor camera 1-1, the event notification controller 53 determines whether (i) an event is occurring in the region 11-2 monitored by the present camera (multi-sensor camera 1-2) and (ii) the image transmission enable flag is in the on-state. In this specific case, no event is occurring in the region 11-2 monitored by the present camera, and the image transmission enable flag is in the off-state, and thus the process proceeds to step S10 in FIG. 14 without performing step S111.

Thus, as in the case of the multi-sensor camera 1-1, the single state history data is updated, and no further process is performed thereafter.

In the controlled-by-server combined mode, corresponding to the operation performed by the multi-sensor cameras 1-1 and 1-2 according to the flow chart shown in FIGS. 16 and 17, the monitoring operation (monitoring operation by server in step S23 in FIG. 15) is performed by the server 31 as described below with reference to FIGS. 20 and 22. At the beginning of the process, the notification-necessary event occurrence flag is in the off-state.

In step S151, the receiver 72 receives the state change notification from the multi-sensor camera 1-1 or 1-2. In this specific case, the state change notification has been transmitted from the multi-sensor camera 1-1 in step S104 in FIG. 16, and the receiver 72 receives this state change notification. Thus, the process proceeds to step S152. In the case in which no state change notification is received in step S151, the process proceeds to step S152 without performing anything.

In step S152, the event notification controller 73 acquires the state change notification received, in step S151, by the receiver 72. The event notification controller 73 updates the combined state history data associated with the multi-sensor cameras 1-1 and 1-2 on the basis of the acquired state change notification. FIG. 23 shows the resultant updated combined state history data stored in the server 31. The event notification controller 73 recognizes, from the state change notification received from the multi-sensor camera 1-1, that the multi-sensor camera 1-1 is in single state 0x01. Because no state change notification is received from the multi-sensor camera 1-2, the event notification controller 73 determines that the multi-sensor camera 1-2 remains in single state 0x00. Furthermore, the event notification controller 73 determines that the combined state of the multi-sensor cameras 1-1 and 1-2 is combined state 0x01. Thus, in the combined state history data, "combined state 0x01" is recorded as the state transition pattern, and "0 sec" is recorded as the duration because the event has just started.

In step S153, the event notification controller 73 determines whether the event is over. In this specific case, the event is occurring in the monitored region 11-1, and thus the process proceeds to step S154.

In step S154, the event notification controller 73 determines whether the notification-necessary event occurrence flag is in the on-state. In this specific case, it is determined that the notification-necessary event occurrence flag is in the on-state, and thus the process proceeds to step S159.

In step S159, the event notification controller 73 determines whether an event is occurring which should be notified to the user. The event notification controller 73 acquires a notification-unnecessary event table from the event classification information storage unit 80 and makes the event notification decision described earlier with reference to FIG. 13 to determine whether the event currently occurring is an event that should be notified to the user, on the basis of the combined state history data (FIG. 23) updated in step S152 and the acquired notification-unnecessary event table. In this specific case, it is determined that there is no event which should be notified to the user. Thus, steps S160 to S162 are skipped and the process proceeds to step S26 in FIG. 15 without starting event presentation.

Thus, as described above, the server 31 receives the state change notification from the multi-sensor cameras 1-1 and 1-2 and determines the combined state history data associated with the multi-sensor cameras 1-1 and 1-2. In the case in which it is determined that no event is occurring which should be notified to the user, event presentation is not started.

In the controlled-by-server combined mode, if the state of the event changes into the state shown in FIG. 5, the monitoring operation is performed by the monitoring system 21 as described below. In the state shown in FIG. 5, as described earlier, the person 41 enters the monitored region 11-3 m sec after the state shown in FIG. 4, that is, at a time T=t+m.

The monitoring operation performed by the multi-sensor camera 1-1 (monitoring operation by multi-sensor camera in step S7 in FIG. 14) is described.

In step S101, sensor data is acquired from the photosensor 51. In step S102, the single state history data associated with the present camera (multi-sensor camera 1-1) is updated. FIG. 24 shows the resultant updated single state history data associated with the multi-sensor camera 1-1. In this specific state, no change occurs in state (single state number) of the region 11-1 monitored by the multi-sensor camera 1-1 from the state shown in FIG. 4, and thus the duration of "single state 0x01" in the single state history data associated with the multi-sensor camera 1-1 is updated to m sec.

In this specific case, it is determined in step S103 that no change occurs in state (single state number) of the region 11-1 monitored by the present camera (multi-sensor camera 1-1). Thus, step S104 is skipped and the process proceeds to step S105 without transmitting a state change notification.

In step S105, it is determined whether an image transmission start command has been received via the receiver 56. In this specific case, because the image transmission start command was transmitted, in step S160 in FIG. 20, from the server 31 to the multi-sensor camera 1-1 and 1-2, and the receiver 56 has received this image transmission start command. Thus, it is determined in step S105 that the image transmission start command has been received, and the process proceeds to step S108.

In step S108, the event notification controller 53 turn on the image transmission enable flag.

In step S109, in this specific case, it is determined that no image data is being transmitted, and thus the process proceeds to step S110.

In step S110, it is determined whether (i) an event is occurring in the region 11-1 monitored by the present camera (multi-sensor camera 1-1) and (ii) the image transmission enable flag is in the on-state. In this specific case, an event is occurring in the region 11-1 monitored by the present camera and the image transmission enable flag is in the on-state, and thus the process proceeds to step S111.

In step S111, the event notification controller 53 turns on the power of the camera 54. In response, transmission of image data taken by the camera 54 to the server 31 via the transmitter 55 is started. Thereafter, the process proceeds to step S10 in FIG. 14.

As described above, if the server 31 determines that an event is occurring which should be notified to the user, the server 31 transmits the image transmission start command. In response, the transmission of image data to the server 31 is started.

Now, the monitoring operation performed by the multi-sensor camera 1-2 (monitoring operation by multi-sensor camera in step S7 in FIG. 14) is described.

In step S101, sensor data is acquired from the photosensor 51. In step S102, the single state history data associated with the present camera (multi-sensor camera 1-2) is updated. FIG. 25 shows the resultant updated single state history data associated with the multi-sensor camera 1-2. That is, in the single state history data associated with the multi-sensor camera 1-2, "single state 0x01" is recorded as the state transition pattern, and the duration of "single state 0x01" is described as 0 sec.

In this specific case, it is determined in step S103 that a change has occurred in state (single state number) of the region 11-2 monitored by the present camera (multi-sensor camera 1-2), and thus the process proceeds to step S104.

In step S104, a state change notification is transmitted to the server 31. The state change notification includes data indicating the single state number of the present camera (multi-sensor camera 1-2) as of this time. Thus, the server 31 is notified that the single state number of the multi-sensor camera 1-2 is 0x01 as of this time.

Steps S105 to S111 are performed in a similar manner as in the case of the multi-sensor camera 1-1. That is, in step S105, an image transmission start command is received. In step S108, the image transmission enable flag is turned on. In step S111, transmission of image data to the server 31 is started. Thereafter, the process proceeds to step S10 in FIG. 14.

As described above, also in the multi-sensor camera 1-2 as with the multi-sensor camera 1-1, transmission of image data to the server 31 is started in response to the image transmission start command transmitted from the server 31.

Now, the operation performed by the server 31 (monitoring operation by server in step S23 in FIG. 15) is described.

In step S151, in this specific case, a state change notification is received from the multi-sensor camera 1-2. In step S152, the combined state history data is updated. FIG. 26 shows the resultant updated combined state history data stored in the server 31. That is, the duration of the combined state 0x01 is updated to m sec, the current combined state 0x11 is added to the state transition pattern, and the duration of the combined state 0x11 is described as 0 sec.

In step S153, in this specific case, it is determined that the event is not over, and thus the process proceeds to step S154. In step S154, in this specific case, it is determined that the notification-necessary event occurrence flag is in the off-state, and thus the process proceeds to step S159.

In step S159, the event notification decision described earlier with reference to FIG. 13 is made on the basis of the combined state history data (FIG. 26) and the notification-unnecessary event table. In this specific case, it is determined that an event is occurring which should be notified to the user, and thus the process proceeds to step S160.

In step S160, the event notification controller 73 transmits an image transmission start command to the multi-sensor cameras 1-1 and 1-2 via the transmitter 71. As described earlier, this image transmission start command is received by the multi-sensor cameras 1-1 and 1-2 in step S105 in FIG. 16, and in step S111 in FIG. 17 the multi-sensor cameras 1-1 and 1-2 start transmission of image data. This image data transmitted from the multi-sensor cameras 1-1 and 1-2 are received by the receiver 72.

In step S161, the receiver 72 starts transferring of the image data, whose transmission from the multi-sensor cameras 1-1 and 1-2 was started in step S160, to the event presentation controller 74. The event presentation controller 74 produces data to be presented to the user on the basis of the acquired image data and outputs the produced data to the presentation unit 32 shown in FIG. 3A. In response, the presentation unit 32 presents the event.

In step S162, the event notification controller 73 turns on the notification-necessary event occurrence flag. Thereafter, the process proceeds to step S26 in FIG. 15.

As described above, if the server 31 determines that an event is occurring which should be notified to the user, the server 31 transmits the image transmission start command to the multi-sensor cameras 1-1 and 1-2. In response, the multi-sensor cameras 1-1 and 1-2 start transmission of image data, and presentation of the event is started.

In the controlled-by-server combined mode, if the state of the current event changes into the state shown in FIG. 6, the monitoring operation is performed by the monitoring system 21 as described below. In the state shown in FIG. 6, as described earlier, the person 41 goes out of the monitored regions 11-1 and enters the monitored region 11-2 at T=t+m+n, that is, n sec after the state shown in FIG. 5.

First, the monitoring operation performed by the multi-sensor camera 1-1 (monitoring operation by multi-sensor camera in step S7 in FIG. 14) is described.

In step S101, sensor data is acquired from the photosensor 51. In step S102, the single state history data associated with the present camera (multi-sensor camera 1-1) is updated. FIG. 27 shows the resultant updated single state history data associated with the multi-sensor camera 1-1. In this specific case, the event is over in the region 11-1 monitored by the multi-sensor camera 1-1, and the state number of the event has changed from "single state 0x01" into "single state 0x00". Thus, the duration of "single state 0x01" in the single state history data associated with the multi-sensor camera 1-1 is updated to m+n sec.

In this specific case, it is determined in step S103 that a change has occurred in state (single state number) of the region 11-1 monitored by the present camera (multi-sensor camera 1-1), and thus the process proceeds to step S104. In step S104, a state change notification is transmitted to the server 31.

In this specific case, the image transmission start command associated with the event currently occurring has been already received from the server 31, and no further image transmission command is transmitted. Thus, it is determined in step S105 that the image transmission start command is not been received, and the process proceeds to step S106.

In step S106, the receiver 56 determines whether an image transmission end command has been received from the server 31. If it is determined that the image transmission end command has been received, the process proceeds to step S107. In step S107, the event notification controller 54 turns off the image transmission enable flag. On the other hand, if it is determined that the image transmission end command is not received, the process proceeds to step S109 without performing step S106. In the following description, it is assumed that it is determined in step S106 that the image transmission end command is not received.

In step S109, in this specific case, it is determined that image data is being transmitted, and thus the process proceeds to step S112.

In step S112, the event notification controller 73 determines whether (i) no event is occurring in the region 11-1 monitored by the present camera (multi-sensor camera 1-1) or (ii) the image transmission enable flag is in the off-state. In this specific case, no event is occurring in the monitored region 11-1, and thus the process proceeds to step S113.

In step S113, the event notification controller 53 turns off the power of the camera 54 thereby stopping transmission of image data to the server 31. Thereafter, the process proceeds to step S10 in FIG. 14.

Although the event is still occurring at some place of the total region monitored by the monitoring system 21, the event is over in the region 11-1 monitored by the multi-sensor camera 1-1, and thus transmission of image data from the multi-sensor camera 1-1 is ended.

Now, the monitoring operation performed by the multi-sensor camera 1-2 (monitoring operation by multi-sensor camera in step S7 in FIG. 14) is described.

In step S101, sensor data is acquired from the photosensor 51. In step S102, the single state history data associated with the present camera (multi-sensor camera 1-2) is updated. FIG. 28 shows the resultant updated single state history data associated with the multi-sensor camera 1-2. In this specific state, no change occurs in state (single state number) of the region 11-2 monitored by the multi-sensor camera 1-2 from the state shown in FIG. 5, and thus the duration of "single state 0x01" in the single state history data associated with the multi-sensor camera 1-2 is updated to n sec.

In this specific case, it is determined in step S103 that no change has occurred in state (single state number) of the region 11-2 monitored by the present camera (multi-sensor camera 1-2), and thus the process proceeds to step S105.

Steps S105 to S109 are performed in a similar manner as in the case of the multi-sensor camera 1-1 in the state shown in FIG. 6. That is, in step S109, in this specific case, it is determined that image data is being transmitted to the server 31, and thus the process proceeds to step S112.

In step S112, it is determined whether (i) no event is occurring in the region 11-2 monitored by the present camera (multi-sensor camera 1-2) or (ii) the image transmission enable flag is in the off-state. In this specific case, an event is occurring in the region 11-2 monitored by the present camera and the image transmission enable flag is in the on-state, and thus the process proceeds to step S10 in FIG. 14 without performing step S113.

Because the event is still occurring in the region 11-2 monitored by the multi-sensor camera 1-2, transmission of image data to the server 31 is continued without being stopped.

Now, the operation performed by the server 31 (monitoring operation by server in step S23 in FIG. 15) is described.

In step S151, in this specific case, a state change notification is received from the multi-sensor camera 1-1. In step S152, the combined state history data is updated. FIG. 29 shows the resultant updated combined state history data stored in the server 31. That is, the duration of the combined state 0x11 is updated to n sec, the current combined state 0x10 is added to the state transition pattern, and the duration of the combined state 0x10 is described as 0 sec.

In step S153, in this specific case, it is determined that the event is not yet over, and thus the process proceeds to step S155. In step S154, in this specific case, it is determined that the notification-necessary event occurrence flag is in the on-state, and thus the process proceeds to step S155.

In step S155, the user input unit 77 determines whether the user has input evaluation indicating whether a notification of the presented event is necessary. If it is determined that the user has input evaluation indicating whether a notification of the presented event is necessary, the process proceeds to step S156. Note that this can occur when an event is being presented, if the user inputs an evaluation indicating whether a notification is necessary.

In step S156, the user input unit 77 determines whether the user's evaluation acquired in step S155 indicates that notification is not necessary. If it is determined that the user's evaluation indicates that notification is not necessary, the process proceeds to step S157. Note that this can occur when an event is being presented, if the user inputs an evaluation indicating that a notification thereof is not necessary. If it is determined that the user's evaluation indicates that a notification is necessary, the process proceeds to step S26 in FIG. 15 without performing step S157 and S158.

In step S157, the event notification controller 73 transmits an image transmission end command to the multi-sensor cameras 1-1 and 1-2 via the transmitter 71. In step S158, the event presentation controller 74 stops outputting of presentation data to the presentation unit 32. Thus, the presentation of the event is ended. Note that steps S157 and S158 are performed to stop the presentation of the event if, when an event is being presented, the user inputs an evaluation indicating that a notification thereof is not necessary. Thereafter, the process proceeds to step S26 in FIG. 15.

Figure 15:
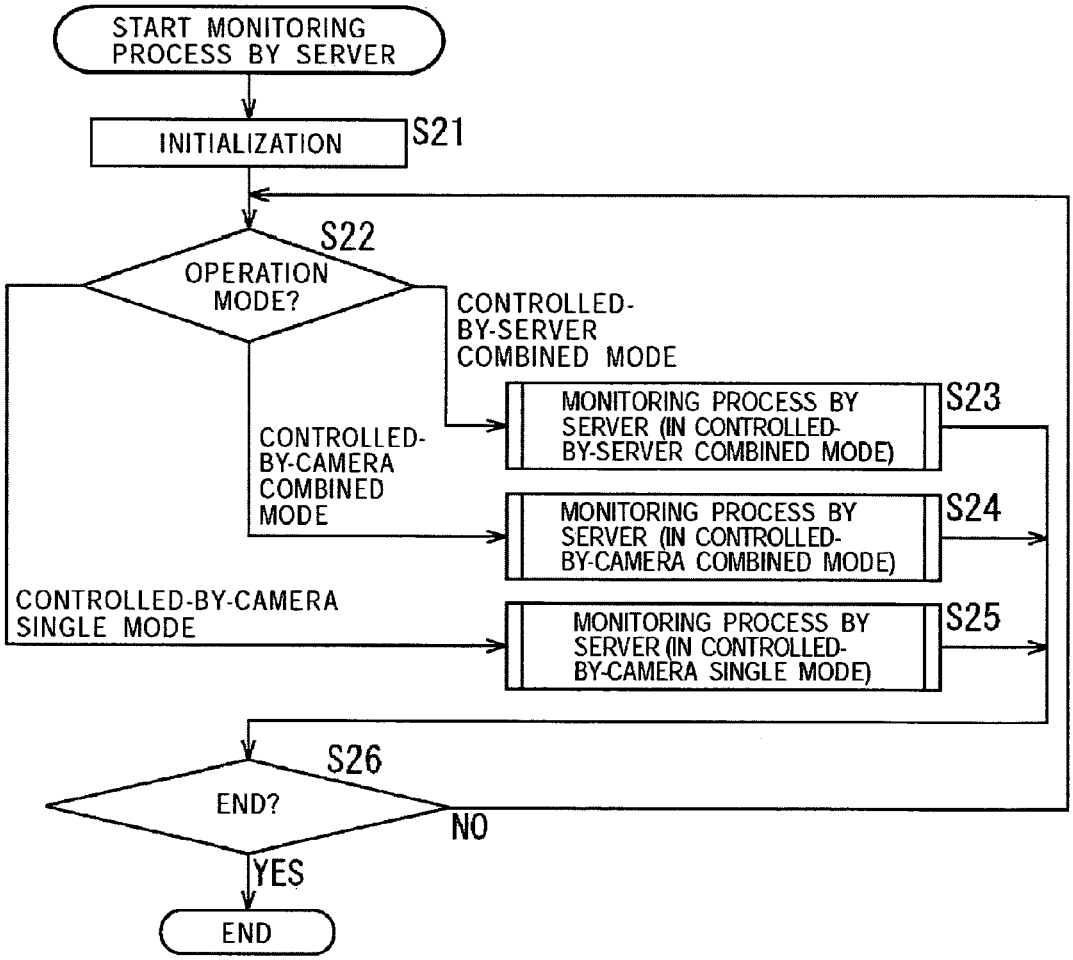
FIG. 15 is a flow chart showing a process performed by the server shown in FIG. 3A.

If it is determined in step S155 that an evaluation indicating whether or not a notification is necessary is not input by a user, the process proceeds to step S26 in FIG. 15 without performing steps S156 to S158.

As described above, when an event that should be notified to the user is still occurring and an evaluation indicating that a notification of the presented event is unnecessary is not input by the user, the presentation of the event is continued without being stopped.

In the controlled-by-server combined mode, if the state of the current event changes into the state shown in FIG. 7, the monitoring operation is performed by the monitoring system 21 as described below. In the state shown in FIG. 7, as described earlier, the person 41 goes out of the region covered by the monitoring system 21 and thus the event is over at T=t+m+n+p, that is, p sec after the state shown in FIG. 6.

First, the monitoring operation performed by the multi-sensor camera 1-1 (monitoring operation by multi-sensor camera in step S7 in FIG. 14) is described.

In step S101, sensor data is acquired from the photosensor 51. In step S102, the single state history data associated with the present camera (multi-sensor camera 1-1) is updated. FIG. 30 shows the resultant updated single state history data associated with the multi-sensor camera 1-1. In this specific example, in the single state history data associated with the multi-sensor camera 1-1, "single state 0x00" indicating that no event is occurring is recorded in the state transition pattern.

In step S103, in this specific case, it is determined that no change occurs in state (single state number) of the region 11-1 monitored by the present camera (multi-sensor camera 1-1), and thus the process proceeds to step S105 without transmitting a state change notification.

In step S105, it is determined whether an image transmission start command has been received. In this specific case, the event in the region monitored by the monitoring system 21 is over as shown in FIG. 7, and thus no image transmission start command is transmitted. Thus, it is determined in step S105 that the image transmission start command is not received, and the process proceeds to step S106.

In step S106, the receiver 56 determines whether an image transmission end command has been received from the server 31. When the presentation of an event being presented, if the event is over as is the present situation in which the event in the region monitored by the monitoring system 21 is over as shown in FIG. 7, an image transmission end command is transmitted, in step S172 in FIG. 21 (described later); from the server 31. In this case, it is determined in step S106 that the image transmission end command has been received, and thus the process proceeds to step S107.

In step S107, the event notification controller 53 turns off the image transmission enable flag.

In step S109, in this specific case, it is determined that no image data is being transmitted to the server 31, and thus the process proceeds to step S110.

In step S110, it is determined whether (i) an event is occurring in the region 11-1 monitored by the present camera (multi-sensor camera 1-1) and (ii) the image transmission enable flag is in the on-state. In this specific case, no event is occurring in the region 11-1 monitored by the present camera, and the image transmission enable flag is in the off-state, and thus the process proceeds to step S10 in FIG. 14 without performing step S111.

As described above, when the event whose image data is being transmitted is over, an image transmission end command transmitted from the server 31 is received, and the image transmission enable flag is turned off.

Now, the monitoring operation performed by the multi-sensor camera 1-2 (monitoring operation by multi-sensor camera in step S7 in FIG. 14) is described.

In step S101, sensor data is acquired from the photosensor 51. In step S102, the single state history data associated with the present camera (multi-sensor camera 1-2) is updated. FIG. 31 shows the resultant updated single state history data associated with the multi-sensor camera 1-2. In this specific case, the event in the region 11-2 monitored by the multi-sensor camera 1-2 is over, and the state number of the event has changed from "single state 0x01" into "single state 0x00". Thus, the duration of "single state 0x01" in the single state history data associated with the multi-sensor camera 1-2 is updated to n+p sec.

In this specific case, it is determined in step S103 that a change has occurred in state (single state number) of the region 11-2 monitored by the present camera (multi-sensor camera 1-2), and thus the process proceeds to step S104. In step S104, a state change notification is transmitted to the server 31.

Steps S105 to S108 are performed in a similar manner as in the case of the multi-sensor camera 1-1 in the state shown in FIG. 7. That is, in step S106, it is determined that the image transmission end command has been received, and in step S107 the image transmission enable flag is turned off.

In step S109, in this specific case, it is determined that image data is being transmitted to the server 31, and thus the process proceeds to step S112.

In step S112, it is determined whether (i) no event is occurring in the region 11-2 monitored by the present camera (multi-sensor camera 1-2) or (ii) the image transmission enable flag is in the off-state. In this specific case, no event is occurring in the region 11-2 monitored by the present camera and the image transmission enable flag is in the off-state, and thus the process proceeds to step S113.

In step S113, as in the case of the operation performed by the multi-sensor camera 1-1 in the situation shown in FIG. 6, transmission of image data to the server 31 from the multi-sensor camera 1-2 is stopped. Thereafter, the process proceeds to step S10 in FIG. 14.

As described above, when the event whose image data is being transmitted is over, an image transmission end command transmitted from the server 31 is received, and the image transmission enable flag is turned off. Herein, if image data is being transmitted, transmission of image data is stopped.

Now, the operation performed by the server 31 (monitoring operation by server in step S23 in FIG. 15) is described.

In step S151, in this specific case, a state change notification is received from the multi-sensor camera 1-2. In step S152, the combined state history data is updated. FIG. 32 shows the resultant updated combined state history data stored in the server 31. That is, the duration of the "combined state 0x10" is updated to p sec, and it is detected that the current combined state is "combined state 0x00" (that is, it is detected that the event is over).

In step S153, in this specific case, it is determined that the event is over, and thus the process proceeds to step S163.

In step S163, the event information recording unit 75 acquires, from the event notification controller 73, the combined state history data associated with the event that is over, and stores event information in the event information storage unit 79.

The event information includes an event number, state history data, an event occurrence time, and a user's evaluation. The event number is a serial number assigned to stored event information. In this specific case, the state history data is the combined state history data (shown in FIG. 32) acquired from the event notification controller 73. The event occurrence time indicates the time at which the event of interest was detected. The user's evaluation is input by the user to indicate whether the notification of the event is necessary or unnecessary, and the user's evaluation is acquired in step S155 or S166. In the controlled-by-server combined mode, event information of even an event that is not presented to the user is also stored for use in the determination of the operation mode, and thus the user's the evaluation of event information is treated in a similar manner to that of an event evaluated by the user as not needing to be notified.

In step S164, the event notification controller 73 determines whether the notification-necessary event occurrence flag is in the on-state. If it is determined that the notification-necessary event occurrence flag is in the on-state, the process proceeds to step S165. However, if it is determined that the notification-necessary event occurrence flag is in the off-state, the process proceeds to step S175.

In step S165, the user input unit 77 determines whether a user's evaluation of the presented event has been acquired. In this specific case, it is determined that a user's evaluation has not been acquired, and thus the process proceeds to step S166.

In step S166, as in step S155, the user input unit 77 determines whether the user has input evaluation indicating whether a notification of the presented event is necessary. If it is determined that the user has input evaluation indicating whether a notification of the presented event is necessary, the process proceeds to step S167. On the other hand, if it is determined that an evaluation indicating whether a notification of the presented event is necessary is not input by the user, the process proceeds to step S171 without performing steps S167 and 168.

In step S167, the classification information generator 76 acquires user's evaluation, input in step S166, on the presented event from the user input unit 77, and the classification information generator 76 updates the notification-unnecessary event table by performing the process described earlier with reference to FIG. 13.

In step S168, the event information recording unit 75 acquires user's evaluation, input in step S166, on the presented event from the user input unit 77 and stores the acquired user's evaluation in relationship to the event information stored in step S163.

If it is determined in step S165 that an evaluation by the user has been acquired, the process proceeds to step S169. In step S169, the classification information generator 76 updates the notification-unnecessary event table in a similar manner as in step S167. In step S170, the event information recording unit 75 stores the user's evaluation in relationship to the event information stored in step S163, in a similar manner as in step S168.

In step S171, the event notification controller 73 determines whether an event is being presented. If it is determined that an event is being presented, the process proceeds to step S172. However, if it is determined that no event is being presented, the process proceeds to step S174 without performing steps S172 and S173. In this specific case, it is determined that an event is being presented, and thus the process proceeds to step S172.

In step S172, the event notification controller 73 transmits an image transmission end command to the multi-sensor cameras 1-1 and 1-2, in a similar manner as in step S157.

In step S173, the event presentation controller 74 stops the operation of presenting the event in a similar manner as in step S158.

In step S174, the event notification controller 73 turns off the notification-necessary event occurrence flag.

In step S175, the operation mode selector 78 determines whether the operation mode selection process is not yet executed. If it is determined that the operation mode selection process is not yet executed, the process proceeds to step S175. On the other hand, if it is determined that the operation mode selection process has already been executed, the process proceeds to step S26 in FIG. 15 without performing step S175–S177.

In step S176, the operation mode selector 78 determines whether the amount of event information accumulated in the event information storage unit 79 is equal to or greater than a value (for example, a value corresponding to a particular number of occurrences of events) that is sufficient to perform the operation mode selection process. If the amount of event information is not sufficient, step S177 is skipped and the process proceeds to step S26 in FIG. 15.

As described above, when an event is over, event information is stored, and an image transmission end command is transmitted to the multi-sensor cameras 1-1 and 1-2. In response, the presentation of the event is ended.

After the event detection process has been performed repeatedly in the controlled-by-server combined mode, and it is determined in step S176 that the amount of accumulated event information has become greater than the predetermined value, the process proceeds to step S177. In step S177, the operation mode selection process is performed to select an operation mode that is most suitable for correct detection of events that should be notified to the user. The details of the operation mode selection process will be described later with reference to FIG. 33.

As described above, in the sequence of processing steps performed by the monitoring system 21 in the controlled-by-server combined mode, the server 31 combines states of an event detected by the multi-sensor cameras 1-1 and 1-2 and determines whether or not the detected event is an event that needs to be notified to a user on the basis of combined state history data of the event. If the event is determined as needing to be notified to the user, presentation of the event is performed.

Figure 22:
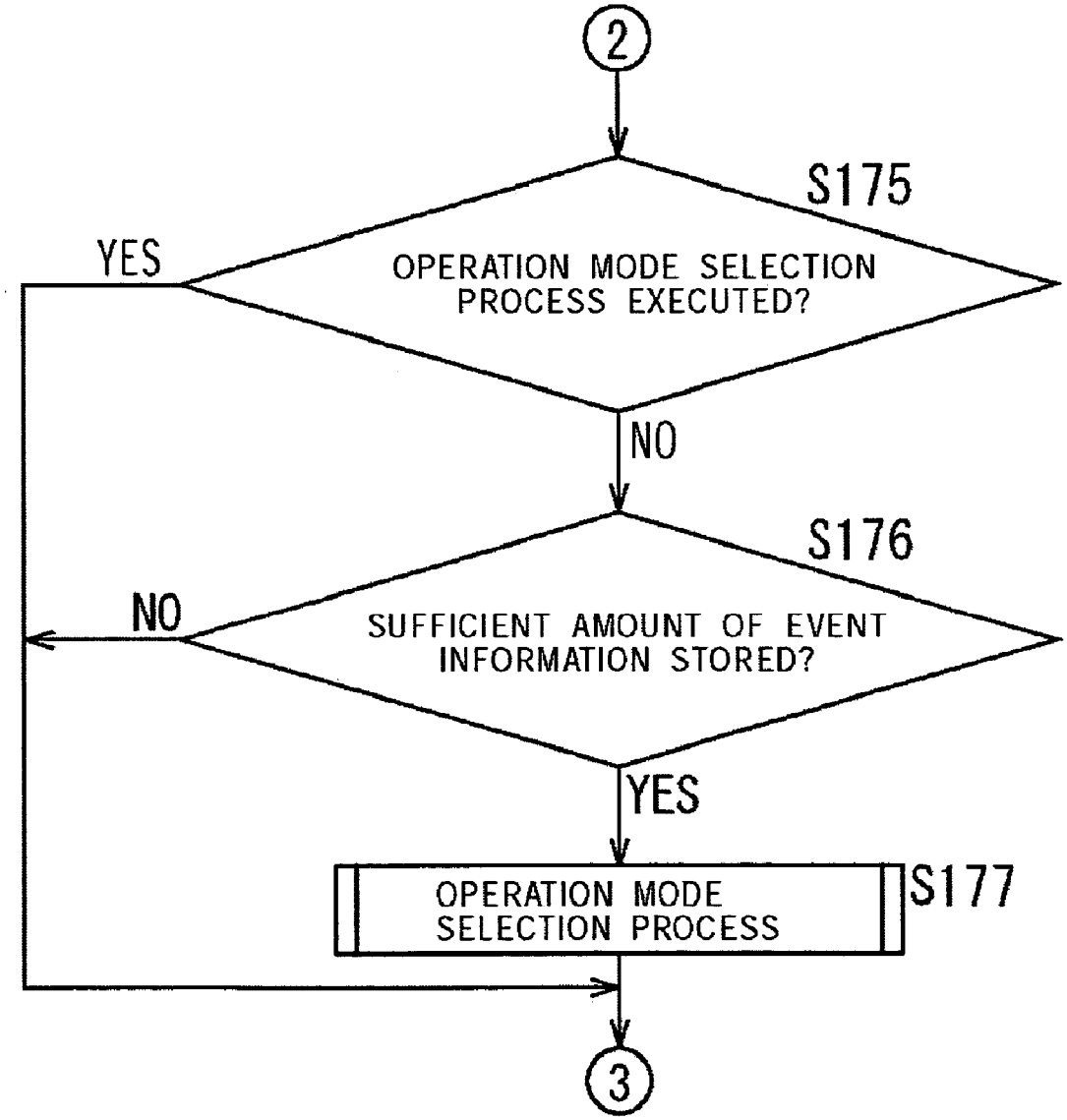
FIG. 22 is a flow chart showing a monitoring process performed by a server in step S23 in FIG. 15.

The operation mode selection process performed by the server 31 in step S177 of FIG. 22 is described in further detail below with reference to FIG. 33.

In step S201, the operation mode selector 78 loads event information from the event information storage unit 79.

In step S202, the operation mode selector 78 determines whether the ratio of the number of events simultaneously detected by a plurality of multi-sensor cameras to the total number of events is equal to or greater than a predetermined threshold value. More specifically, on the basis of the combined state history data of events loaded in step S201, the operation mode selector 78 determines the number of events detected simultaneously by a plurality of multi-sensor cameras and further determines the ratio of the determined number to the total number of events that occurred in the past. If it is determined that the ratio is equal to or greater than a predetermined threshold value, the process proceeds to step S203.

On the other hand, if it is determined in step S202 that the ratio of the number of events detected simultaneously by a plurality of multi-sensor cameras to the total number of events that occurred in the past is smaller than the predetermined threshold value, the process proceeds to step S209. In step S209, the controlled-by-camera single mode is selected as the operation mode. When most events are detected by only one multi-sensor camera 1-1 or 1-2 because there is no overlap between regions monitored by the multi-sensor cameras 1-1 and 1-2 or for some other reason, there is no merit in making the event notification decision on the basis of the combined state history data associated with the multi-sensor cameras 1-1 and 1-2, and thus, in such a situation, the controlled-by-camera single mode is selected as the operation mode as described above. Thereafter, the process proceeds to step S210.

In step S203, on the basis of the event information loaded in step S202, the operation mode selector 78 calculates the event detection accuracy that would be obtained if the past events were detected in the controlled-by-camera single mode. The event detection accuracy indicates what percentage of events actually determined by a user as needing to be notified to the user in the controlled-by-server combined mode will be correctly determined as needing to be notified if the operation is performed in the controlled-by-camera single mode, and what percentage of events actually determined by the user as not needing to be notified in the controlled-by-server combined mode will be correctly determined as not needing to be notified if the operation is performed in the controlled-by-camera single mode.

More specifically, first, the operation mode selector 78 loads the notification-unnecessary event table for use by the multi-sensor camera 1-1 in the controlled-by-camera single mode from the event classification information storage unit 80. The operation mode selector 78 then extracts event information detected by the multi-sensor camera 1-1 from the past event information. The operation mode selector 78 groups the extracted event information into a group of events that were evaluated by the user as being necessary to be notified and a group of events that were evaluated by the user as being unnecessary to be notified. Note that the group of events evaluated as unnecessary to be notified includes event information that was determined by the server 31 in the event notification decision as being unnecessary to be notified to the user and thus was not presented to the user.

The operation mode selector 78 determines whether each event actually evaluated by the user as needing to be notified will be correctly determined by the multi-sensor camera 1-1 as needing to be notified to the user if the operation is performed in the controlled-by-camera single mode. More specifically, the determination is made as follows. The single state history data associated with the multi-sensor camera 1-1 is determined from the combined state history data of the loaded event information, and the single state history data is examined to check whether it satisfies some of the notification-unnecessary event tables, acquired above, for use by the multi-sensor camera 1-1 in the controlled-by-camera single mode.

For example, let us assume that the notification-unnecessary event table shown in FIG. 34 is given as an notification-unnecessary event table for use by the multi-sensor camera 1-1 in the controlled-by-camera single mode, and the combined state history data of event information shown in FIG. 35 is given. In the combined state history data shown in FIG. 35, both combines states 0x01 and 0x11 indicate an event in the region 1-1 monitored by the multi-sensor camera 11-1, and thus states 0x01 and 0x01 in the combined state history data shown in FIG. 35 can be combined into one state in the controlled-by-camera single mode. Thus, single state history data associated with the multi-sensor camera 1-1 is produced as shown in FIG. 36. In this specific example shown in FIG. 36, it is determined that the single state history data does not satisfy the condition specified in the notification-unnecessary event table shown in FIG. 34. Thus, it is determined that the event described in the combined state history data shown in FIG. 35 will be determined by the multi-sensor camera 1-1 as an event needing to be notified to the user if the operation is performed in the controlled-by-camera single mode.

FIG. 38 shows single state history data of the multi-sensor camera 1-1 produced in a similar manner from combined state history data shown in FIG. 37. The single state history data shown in FIG. 38 is determined as satisfying the condition described in the notification-unnecessary event table shown in FIG. 34, and thus it is determined that the event described in the combined state history data shown in FIG. 37 will be determined by the multi-sensor camera 1-1 as needing to be notified to the user if the operation is performed in the controlled-by-camera single mode.

In the determination process described above, the determination is made as to what percentage of events actually evaluated by the user as needing to be notified in the controlled-by-server combined mode will also be determined as needing to be notified when the operation is performed in the controlled-by-camera single mode. In a similar manner, the determination is also made as to what percentage of events actually evaluated by the user as not needing to be notified in the controlled-by-server combined mode will also be determined as not needing to be notified when the operation is performed in the controlled-by-camera single mode. For all multi-sensor cameras, the above-described two ratios (event detection accuracy) are determined.

In step S204, the operation mode selector 78 determines for each of all multi-sensor cameras whether the event detection accuracy in the controlled-by-camera single mode calculated in step S203 is equal to or greater than a predetermined threshold value. If it is determined, for all multi-sensor cameras, that the event detection accuracy in the controlled-by-camera single mode is equal to or greater than the predetermined threshold value (that is, if it is determined that the event detection accuracy in the controlled-by-camera single mode is similar to that in the controlled-by-server combined mode), the process proceeds to step S209. In step S209, the controlled-by-camera single mode is selected as the operation mode. Thereafter, the process proceeds to step S210.

On the other hand, in the case in which it is determined in step S204 that the event detection accuracy in the controlled-by-camera single mode is smaller than the predetermined threshold value (that is, if it is determined that the event detection accuracy in the controlled-by-camera single mode is lower than that in the controlled-by-server combined mode), the process proceeds to step S205.

In step S205, the user input unit 77 displays a message to ask the user whether to select a low-power mode. If an answer from the user is acquired, the answer is notified to the operation mode selector 78.

In step S206, the operation mode selector 78 determines whether the low-power mode is selected on the basis of the notification acquired in step S205. If it is determined that the low-power mode is selected, the process proceeds to step S207. In step S207, the operation mode selector 78 sets the operation mode to the controlled-by-server combined mode. Thereafter, the process proceeds to step S210. On the other hand, if it determined that the low-power mode is not selected, the process proceeds to step S208. In step S208, the operation mode selector 78 sets the operation mode to the controlled-by-camera combined mode. Thereafter, the process proceeds to step S210.

In step S210, the operation mode selector 78 sends a notification indicating the operation mode determined via steps S207 to S209 to the multi-sensor cameras 1-1 and 1-2 via the transmitter 71. The operation mode selector 78 also sends the notification indicating the determined operation mode to the event notification controller 73, the event information recording unit 75, and the classification information generator 76.

In step S211, the transmitter 71 transmits the notification-unnecessary event table stored in the event classification information storage unit 80 to the multi-sensor cameras 1-1 and 1-2.

As described above, in the operation mode selection process, an operation mode most suitable for providing necessary and sufficient information to the user is set on the basis of the past event information stored in the monitoring system 21 and the selection by the user as to the low-power mode.

Figure 33:
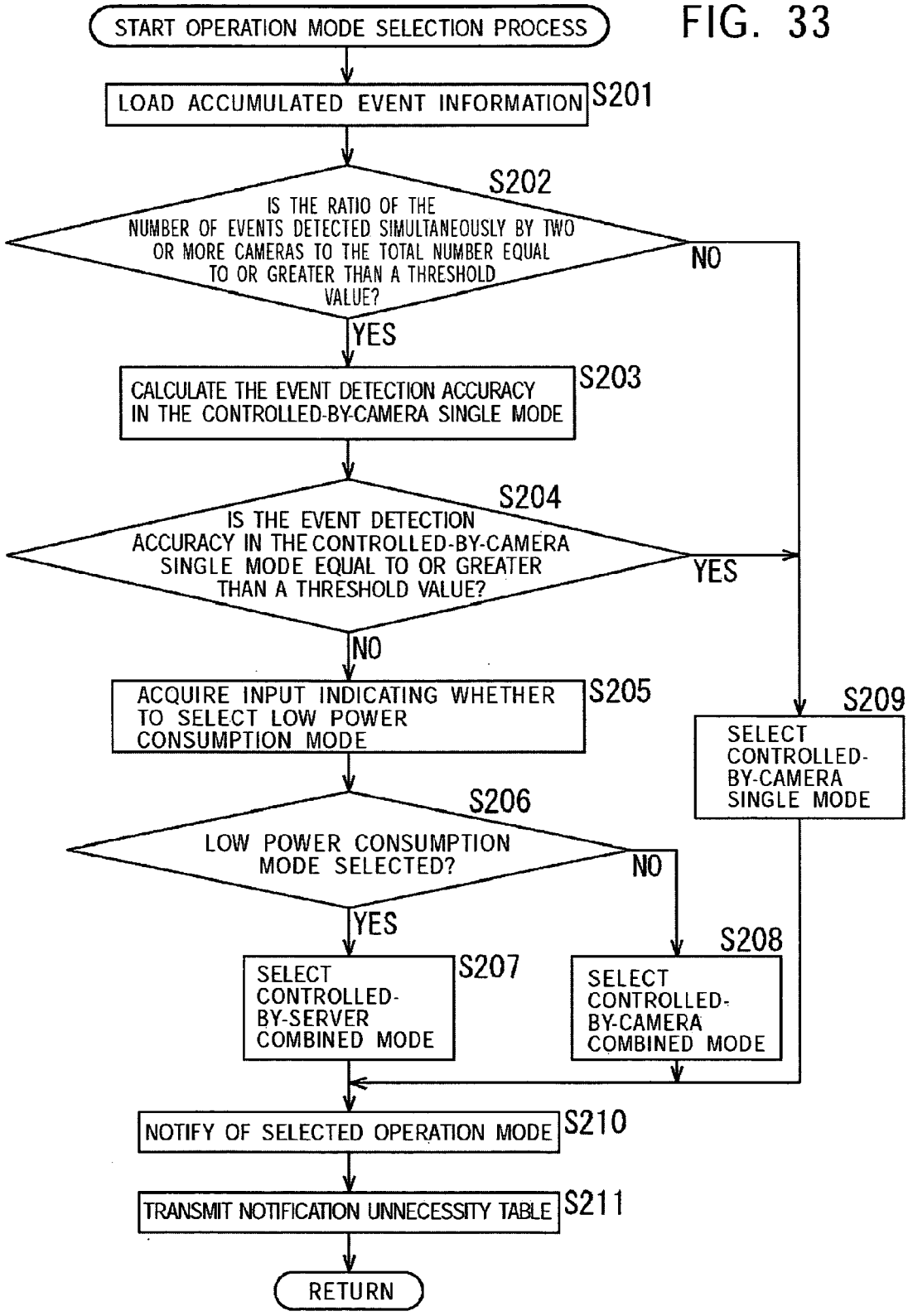
FIG. 33 is a flow chart showing an operation mode selection process performed by a server in step S177 in FIG. 22.

In the operation mode selection process shown in FIG. 33, the determination of whether to select the controlled-by-server combined mode (in which event detection is performed by the server 31) or the controlled-by-camera combined mode (in which event detection is performed by the multi-sensor cameras 1-1 and 1-2) is made in step S206 depending on whether the low-power mode is selected by the user. Alternatively, the determination may be made depending on the remaining capacity of the battery of the multi-sensor cameras 1-1 and 1-2. In this case, the process is performed as described below with reference to FIG. 39.

Figure 39:
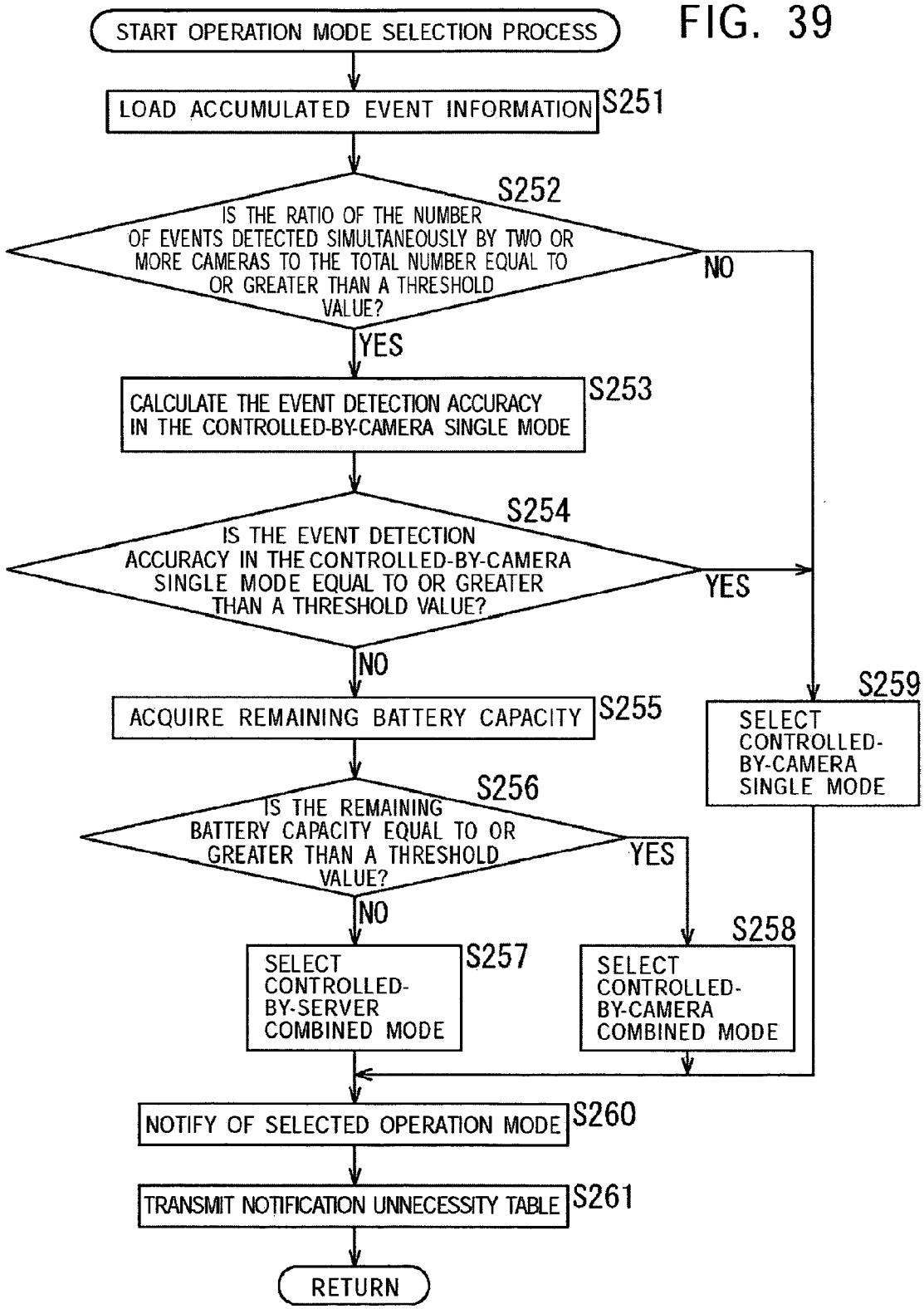
FIG. 39 is a flow chart showing an operation mode selection process performed by a server in step S177 in FIG. 22.

In the operation mode selection process shown in FIG. 39, step S205 (FIG. 33) of acquiring of a user's input indicating whether or not the low-power mode should be selected and step S206 (FIG. 33) of determining whether or not the low-power mode is selected are respectively replaced with steps S255 and S256, but the other steps in FIG. 39 are similar to those in FIG. 33. The similar steps are not described again herein, and the following discussion will be focused on steps S255 and S256.

In step S255, the operation mode selector 78 acquires, via the receiver 72, information associated with the remaining capacity of the battery 57 of the multi-sensor cameras 1-1 and 1-2. More specifically, the operation mode selector 78 transmits, via the transmitter 71, a request for notification of the remaining capacity of the battery to the multi-sensor cameras 1-1 and 1-2. If the state detector 52 receives this request for notification via the receiver 56, the state detector 52 detects the remaining capacity of the battery 57 and returns a notification indicating the detected remaining capacity via the transmitter 55.

In step S256, the operation mode selector 78 determines whether the remaining capacity of the battery is equal to or greater than a predetermined threshold value for all multi-sensor cameras. If it is determined that the remaining capacity of the battery is equal to or greater than the predetermined threshold value for all multi-sensor cameras, the process proceeds to step S258. In step S258, the operation mode selector 78 selects the controlled-by-camera combined mode as the operation mode. On the other hand, if it is determined that the remaining capacity of the battery of at least one or more multi-sensor cameras is lower than the predetermined threshold value, the process proceeds to step S257. In step S257, the operation mode selector 78 selects the controlled-by-server combined mode as the operation mode.

In the operation mode selection process shown in FIG. 39, the operation mode is selected depending on the status of power consumption of the multi-sensor cameras, without the user having to input a command to specify whether to select the low-power mode.

In the processes shown in FIGS. 33 and 39, when it is determined in step S204 or S254 that the event detection accuracy in the controlled-by-camera single mode is lower than the threshold value, the operation mode is determined based on the selection made by the user or the remaining capacity of the battery. Alternatively, a predetermined operation mode may be selected as described below with reference to FIGS. 40 and 41.

Figure 40:
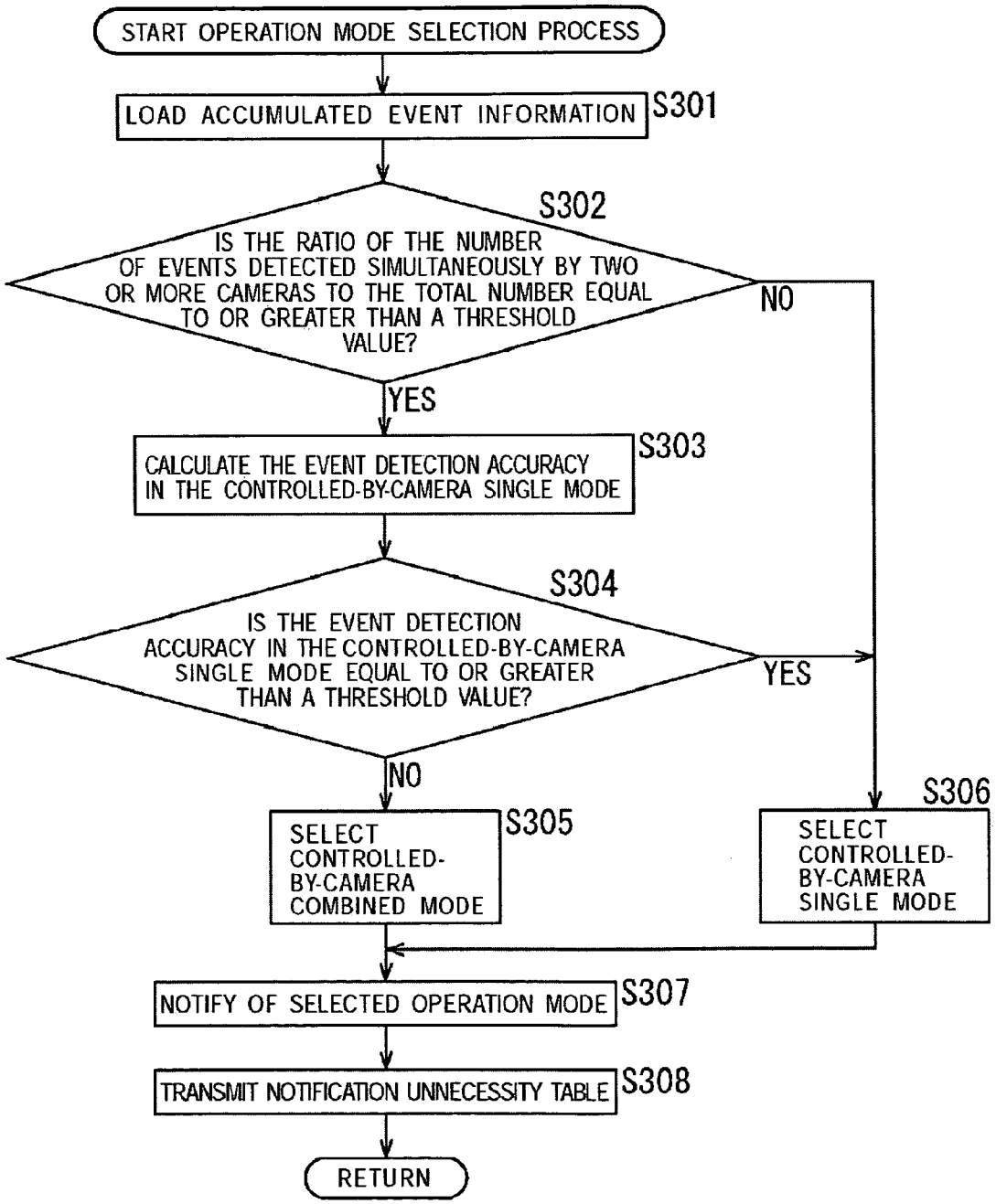
FIG. 40 is a flow chart showing an operation mode selection process performed by a server in step S177 in FIG. 22.

In the example shown in FIG. 40, if it is determined in step S304 corresponding to step S204 of FIG. 33 that the event detection accuracy in the controlled-by-camera single mode is lower than the threshold value, the process proceeds to step S305. In step S305, the controlled-by-camera combined mode is selected as the operation mode. Except for the above, the other steps are similar to those shown in FIG. 33.

The operation mode selection process shown in FIG. 40 is employed when the power consumption of the multi-sensor camera is not of significant concern as in the case in which no battery is used as a power supply of the multi-sensor cameras 1-1 and 1-2.

Figure 41:
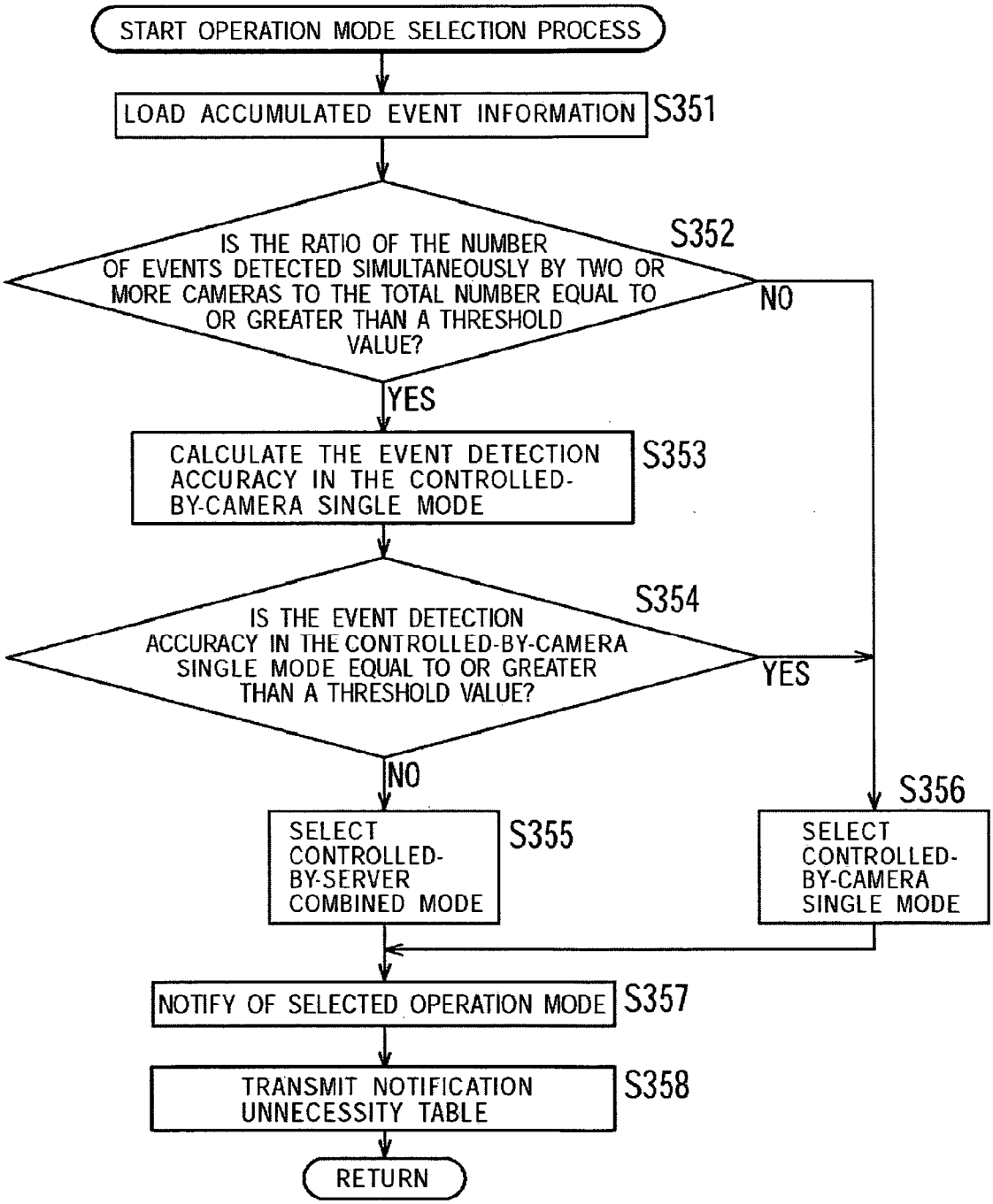
FIG. 41 is a flow chart showing an operation mode selection process performed by a server in step S177 in FIG. 22.

In the example shown in FIG. 41, if it is determined in step S354 corresponding to step S204 of FIG. 33 that the event detection accuracy in the controlled-by-camera single mode is lower than the threshold value, the process proceeds to step S355. In step S355, the controlled-by-server combined mode is selected as the operation mode. Except for the above, the other steps are similar to those shown in FIG. 33.

The operation mode selection process shown in FIG. 41 is employed when it is desirable to minimize the power consumption of the multi-sensor cameras 1-1 and 1-2.

The process performed by the monitoring system 21 after the operation mode is selected in the above-described manner is described below.

First, the operation performed by the multi-sensor cameras 1-1 and 1-2 is described below with reference to FIG. 14.

In step S2, the receiver 56 determines whether a notification of the operation mode has been received from the server 31. In this specific case, the notification indicating the operation mode transmitted from the server 31 in step S210 of FIG. 33 is received, and thus the answer to step S2 is affirmative. Thus, the process proceeds to step S3.

In step S3, the receiver 56 transfers the notification indicating the operation mode acquired in step S2 to the state detector 52 and the event notification controller 53. Hereinafter, the state detector 52 and the event notification controller 53 operate in the operation mode specified by the notification.

In step S4, the receiver 56 determines whether a notification-unnecessary event table has been received from the server 31. In this specific case, a notification-unnecessary event table has been received from the server 31 in step S211 of FIG. 33, and thus the answer to step S4 is affirmative. Thus, the process proceeds to step S5.

In step S5, the event notification controller 53 acquires the notification-unnecessary event table received in step S4 from the receiver 56 and stores the received table.

In step S6, the event notification controller 53 determines what operation mode is specified by the notification received in step S2. If it is determined that the controlled-by-server combined mode is specified, the process proceeds to step S7. In the case in which the controlled-by-camera combined mode is specified, the process proceeds to step S8. If it is determined that the controlled-by-camera single mode is specified, the process proceeds to step S9.

In step S7, S8, or S9, the monitoring operation is performed in the selected operation mode. Thereafter, the process proceeds to step S10. In step S10, the event notification controller 53 determines whether a command to end the monitoring operation has been issued by the user. If it is determined that the end command has not been issued, the operation flow returns to step S2, and the process is repeated from step S2.

As described above, after completion of the operation mode selection process, the multi-sensor cameras 1-1 and 1-2 receive the notification indicating the operation mode and also receive the notification-unnecessary event table, and the multi-sensor cameras 1-1 and 1-2 repeatedly perform the monitoring operation in the operation mode specified by the notification.

Now, monitoring operations performed by the monitoring system 21 in the respective operation modes are described below. In the controlled-by-server combined mode, the monitoring operation is performed by the monitoring system 21 (step S7 (FIG. 14) performed by the multi-sensor cameras and step S23 (FIG. 15) performed by the server) in a similar manner to the above-described process performed before the operation mode selection process, and thus a duplicated description thereof is not given herein. Steps S2 to S6 (FIG. 14) performed by the multi-sensor cameras 1-1 and 1-2, and steps S22 and S26 (FIG. 15) performed by the server 31 are performed in a similar manner as is performed at the beginning of the monitoring operation, and thus those steps are not described again.

In the controlled-by-camera combined mode, the monitoring operation (the monitoring operation by the multi-sensor cameras in step S8 of FIG. 14 and the monitoring operation by the server in step S24 of FIG. 15) is performed by the monitoring system 21 as is described below with reference to FIGS. 42 to 55. In the following description, it is assumed that an event occurs as described earlier with reference to FIGS. 4 to 7. It is also assumed, as in the case of the controlled-by-server combined mode described above, that the event in the state shown in FIG. 4 is evaluated such that it is not necessary to notify the user of the occurrence of the event, but it is determined that it is necessary to notify the user of the occurrence of the event in the state shown in FIG. 5.

In the controlled-by-camera combined mode, if an event occurs as shown in FIG. 4, the monitoring operation is performed by the monitoring system 21 as described below. In FIG. 4, as described earlier, the person 41 enters the monitored region 11-1 at time T=t, and thus an event occurs in the region monitored by the monitoring system 21.

Figure 42:
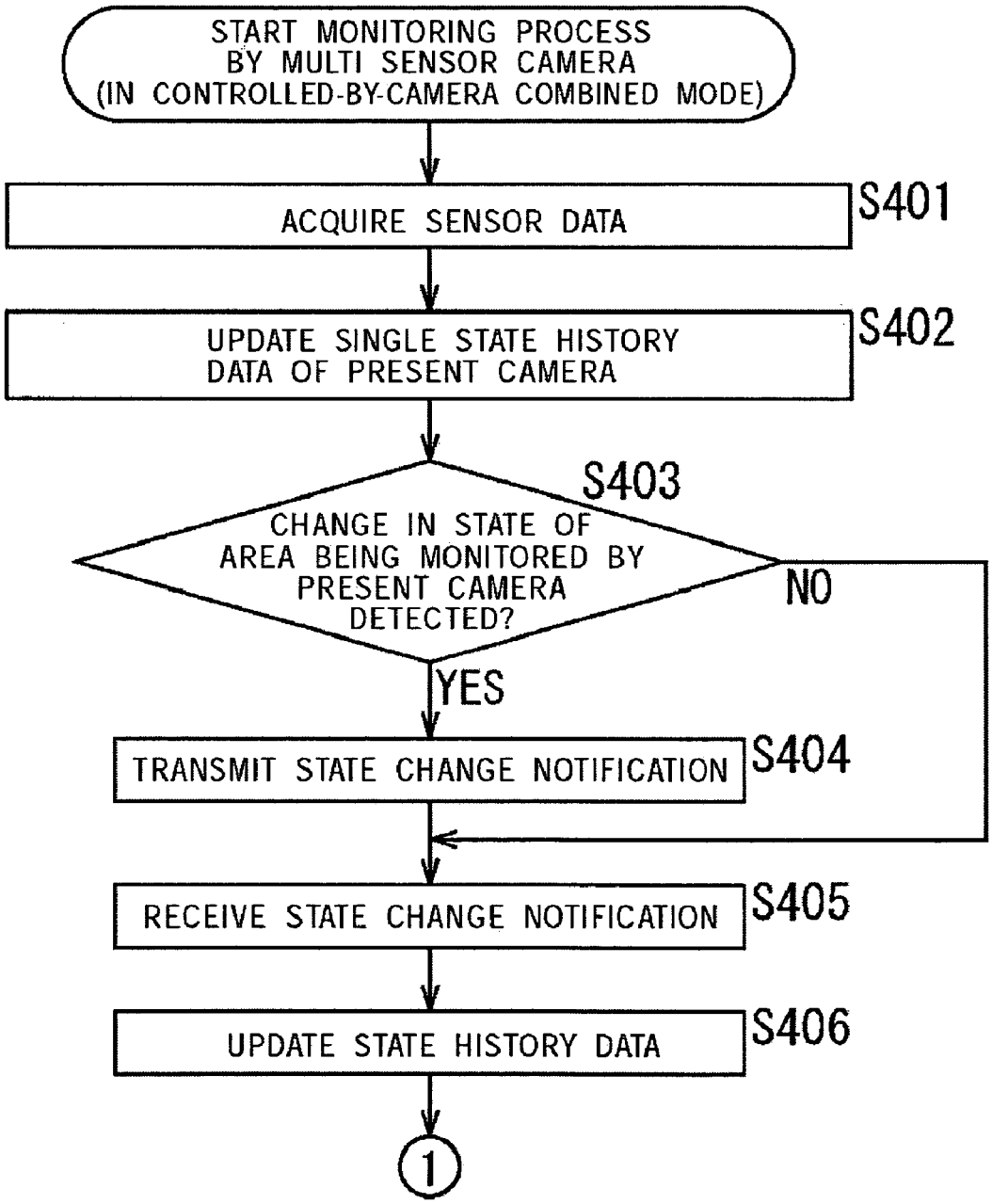
FIG. 42 is a flow chart showing a monitoring process performed by a multi-sensor camera in step S8 in FIG. 14.
Figure 43:
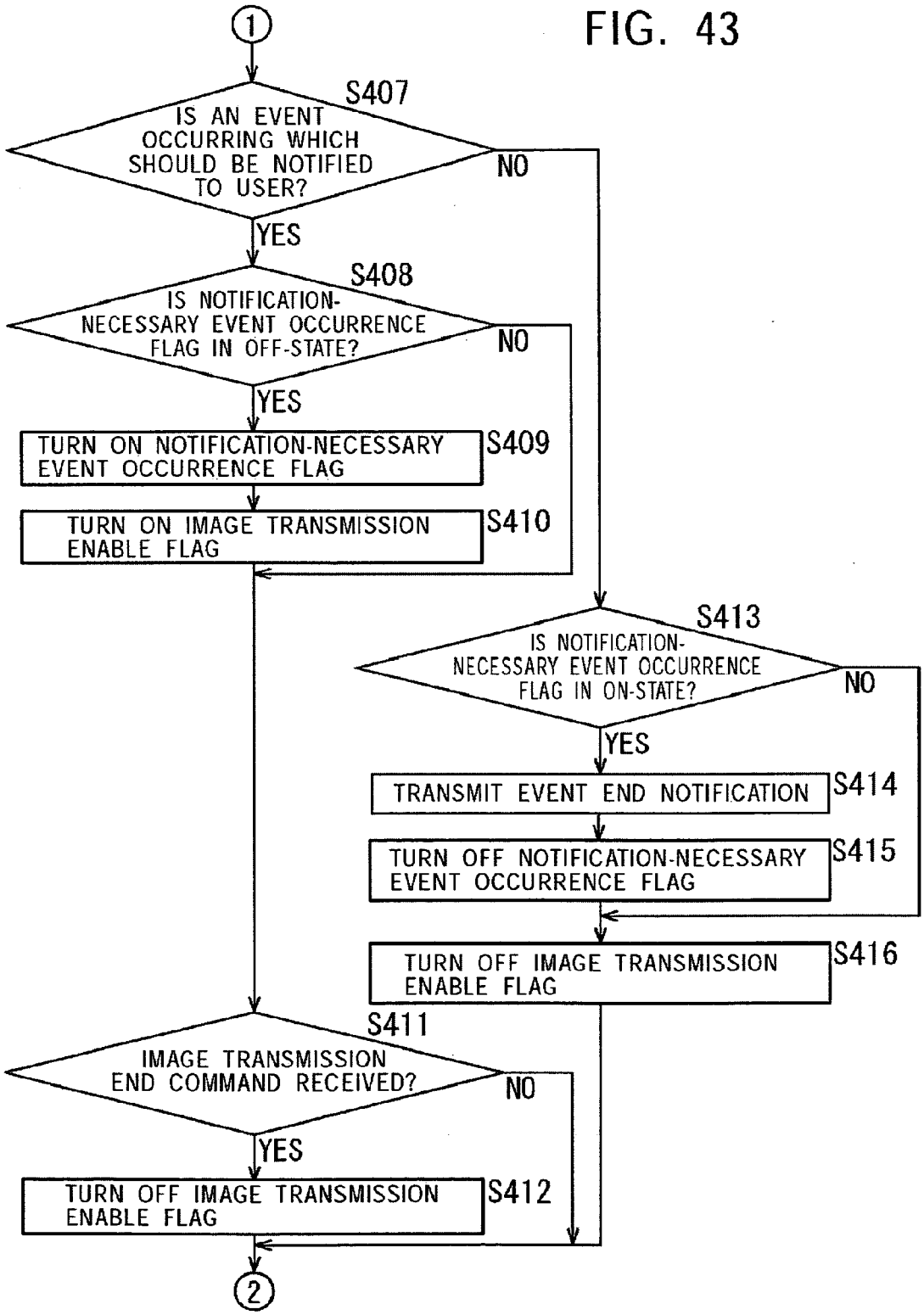
FIG. 43 is a flow chart showing a monitoring process performed by a multi-sensor camera in step S8 in FIG. 14.
Figure 44:
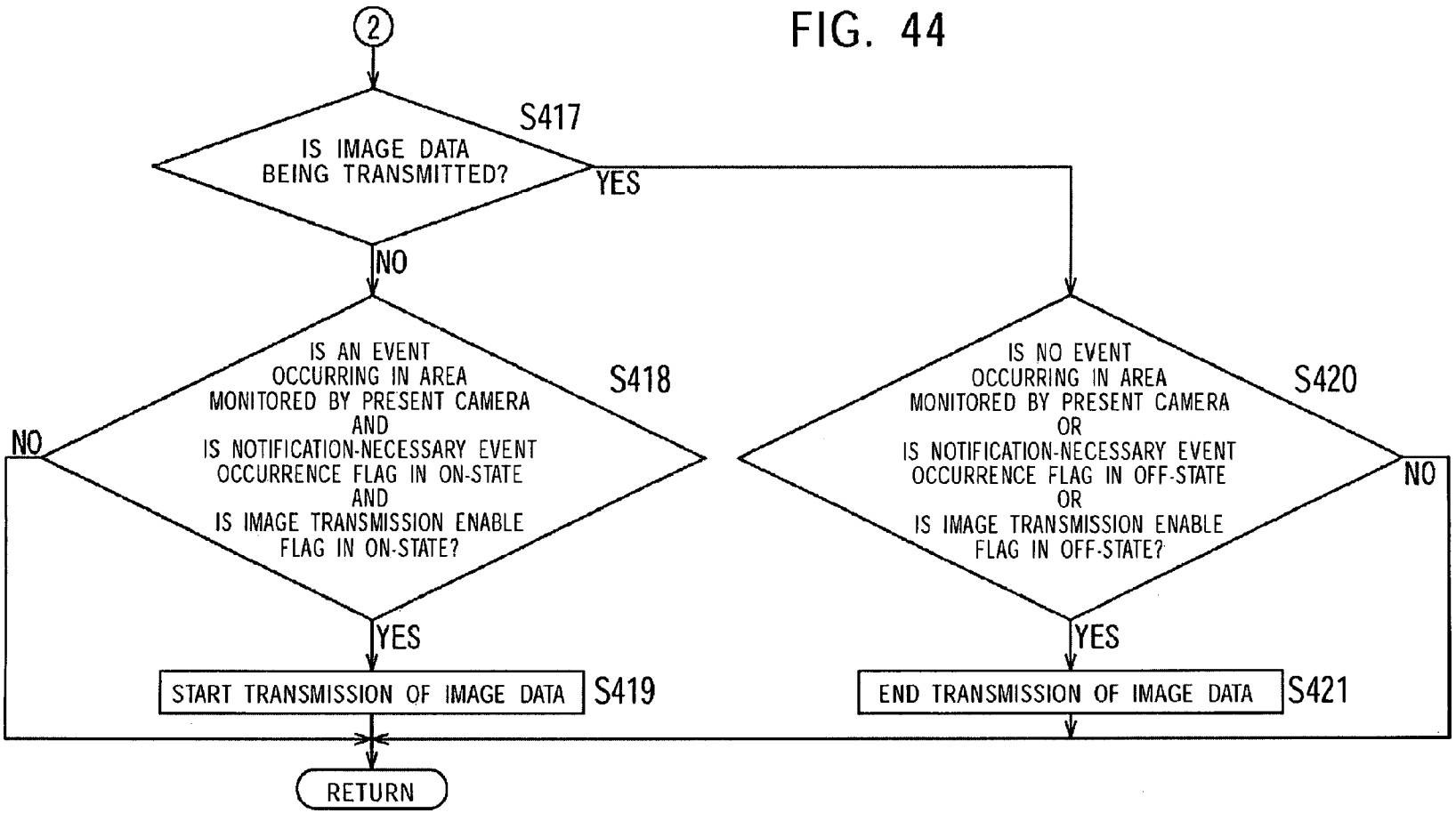
FIG. 44 is a flow chart showing a monitoring process performed by a multi-sensor camera in step S8 in FIG. 14.

The monitoring operation performed in this situation by the multi-sensor camera 1-1 in the controlled-by-camera combined mode (monitoring operation by multi-sensor camera in step S8 in FIG. 14) is described below with reference to FIGS. 42 to 44. At the beginning of the process, the notification-necessary event occurrence flag and the image transmission enable flag are both in the off-state.

In step S401, the state detector 52 acquires sensor data from the photosensor 51 in a similar manner as steps S101 and S102 (FIG. 16) in the controlled-by-server combined mode. In step S402, the state detector 52 updates the single state history data associated with the present camera (multi-sensor camera 1-1) on the basis of the sensor data acquired in step S401. Herein, the state history data of each of the multi-sensor cameras 1-1 and 1-2 is similar to that used in the controlled-by-server combined mode. Thus, the single state history data associated with the multi-sensor camera 1-1 is updated as shown in FIG. 18.

In step S403, as in step S103 (FIG. 16) in the controlled-by-server combined mode, the state detector 52 determines whether a change has occurred in the state of the region 11-1 monitored by the present multi-sensor camera (multi-sensor camera 1-1) after the last updating of the state history data. In this specific case, it is determined that a change is detected in the state of the region 11-1 monitored by the present camera, and thus the process proceeds to step S404.

In step S404, the state detector 52 transmits a state change notification to the other multi-sensor camera (multi-sensor camera 1-2) via the transmitter 55, unlike in the controlled-by-server combined mode in which the state change notification is transmitted to the server 31. The state change notification includes data indicating the single state number of the present camera (multi-sensor camera 1-1) at the present time. Thus, the notification indicating that the single state number of the multi-sensor camera 1-1 is 0x01 as of this time is sent to the multi-sensor camera 1-1. The state detector 52 also transmits the state change notification to the event notification controller 53.

In step S405, the event notification controller 53 receives a state change notification from the other multi-sensor camera (multi-sensor camera 1-2) via the receiver 56. At the point of time shown in FIG. 4, no event occurs yet in the region 11-2 monitored by the multi-sensor camera 1-2, and thus no change in the state of event has occurred. Therefore, no state change notification is transmitted from the multi-sensor camera 1-2. Thus, the process proceeds to step S406 without performing anything.

In step S406, the event notification controller 53 updates the combined state history data on the basis of (i) the state change notification associated with the present camera acquired in step S404 and (ii) the state change notification associated with the other multi-sensor camera (multi-sensor camera 1-2) received in step S405.

In the event notification controller 53, state history data including data indicating the state of the present multi-sensor camera, data indicating the state of the other multi-sensor camera, and data indicating the combined state is stored separately from the single state history data stored in the state detector 52. FIG. 45 shows the state history data stored, at this stage, in the event notification controller 53 of the multi-sensor camera 1-1. In this state history data, the state transition pattern of the single state of the present multi-sensor camera (multi-sensor camera 1-1) is described in the first row, and the state transition pattern of the single state of the other multi-sensor camera (multi-sensor camera 1-2) is described in the second row. The state transition pattern of the combined state of the multi-sensor cameras 1-1 and 1-2 is described as data stored in the multi-sensor camera 1-1 is described in the third row. In the fourth row, the duration of the state is described.

In this specific case, "single state 0x01" is recorded in the state transition pattern of the single state of the present multi-sensor camera. In this specific situation, no state change notification is received from the multi-sensor camera 1-2, it is determined that the multi-sensor camera 1-2 remains in the same single state, and thus "single state 0x00" is recorded in the state transition pattern of the single state of the other multi-sensor camera. In the state transition pattern of the combined state of the multi-sensor camera 1-1, "combined state 0x01" indicating the combined state of the multi-sensor cameras 1-1 and 1-2 is recorded. Because the event has just started, "0 sec" is recorded as the duration.

In step S407, the event notification controller 53 determines whether an event is occurring which should be notified to the user. More specifically, the event notification decision described earlier with reference to FIG. 13 is made on the basis of the combined state transition pattern and the duration described in the combined state history data shown in FIG. 45 and also the notification-unnecessary event table. In this specific case, it is determined that there is no event which should be notified to the user. Thus, the process proceeds to step S413.

In step S413, the event notification controller 53 determines whether the notification-necessary event occurrence flag is in the on-state. In this specific case, it is determined that the notification-necessary event occurrence flag is in the on-state, and thus the process proceeds to step S416 without performing steps S414 and S415.

In step S416, the event notification controller 53 turns off the image transmission enable flag.

In step S417, the event notification controller 53 determines whether image data is being transmitted to the server 31. In this specific case, it is determined that no image data is being transmitted, and thus the process proceeds to step S418.

In step S418, the event notification controller 53 determines whether (i) an event is occurring in the region 11-1 monitored by the present camera (multi-sensor camera 1-1), (ii) the notification-necessary event occurrence flag is in the on-state, and (ii) the image transmission enable flag is in the on-state. In this specific case, although an event is occurring in the region 11-1 monitored by the present camera, both the notification-necessary event occurrence flag and the image transmission enable flag are in the off-state, and thus the process proceeds to step S10 in FIG. 14 without performing step S419.

In the controlled-by-camera combined mode, as described above, the state history data is updated by the multi-sensor camera 1-1 on the basis of the state of the multi-sensor camera 1-1 and the state change notification received from the other multi-sensor camera (multi-sensor camera 1-2), and the event notification decision is made based on the state history data.

Now, the monitoring operation performed by the multi-sensor camera 1-2 in the controlled-by-camera combined mode (monitoring operation by multi-sensor camera in step S8 in FIG. 14) is described. At the beginning of the process, the notification-necessary event occurrence flag and the image transmission enable flag are both in the off-state.

In step S401, the state detector 52 acquires sensor data from the photosensor 51. In step S402, the state detector 52 updates the single state history data of the present camera (multi-sensor camera 1-2). FIG. 19 shows the resultant updated single state history data associated with the multi-sensor camera 1-2.

In this specific case, it is determined in step S403 that no change has occurred in state of the region 11-2 monitored by the present camera (multi-sensor camera 1-2). Thus, step S404 is skipped and the process proceeds to step S405 without transmitting a notice of change of state.

In step S405, the event notification controller 53 receives a state change notification from the other multi-sensor camera (multi-sensor camera 1-1) via the receiver 56. In this specific case, the state change notification transmitted in step S404 of FIG. 42 from the multi-sensor camera 1-1 is received.

In step S406, as in the case of the multi-sensor camera 1-1, the event notification controller 53 updates the combined state history data on the basis of (i) the state change notification associated with the present camera acquired in step S404 and (ii) the state change notification associated with the other multi-sensor camera (multi-sensor camera 1-1) received in step S405.

FIG. 46 shows the resultant updated state history data stored in the event notification controller 53 of the multi-sensor camera 1-2 at this point of time. In this state history data, the state transition pattern of the single state of the present multi-sensor camera (multi-sensor camera 1-2) is described in the first row, the state transition pattern of the single state of the other multi-sensor camera (multi-sensor camera 1-2) is described in the second row. The state transition pattern of the combined state of the multi-sensor cameras 1-1 and 1-2 is described as data stored in the multi-sensor camera 1-2 is described in the third row. In the fourth row, the duration of the state is described. In this specific case, "single state 0x00" is recorded in the state transition pattern of the single state of the present multi-sensor camera, and "single state 0x01" is recorded in the state transition pattern of the single state of the other multi-sensor camera on the basis of the state change notification received from the multi-sensor camera 1-1. In the state transition pattern of the combined state of the multi-sensor camera 1-2, "combined state 0x10" indicating the combined state of the multi-sensor cameras 1-1 and 1-2 is recorded. Because the event has just started, "0 sec" is recorded as the duration.

In step S407, the event notification decision described earlier with reference to FIG. 13 is made on the basis of the combined state transition pattern and the duration described in the combined state history data (FIG. 46) and also the notification-unnecessary event table. In this specific case, as in the case of the multi-sensor camera 1-1, it is determined that there is no event which should be notified to the user, and thus the process proceeds to step S413.

Steps S413 to S418 are performed in a similar manner as in the case of the multi-sensor camera 1-1. That is, in step S416, the image transmission enable flag is turned off, and the process proceeds to step S10 in FIG. 14.

As described above, the state history data is also updated by the multi-sensor camera 1-2 on the basis of the state of the multi-sensor camera 1-2 and the state change notification received from the other multi-sensor camera (multi-sensor camera 1-1), and the event notification decision is made based on the state history data.

Figure 47:
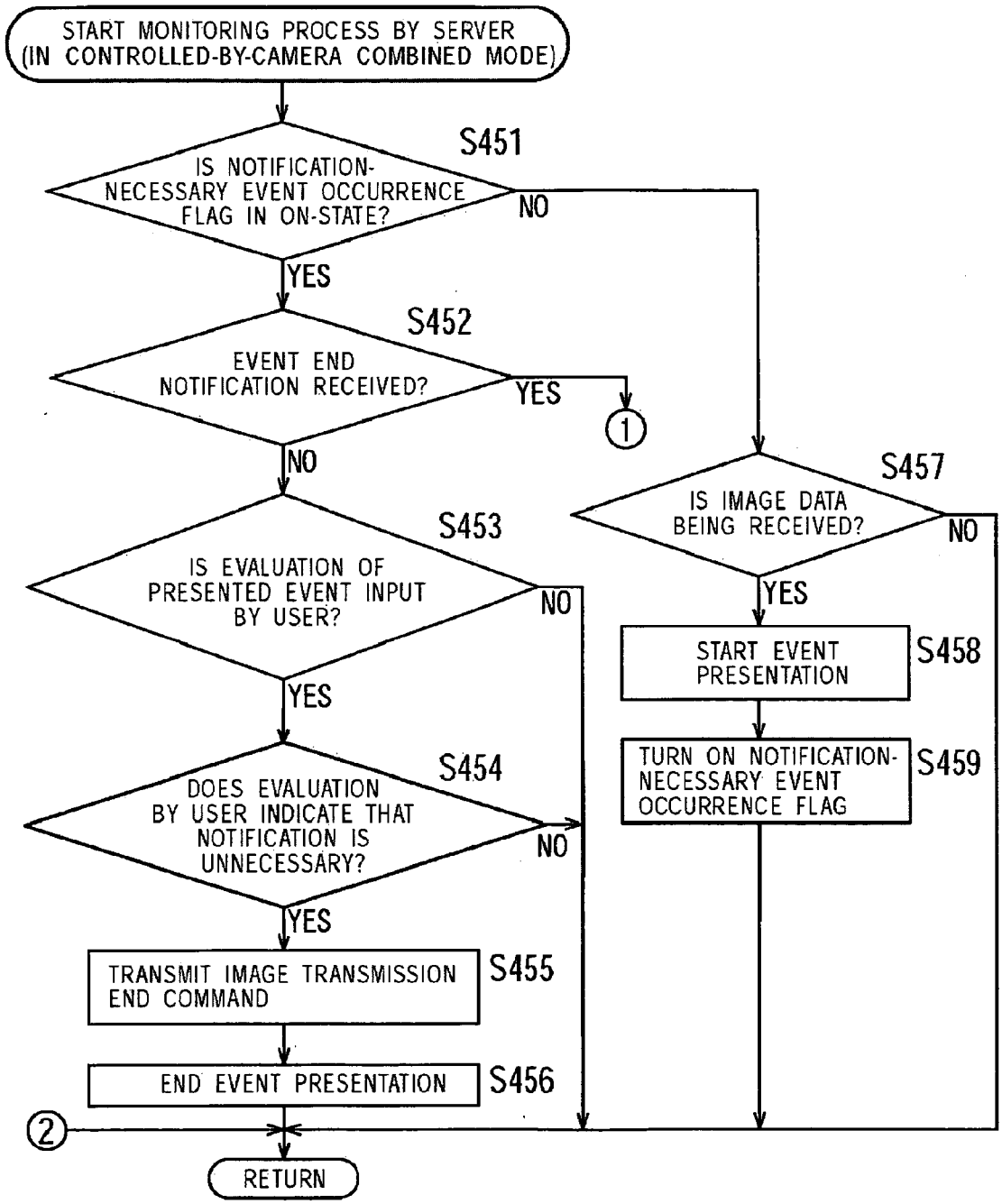
FIG. 47 is a flow chart showing a monitoring process performed by a server in step S24 in FIG. 15.

In the controlled-by-camera combined mode, corresponding to the operation performed by the multi-sensor cameras 1-1 and 1-2 according to the flow chart shown in FIGS. 42 to 44, the monitoring operation (monitoring operation by server in step S24 in FIG. 15) is performed by the server 31 as described below with reference to FIGS. 47 and 48. At the beginning of the process, the notification-necessary event occurrence flag is in the off-state.

In step S451, the event notification controller 73 determines whether the notification-necessary event occurrence flag is in the on-state. In this specific case, it is determined that the notification-necessary event occurrence flag is in the off-state, and thus the process proceeds to step S457.

In step S457, the receiver 72 determines whether image data is being received from the multi-sensor cameras 1-1 and 1-2. In this specific case, no image data is being transmitted from the multi-sensor camera 1-1 or 1-2, and thus it is determined that no image data is being received. Thus, the process proceeds to step S26 in FIG. 15 without performing steps S458 and S459.

In this case, no particular processing is performed until image data is received.

In the controlled-by-camera combined mode, if the state of the event changes into the state shown in FIG. 5, the monitoring operation is performed by the monitoring system 21 as described below. In the state shown in FIG. 5, as described earlier, the person 41 enters the monitored region 11-3 m sec after the state shown in FIG. 4, that is, at a time T=t+m.

First, the monitoring operation performed by the multi-sensor camera 1-1 (monitoring operation by multi-sensor camera in step SB in FIG. 14) is described.

In step S401, the state detector 52 acquires sensor data from the photosensor 51. In step S402, the state detector 52 updates the single state history data of the present camera (multi-sensor camera 1-1). FIG. 24 shows the resultant updated single state history data associated with the multi-sensor camera 1-1.

In this specific case, it is determined in step S403 that no change has occurred in the state of the region 11-1 monitored by the present camera (multi-sensor camera 1-1). Thus, step S404 is skipped and the process proceeds to step S405 without transmitting a notice of change of state.

In step S405, a state change notification is received from the other multi-sensor camera (multi-sensor camera 1-2). In step S406, the state history data is updated. FIG. 49 shows the resultant updated state history data stored in the event notification controller 53 of the multi-sensor camera 1-1. That is, the state transition pattern of the single state of the other multi-sensor camera (multi-sensor camera 1-2) is updated into "single state 0x01", and the state transition pattern of the combined state of the multi-sensor cameras 1-1 and 1-2 is updated into "combined state 0x11". Furthermore, the duration of the "combined state 0x01" is updated to m sec.

In step S407, the event notification decision described earlier with reference to FIG. 13 is made on the basis of the combined state transition pattern and the duration described in the combined state history data (FIG. 49) and also the notification-unnecessary event table. In this specific case, it is determined that an event is occurring which should be notified to the user, and thus the process proceeds to step S408.

In step S408, the event notification controller 53 determines whether the notification-necessary event occurrence flag is in off-state. In this specific case, it is determined that the notification-necessary event occurrence flag is in the off-state, and thus the process proceeds to step S409.

In step S409, the event notification controller 53 turns on the notification-necessary event occurrence flag.

In step S410, the event notification controller 53 turns on the image transmission enable flag.

In step S411, the receiver 56 determines whether an image transmission end command has been received from the server 31. Note that the image transmission end command is transmitted in step S455 (FIG. 47) when the server 31 determines in step S454 in FIG. 47 (described later) that a user's evaluation indicates that notification of the event is not necessary. In this specific case, no event is yet presented to the user, and thus the image transmission end command is not transmitted from the server 31. Thus, it is determined that the image transmission end command has not been received, and the process proceeds to step S417 without performing step S412.

In step S417, in this specific case, it is determined that no image data is being transmitted to the server 31, and thus the process proceeds to step S418.

In step S418, it is determined whether (i) an event is occurring in the region 11-1 monitored by the present camera (multi-sensor camera 1-1), (ii) the notification-necessary event occurrence flag is in the on-state, and (ii) the image transmission enable flag is in the on-state. In this specific case, an event is occurring in the region 11-1 monitored by the multi-sensor camera 1-1, and both the notification-necessary event occurrence flag and the image transmission enable flag are in the on-state, and thus the process proceeds to step S419.

In step S419, the event notification controller 53 turns on the power of the camera 54 in a similar manner as in step S111 (FIG. 17) in the controlled-by-server combined mode. In response, transmission of image data taken by the camera 54 to the server 31 via the transmitter 55 is started. Thereafter, the process proceeds to step S10 in FIG. 14.

As described above, if it is determined, in the event notification decision performed by multi-sensor camera 1-1, that an event is occurring which should be notified to the user, transmission of image data to the server 31 is started.

Now, the monitoring operation performed by the multi-sensor camera 1-2 (monitoring operation by multi-sensor camera in step S8 in FIG. 14) is described.

In step S401, the state detector 52 acquires sensor data from the photosensor 51. In step S402, the state detector 52 updates the single state history data of the present camera (multi-sensor camera 1-2). FIG. 25 shows the resultant updated single state history data associated with the multi-sensor camera 1-2.

In step S403, in this specific case, it is determined that a change has occurred in state (single state number) of the region 11-2 monitored by the present camera (multi-sensor camera 1-2), and thus the process proceeds to step S404. In step S404, a state change notification is transmitted to the other multi-sensor camera (multi-sensor camera 1-1) and the event notification controller 53.

In this specific case, a state change notification is not received in step S405 from the other multi-sensor camera (multi-sensor camera 1-1), and thus, the process proceeds to step S406 without performing any processing.

In step S406, the state history data is updated. FIG. 50 shows the resultant updated state history data stored in the event notification controller 53 of the multi-sensor camera 1-2. That is, the state transition pattern of the single state of the present multi-sensor camera (multi-sensor camera 1-2) is updated into "single state 0x01", and the state transition pattern of the combined state of the multi-sensor cameras 1-1 and 1-2 is updated into "combined state 0x11". Furthermore, the duration of the "combined state 0x10" is updated to m sec.

In step S407, the event notification decision described earlier with reference to FIG. 13 is made on the basis of the combined state transition pattern and the duration described in the combined state history data (FIG. 50) and also the notification-unnecessary event table. In this specific case, it is determined that an event is occurring which should be notified to the user, and thus the process proceeds to step S408.

Steps S408 to S419 are performed in a similar manner as in the case of the multi-sensor camera 1-1. In step S409, the notification-necessary event occurrence flag is turned on. In step S410, the image transmission enable flag is turned on. Thereafter, in step S419, transmission of image data to the server 31 is started. The process then proceeds to step S10 in FIG. 14.

As described above, it is also determined in the multi-sensor camera 1-2 that an event is occurring which should be notified to the user, and thus transmission of image data to the server 31 is started.

Now, the operation performed by the server 31 (monitoring operation by server in step S24 in FIG. 15) is described.

In step S451, in this specific example, it is determined that the notification-necessary event occurrence flag is in the off-state, and thus the process proceeds to step S457.

In step S457, the receiver 72 determines whether image data is being received from the multi-sensor cameras 1-1 and 1-2. As described above, transmission of image data from the multi-sensor cameras 1-1 and 1-2 has already been started in step S419 in FIG. 44, and the server 31 is receiving the image data. Thus in this specific case, it is determined that image data is being received, and the process proceeds to step S458.

In step S458, the receiver 72 starts transferring of the image data received from the multi-sensor cameras 1-1 and 1-2 to the event presentation controller 74. The event presentation controller 74 produces data to be presented to the user on the basis of the acquired image data and outputs the produced data to the presentation unit 32 shown in FIG. 3A. In response, the presentation unit 32 presents the event.

In step S459, the event notification controller 73 turns on the notification-necessary event occurrence flag. Thereafter, the process proceeds to step S26 in FIG. 15.

As described above, when the multi-sensor cameras 1-1 and 1-2 start transmission of image data, presentation of the event is started.

In the controlled-by-camera combined mode, if the state of the event changes into the state shown in FIG. 6, the monitoring operation is performed by the monitoring system 21 as described below. In the state shown in FIG. 6, as described earlier, the person 41 goes out of the monitored regions 11-1 and enters the monitored region 11-2 at T=t+m+n, that is, n sec after the state shown in FIG. 5.

First, the monitoring operation performed by the multi-sensor camera 1-1 (monitoring operation by multi-sensor camera in step S8 in FIG. 14) is described.

In step S401, the state detector 52 acquires sensor data from the photosensor 51. In step S402, the state detector 52 updates the single state history data of the present camera (multi-sensor camera 1-1). FIG. 27 shows the resultant updated single state history data associated with the multi-sensor camera 1-1.

In this specific case, it is determined in step S403 that a change has occurred in the state (single state number) of the region 11-1 monitored by the present camera (multi-sensor camera 1-1), and thus the process proceeds to step S404. In step S404, a state change notification is transmitted to the other multi-sensor camera (multi-sensor camera 1-2) and the event notification controller 53.

In this specific case, a state change notification is not received in step S405 from the other multi-sensor camera (multi-sensor camera 1-2), and thus, the process proceeds to step S406 without performing any processing.

In step S406, the state history data is updated. FIG. 51 shows the resultant updated state history data stored in the event notification controller 53 of the multi-sensor camera 1-1. That is, the state transition pattern of the single state of the present multi-sensor camera (multi-sensor camera 1-1) is updated into "single state 0x00", and the state transition pattern of the combined state of the multi-sensor cameras 1-1 and 1-2 is updated into "combined state 0x10". Furthermore, the duration of the "combined state 0x11" is updated to n sec.

In step S407, the event notification decision described earlier with reference to FIG. 13 is made on the basis of the combined state transition pattern and the duration described in the combined state history data (FIG. 51) and also the notification-unnecessary event table. In this specific case, it is determined that an event is occurring which should be notified to the user, and thus the process proceeds to step S408.

In step S408, in this specific case, it is determined that the notification-necessary event occurrence flag is in the on-state, and thus the process proceeds to step S411 without performing steps S409 and S410.

In step S411, the receiver 56 determines whether an image transmission end command has been received from the server 31. If it is determined that the image transmission end command has been received, the process proceeds to step S412. In step S412, the event notification controller 53 turns off the image transmission enable flag. On the other hand, if it is determined that the image transmission end command is not received, the process proceeds to step S417 without performing step S412. In the following description, it is assumed that it is determined in step S411 that the image transmission end command is not received.

In step S417, in this specific case, it is determined that image data is being transmitted to the server 31, and thus the process proceeds to step S420.

In step S420, the event notification controller 53 determines whether (i) no event is occurring in the region 11-1 monitored by the present camera (multi-sensor camera 1-1), (ii) the notification-necessary event occurrence flag is in the off-state, or (ii) the image transmission enable flag is in the off-state. In this specific case, no event is occurring in the monitored region 11-1, and thus the process proceeds to step S421.

In step S421, the event notification controller 53 turns off the power of the camera 54 thereby stopping transmission of image data to the server 31. Thereafter, the process proceeds to step S10 in FIG. 14.

Although the event is still occurring at some place of the total region monitored by the monitoring system 21, the event is over in the region 11-1 monitored by the multi-sensor camera 1-1, and thus transmission of image data from the multi-sensor camera 1-1 is ended.

Now, the monitoring operation performed by the multi-sensor camera 1-2 (monitoring operation by multi-sensor camera in step S8 in FIG. 14) is described.

In step S401, the state detector 52 acquires sensor data from the photosensor 51. In step S402, the state detector 52 updates the single state history data of the present camera (multi-sensor camera 1-2). FIG. 28 shows the resultant updated single state history data associated with the multi-sensor camera 1-2.

In this specific case, it is determined in step S403 that no change has occurred in the state of the region 11-2 monitored by the present camera (multi-sensor camera 1-2). Thus, step S404 is skipped and the process proceeds to step S405 without transmitting a notice of change of state.

In step S405, a state change notification is received from the other multi-sensor camera (multi-sensor camera 1-2). In step S406, the state history data is updated. FIG. 52 shows the resultant updated state history data stored in the event notification controller 53 of the multi-sensor camera 1-2. That is, the state transition pattern of the signal state of the other multi-sensor camera (multi-sensor camera 1-2) is updated into "single state 0x00", and the state transition pattern of the combined state of the multi-sensor cameras 1-1 and 1-2 is updated into "combined state 0x01". Furthermore, the duration of the "combined state 0x11" is updated to n sec.

In step S407, the event notification decision described earlier with reference to FIG. 13 is made on the basis of the combined state transition pattern and the duration described in the combined state history data (FIG. 52) and also the notification-unnecessary event table. In this specific case, it is determined that an event is occurring which should be notified to the user, and thus the process proceeds to step S408.

Steps S408 to S417 are performed in a similar manner as in the case of the multi-sensor camera 1-1. That is, in step S417, in this specific case, it is determined that image data is being transmitted to the server 31, and thus the process proceeds to step S420.

In step S420, it is determined whether (i) no event is occurring in the region 11-2 monitored by the present camera (multi-sensor camera 1-2), (ii) the notification-necessary event occurrence flag is in the off-state, or (ii) the image transmission enable flag is in the off-state. In this specific case, an event is occurring in the region 11-2 monitored by the present camera and both the notification-necessary event occurrence flag and the image transmission enable flag are in the on-state, and thus the process proceeds to step S10 in FIG. 14 without performing step S421.

Because the event is still occurring in the region 11-2 monitored by the multi-sensor camera 1-2, transmission of image data to the server 31 is continued without being stopped.

Now, the operation performed by the server 31 (monitoring operation by server in step S24 in FIG. 15) is described.

In step S451, in this specific example, it is determined that the notification-necessary event occurrence flag is in the on-state, and thus the process proceeds to step S452.

In step S452, the receiver 72 determines whether an end-of-event notification has been received from the multi-sensor camera 1-1 or 1-2. In this specific case, no end-of-event notification is transmitted by the multi-sensor camera 1-1 or 1-2, and thus it is determined that no end-of-event notification is received. Thus, the process proceeds to step S453.

Figure 20:
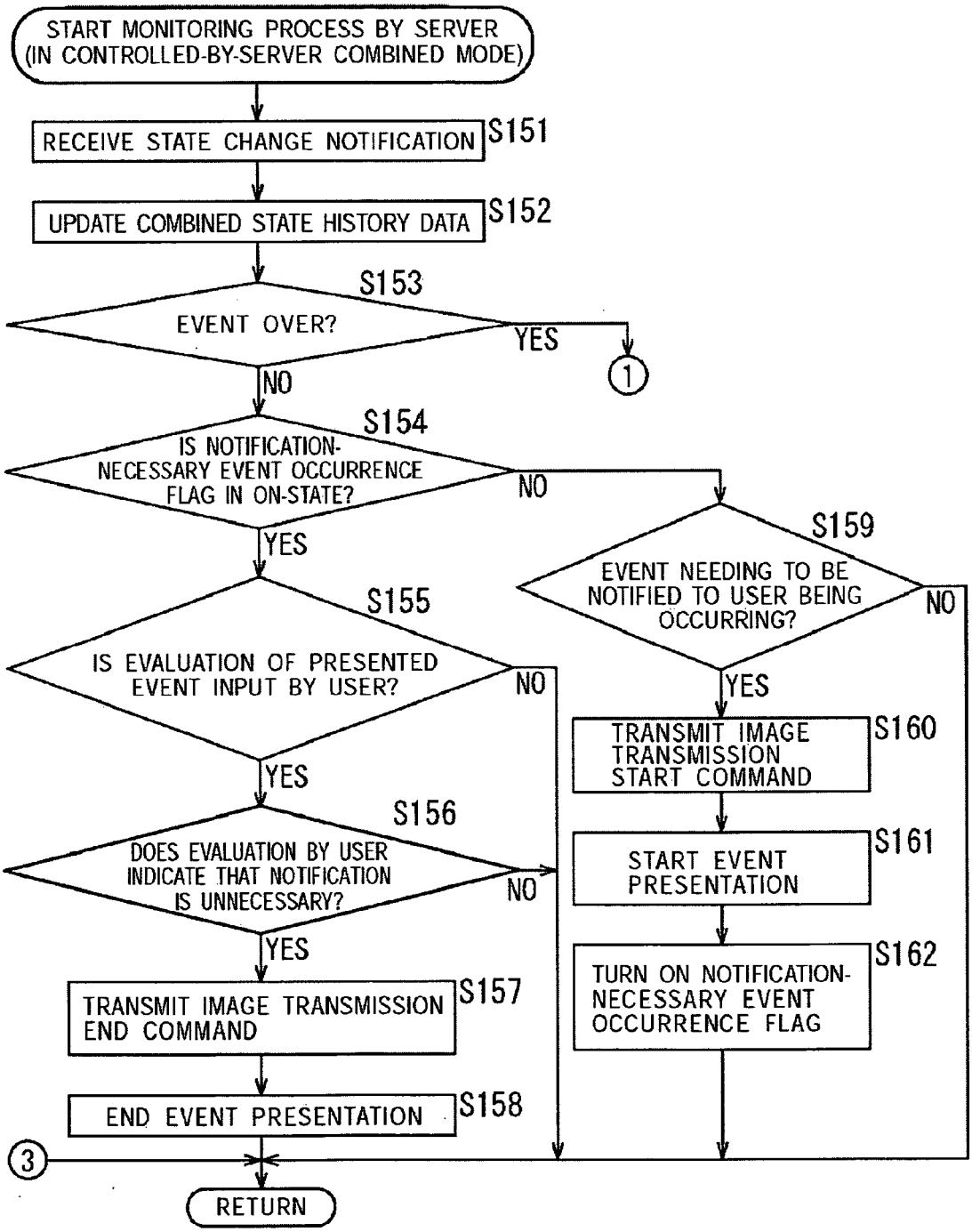
FIG. 20 is a flow chart showing a monitoring process performed by a server in step S23 in FIG. 15.

Steps S453 to S456 are performed in a similar manner as in steps S155 to S158 in FIG. 20 in the controlled-by-server combined mode. That is, in step S453, the user inputs evaluation indicating whether a notification of the presented event is unnecessary. If it is determined in step S454 that the evaluation by the user indicates that notification is not necessary, then, in step S455, an image transmission end command is transmitted to the multi-sensor cameras 1-1 and 1-2. In response, in step S456, the event presentation is ended.

In the following description, it is assumed that it is determined in step S453 that user's evaluation indicating whether or not a notification is necessary is not acquired. In the case in which it is determined in step S453 that evaluation indicating whether or not a notification is necessary is not input by a user, the process proceeds to step S26 in FIG. 15.

If an end-of-event notification is not transmitted from the multi-sensor cameras 1-1 and 1-2 and an evaluation indicating that a notification is unnecessary is not input by a user, the presentation of the event is continued without being stopped.

In the controlled-by-camera combined mode, if the state of the event changes into the state shown in FIG. 7, the monitoring operation is performed by the monitoring system 21 as described below. In the state shown in FIG. 7, as described earlier, the person 41 goes out of the region covered by the monitoring system 21 and thus the event is over at T=t+m+n+p, that is, p sec after the state shown in FIG. 6.

First, the monitoring operation performed by the multi-sensor camera 1-1 in the controlled-by-camera combined mode (monitoring operation by multi-sensor camera in step S8 in FIG. 14) is described.

In step S401, the state detector 52 acquires sensor data from the photosensor 51. In step S402, the state detector 52 updates the single state history data of the present camera (multi-sensor camera 1-1). FIG. 30 shows the resultant updated single state history data associated with the multi-sensor camera 1-1.

In this specific case, it is determined in step S403 that no change has occurred in the state of the region 11-1 monitored by the present camera (multi-sensor camera 1-1). Thus, step S404 is skipped and the process proceeds to step S405 without transmitting a notice of change of state.

In step S405, in this specific case, a state change notification is received from the other multi-sensor camera (multi-sensor camera 1-2). In step S406, the state history data is updated. FIG. 53 shows the resultant updated state history data stored in the event notification controller 53 of the multi-sensor camera 1-1. As shown in FIG. 53, the duration of the "combined state 0x10" is updated to p sec. Herein, it is detected that the current combined state is "combined state 0x00" (that is, it is detected that the event is over).

In this specific case, the event in the region monitored by the monitoring system 21 is over, and thus it is determined in step S407 that there is no event whose occurrence should be notified to a user. Thus, the process proceeds to step S413.

In step S413, the event notification controller 53 determines whether the notification-necessary event occurrence flag is in the on-state. In this specific case, it is determined that the notification-necessary event occurrence flag is in the on-state, and thus the process proceeds to step S414.

In step S414, the event notification controller 53 transmits an end-of-event notification to the server 31 via the transmitter 55. Note that the end-of-event notification includes single state history data of the multi-sensor camera 1-1 shown in FIG. 53.

In step S415, the event notification controller 53 turns off the notification-necessary event occurrence flag.

In step S416, the event notification controller 53 turns off the image transmission enable flag.

In step S417, in this specific case, it is determined that no image data is being transmitted to the server 31, and thus the process proceeds to step S418.

In step S418, it is determined whether (i) an event is occurring in the region 11-1 monitored by the present camera (multi-sensor camera 1-1), (ii) the notification-necessary event occurrence flag is in the on-state, and (ii) the image transmission enable flag is in the on-state. In this specific case, no event is occurring in the region 11-1 monitored by the present camera and both the notification-necessary event occurrence flag and the image transmission enable flag are in the off-state, and thus step S419 is skipped and the process proceeds to step S10 in FIG. 14.

As described above, if the multi-sensor camera 1-1 detects an end of an event evaluated by a user as not needing to be notified, the multi-sensor camera 1-1 transmits an end-of-event notification to the server 31.

Now, the monitoring operation performed by the multi-sensor camera 1-2 (monitoring operation by multi-sensor camera in step SB in FIG. 14) is described.

In step S401, the state detector 52 acquires sensor data from the photosensor 51. In step S402, the state detector 52 updates the single state history data of the present camera (multi-sensor camera 1-2). FIG. 31 shows the resultant updated single state history data associated with the multi-sensor camera 1-2.

In step S403, in this specific case, it is determined that a change has occurred in state of the region 11-2 monitored by the present camera (multi-sensor camera 1-2), and thus the process proceeds to step S404. In step S404, a state change notification is transmitted to other multi-sensor cameras (multi-sensor camera 1-1) and the event notification controller 53.

In this specific case, a state change notification is not received in step S405 from the other multi-sensor camera (multi-sensor camera 1-1), and thus, the process proceeds to step S406 without performing any processing.

In step S406, the combined state history data is updated. FIG. 54 shows the resultant updated state history data stored in the event notification controller 53 of the multi-sensor camera 1-2. As shown in FIG. 54, the duration of the "combined state 0x01" is updated to p sec. Herein, it is detected that the current combined state is "combined state 0x00" (that is, it is detected that the event is over).

Steps S407 to S416 are performed in a similar manner as in the case of the multi-sensor camera 1-1. That is, in step S414, an end-of-event notification is transmitted to the server 31. In step S415, the notification-necessary event occurrence flag is turned off. In step S416, the image transmission enable flag is turned off.

In step S417, in this specific case, it is determined that image data is being transmitted to the server 31, and thus the process proceeds to step S420.

In step S420, it is determined whether (i) no event is occurring in the region 11-2 monitored by the present camera (multi-sensor camera 1-2), (ii) the notification-necessary event occurrence flag is in the off-state, or (iii) the image transmission enable flag is in the off-state. In this specific case, no event is occurring in the region 11-2 monitored by the present camera and both the notification-necessary event occurrence flag and the image transmission enable flag are in the off-state, and thus the process proceeds to step S421.

In step S421, the event notification controller 53 turns off the power of the camera 54 thereby stopping transmission of image data to the server 31. Thereafter, the process proceeds to step S10 in FIG. 14.

Thus, the end of the event needing to be notified to a user is also detected by the multi-sensor camera 1-2, and an end-of-event notification is transmitted to the server 31 and transmission of image data to the server 31 is stopped.

Now, the operation performed by the server 31 (monitoring operation by server in step S24 in FIG. 15) is described.

In step S451, in this specific example, it is determined that the notification-necessary event occurrence flag is in the on-state, and thus the process proceeds to step S452.

In step S452, The receiver 72 determines whether an end-of-event notification has been received from the multi-sensor camera 1-1 or 1-2. In this specific case, the end-of-event notification transmitted in step S414 (FIG. 43) from the multi-sensor cameras 1-1 and 1-2 is received, and thus the process proceeds to step S460.

In step S460, the event information recording unit 75 stores event information in the event information storage unit 79 in a similar manner as in step S163 (FIG. 21) in the controlled-by-server combined mode. More specifically, the event information recording unit 75 acquires via the receiver 72 the end-of-event notification received in step S452 and generates the event information on the basis of the state history data of the multi-sensor cameras 1-1 and 1-2 included in the end-of-event notification. As in the controlled-by-server combined mode, the event information includes an event number, state history data, an event occurrence time, and a user's evaluation. FIG. 55 shows an example of state history data in the controlled-by-camera combined mode. As shown in FIG. 55, the state history data includes single-state transition patterns of respective multi-sensor cameras 1-1 and 1-2, combined-state transition patterns of respective multi-sensor cameras 1-1 and 1-2, and durations of respective states.

Steps S461 to S466 are performed in a similar manner as in steps S165 to S170 in FIG. 21 in the controlled-by-server combined mode. If the user inputs evaluation indicating whether or not a notification of the presented event is unnecessary, the notification-unnecessary event table is updated based on the input evaluation, and the evaluation is stored in relationship to the event information stored in step S460.

In step S467, the event notification controller 73 determines whether an event is being presented. If it is determined that an event is being presented, the process proceeds to step S468. However, if it is determined that no event is being presented, the process proceeds to step S469 without performing step S468.

In step S470, as in step S173 in FIG. 21 in the controlled-by-server combined mode, the event presentation controller 74 stops the operation of presenting the event.

In step S469, the event notification controller 73 turns off the notification-necessary event occurrence flag.

In step S470, the transmitter 71 transmits the notification-unnecessary event table stored in the event classification information storage unit 80 to the multi-sensor cameras 1-1 and 1-2. Thereafter, the process proceeds to step S26 in FIG. 15. The notification-unnecessary event table transmitted in step S470 is received by the multi-sensor cameras 1-1 and 1-2 in step S4 of FIG. 14.

As described above, if an end-of-event notification is received from the multi-sensor camera 1-1 or 1-2, event information is stored and the presentation of the event is ended.

As described above, in the sequence of processing steps performed by the monitoring system 21 in the controlled-by-camera combined mode, the detection states of the multi-sensor cameras 1-1 and 1-2 are notified to each other, and a determination as to whether or not a detected event should be notified to a user is made on the basis of combined state history data produced by combining the states. If the event is determined as needing to be notified to the user, presentation of the event is performed.

In the controlled-by-camera single mode, the monitoring operation (the monitoring operation by the multi-sensor camera in step S9 of FIG. 14 and the monitoring operation by the server in step S25 of FIG. 15) is performed by the monitoring system 21 as is described below with reference to FIGS. 56 to 59. In the following description, it is assumed that an event occurs in a similar manner as described earlier with reference to FIGS. 4 to 7. It is also assumed that the event is determined by the multi-sensor camera 1-1 as not needing to be notified to a user, but the event is determined by the multi-sensor camera 1-2 as needing to be notified.

In the controlled-by-camera single mode, if an event occurs as shown in FIG. 4, the monitoring operation is performed by the monitoring system 21 as described below. In FIG. 4, as described earlier, the person 41 enters the monitored region 11-1 at time T=t, and thus an event occurs in the region monitored by the monitoring system 21.

Figure 56:
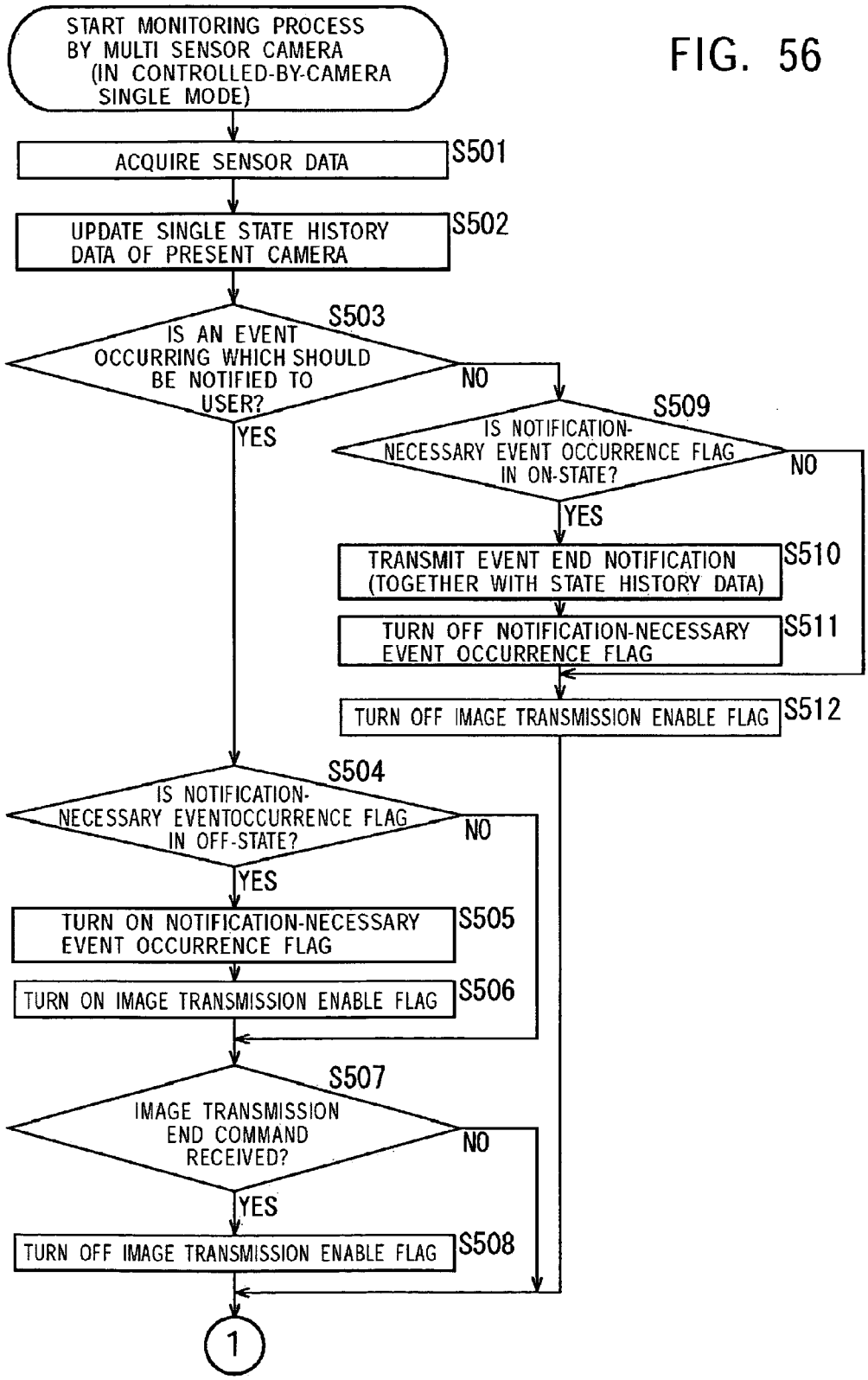
FIG. 56 is a flow chart showing a monitoring process by a multi-sensor camera in step S9 in FIG. 14.
Figure 57:
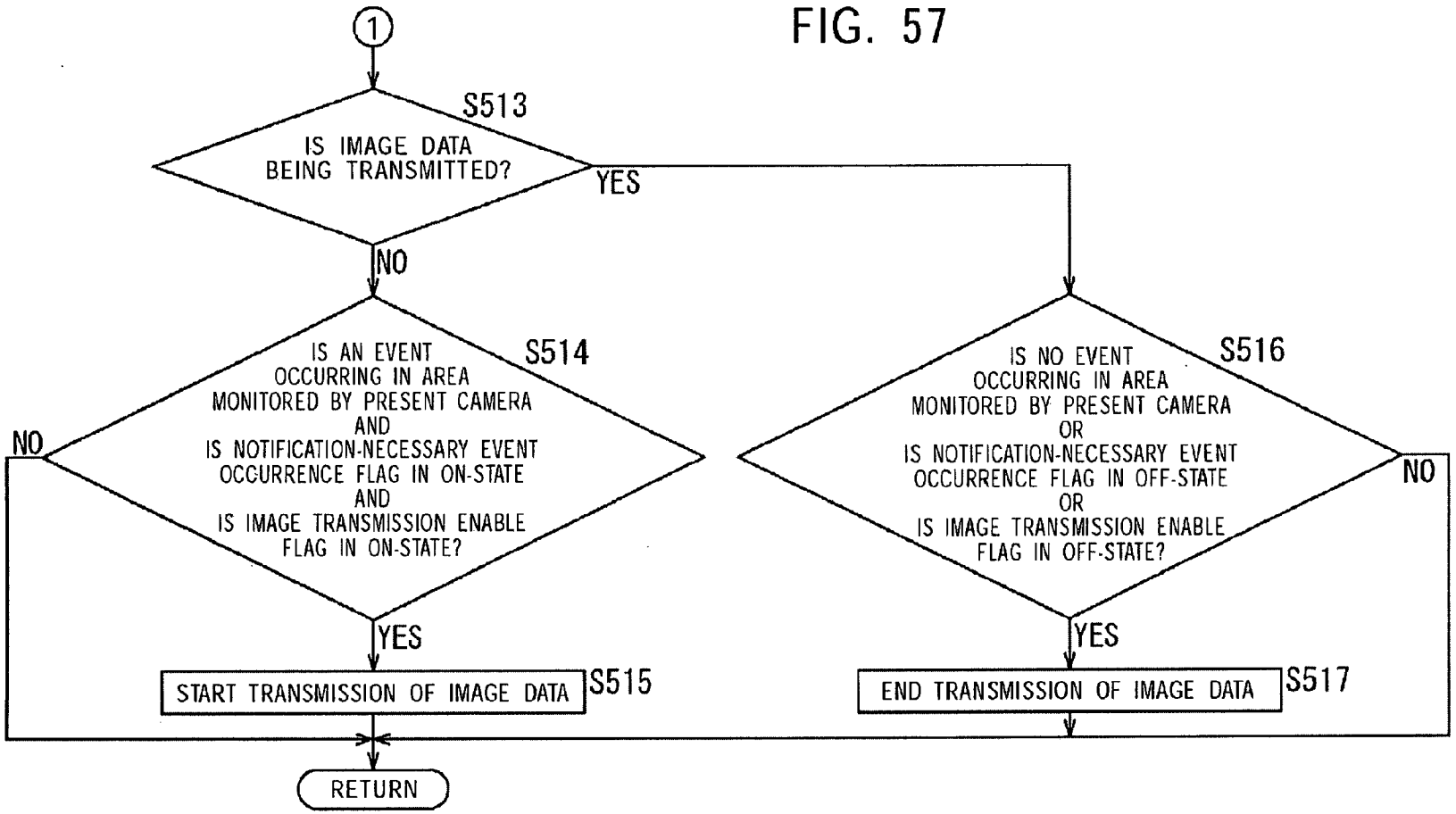
FIG. 57 is a flow chart showing a monitoring process by a multi-sensor camera in step S9 in FIG. 14.

The monitoring operation performed in this situation by the multi-sensor camera 1-1 in the controlled-by-camera single mode (monitoring operation by multi-sensor camera in step S9 in FIG. 14) is described below with reference to FIGS. 56 and 57. At the beginning of the process, the notification-necessary event occurrence flag and the image transmission enable flag are both in the off-state.

Figure 16:
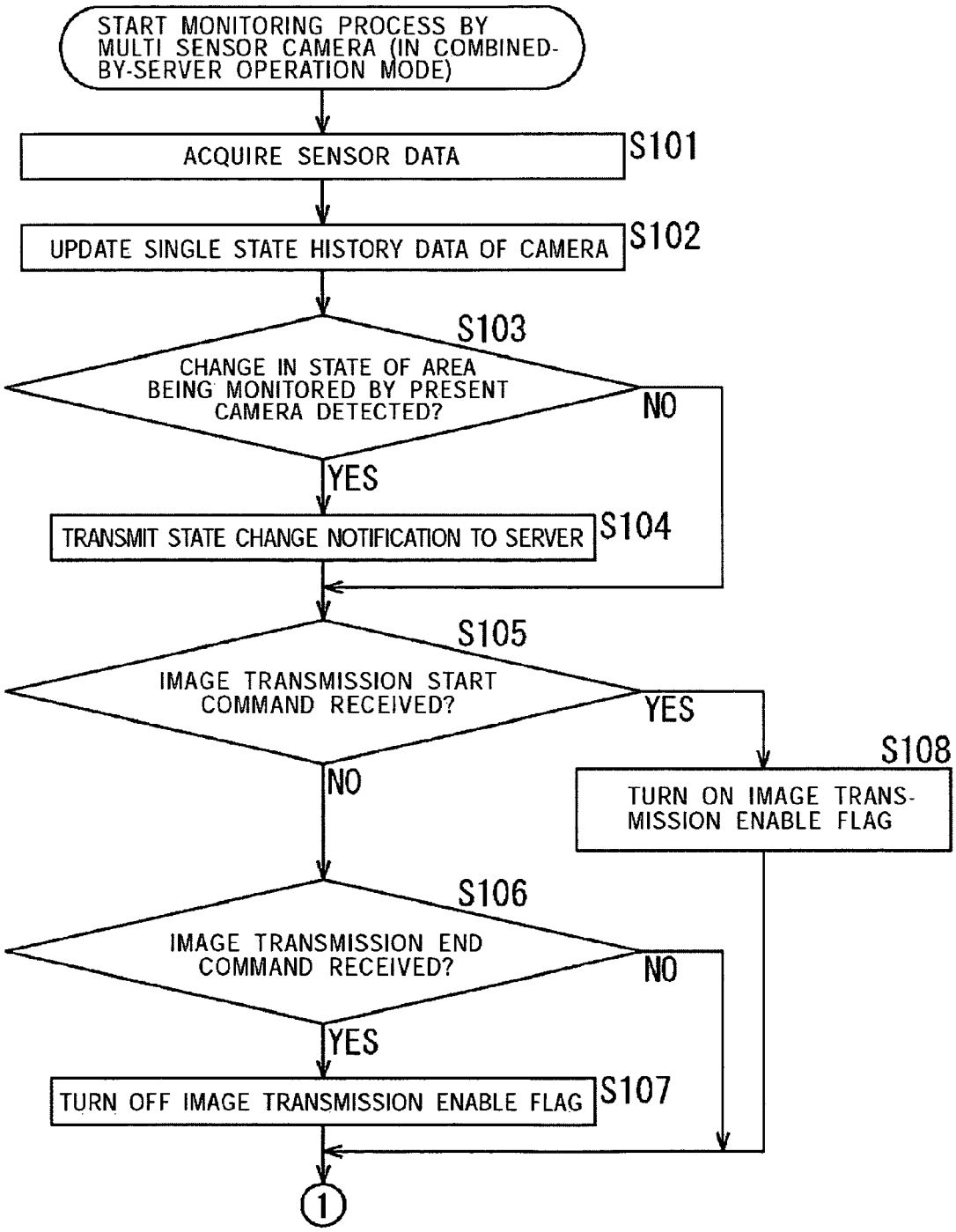
FIG. 16 is a flow chart showing a monitoring process performed by a multi-sensor camera in step S7 in FIG. 14.
Figure 17:
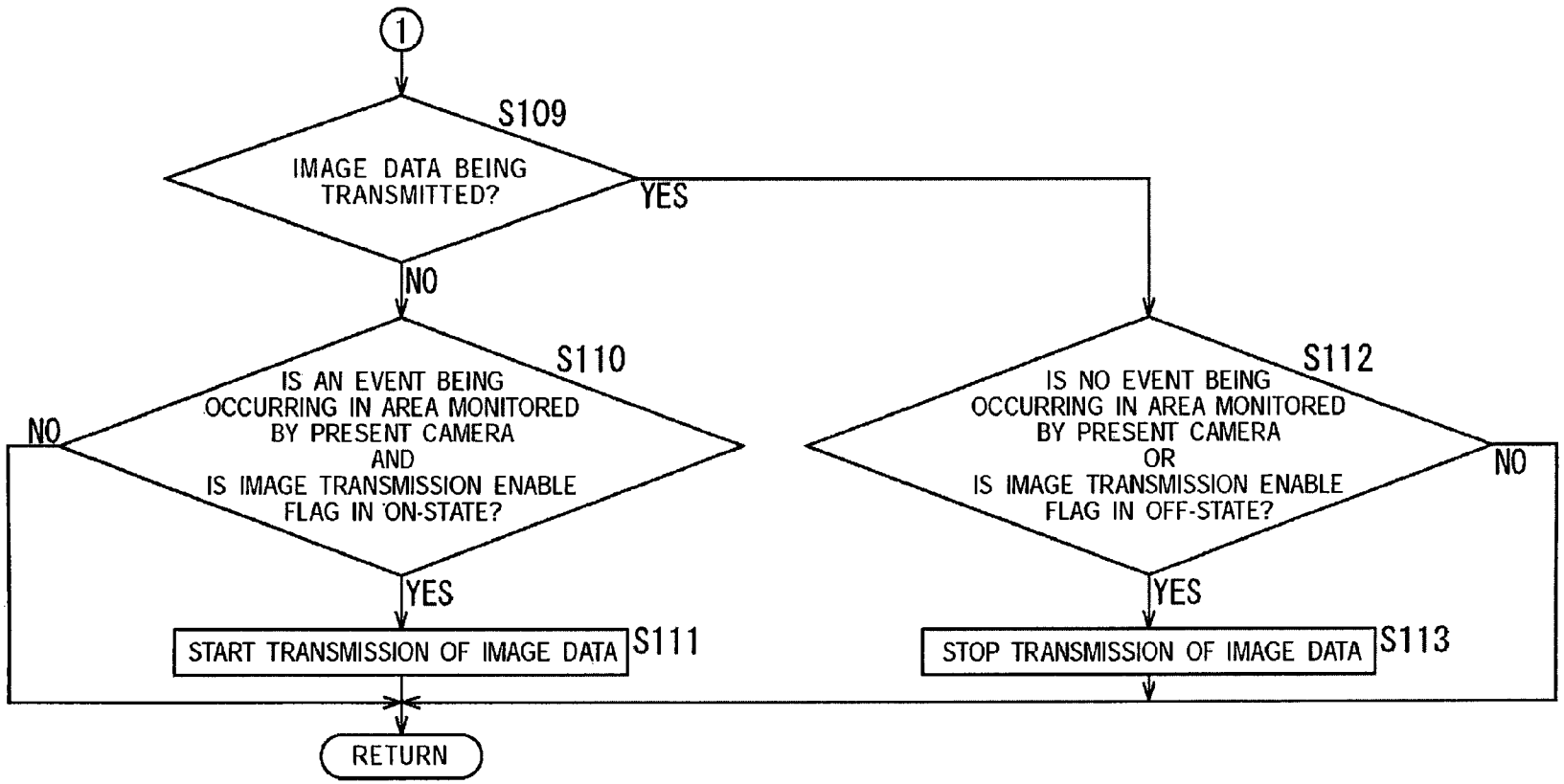
FIG. 17 is a flow chart showing a monitoring process performed by a multi-sensor camera in step S7 in FIG. 14.

In step S501, as in steps S101 and S102 in FIG. 16 in the controlled-by-server combined mode, the state detector 52 acquires sensor data from the photosensor 51. In step S502, the single state history data associated with the present camera (multi-sensor camera 1-1) is updated on the basis of the sensor data acquired in step S501. FIG. 18 shows the resultant updated single state history data associated with the multi-sensor camera 1-1.

In step S503, the event notification controller 53 determines whether an event is occurring which should be notified to the user. More specifically, the event notification decision described earlier with reference to FIG. 13 is made to determine whether the event currently occurring is an event that should be notified to the user, on the basis of the single state history data (FIG. 18) and the notification-unnecessary event table. In this specific case, it is determined that there is no event which should be notified to the user, and thus the process proceeds to step S509.

In step S509, the event notification controller 53 determines whether the notification-necessary event occurrence flag is in the on-state. In this specific case, it is determined that the notification-necessary event occurrence flag is in the off-state, and thus the process proceeds to step S512 without performing steps S510 and S511.

In step S512, the event notification controller 53 turns off the image transmission enable flag.

In step S513, the event notification controller 53 determines whether image data is being transmitted to the server 31. In this specific case, it is determined that no image data is being transmitted, and thus the process proceeds to step S514.

In step S514, the event notification controller 53 determines whether (i) an event is occurring in the region 11-1 monitored by the present camera (multi-sensor camera 1-1), (ii) the notification-necessary event occurrence flag is in the on-state, and (iii) the image transmission enable flag is in the on-state. In this specific case, although an event is occurring in the region 11-1 monitored by the present camera, both the notification-necessary event occurrence flag and the image transmission enable flag are in the off-state, and thus the process proceeds to step S10 in FIG. 14 without performing step S515.

As described above, the multi-sensor camera 1-1 makes the event notification decision on the basis of the single state history data. If it is determined in this event notification decision that no event is occurring which should be notified to the user, no image data is transmitted to the server 31.

Now, the monitoring operation performed by the multi-sensor camera 1-2 in the controlled-by-camera single mode (monitoring operation by multi-sensor camera in step S9 in FIG. 14) is described. At the beginning of the process, the notification-necessary event occurrence flag and the image transmission enable flag are both in the off-state.

In step S501, the state detector 52 acquires sensor data from the photosensor 51. In step S502, the state detector 52 updates the single state history data of the present camera (multi-sensor camera 1-2). FIG. 19 shows the resultant updated single state history data associated with the multi-sensor camera 1-2.

At the point of time shown in FIG. 4, no event occurs yet in the region 11-2 monitored by the multi-sensor camera 1-2, and thus, in step S503, it is determined that there is no event whose occurrence should be notified to a user. In this case, the process proceeds to step S509.

Figure 14:
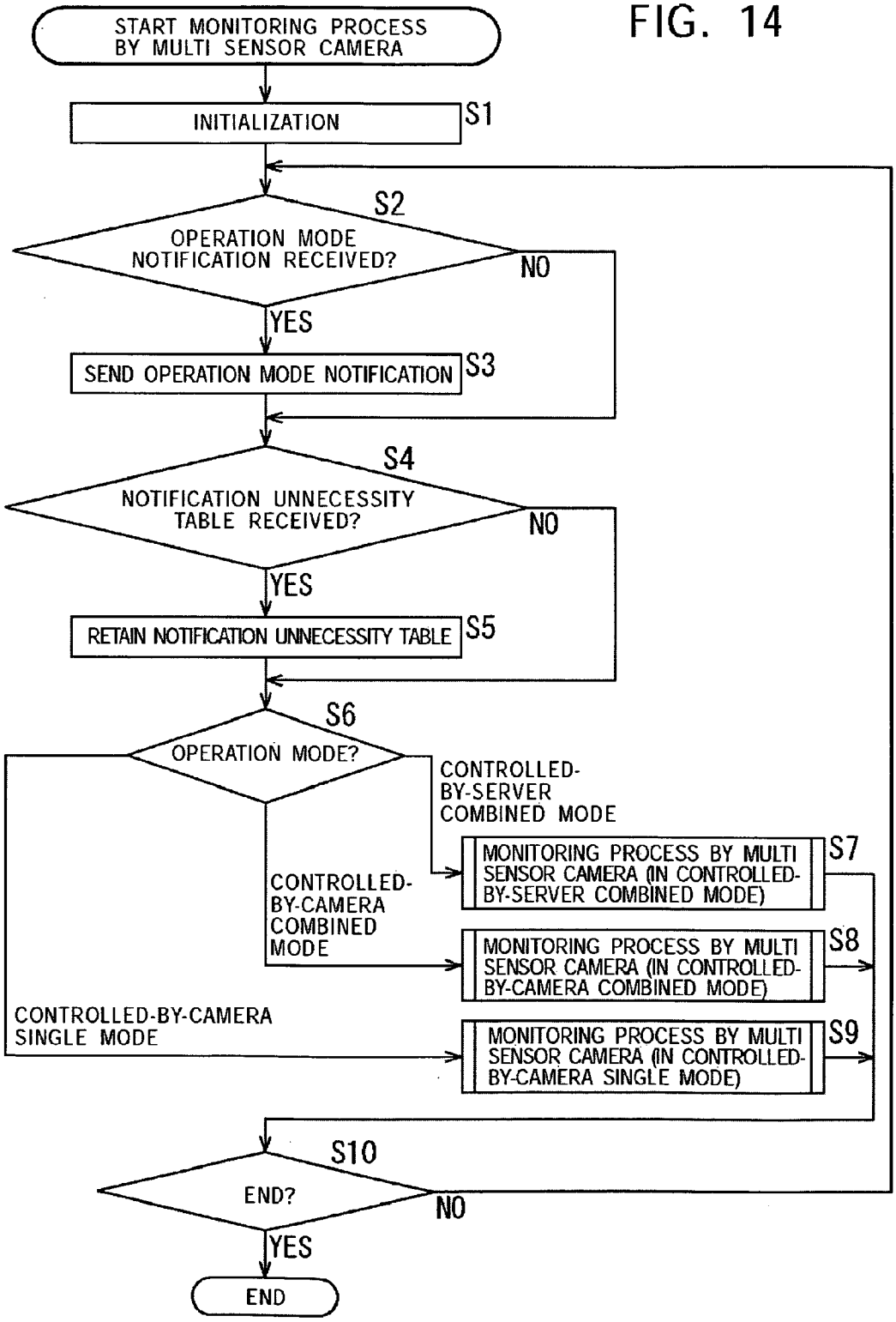
FIG. 14 is a flow chart showing a process performed by the multi-sensor cameras shown in FIG. 3A.

Steps S509 to S514 are performed in a similar manner as in the case of the multi-sensor camera 1-1, and thus the process proceeds to step S10 in FIG. 14.

As described above, the multi-sensor camera 1-2 also makes the event notification decision on the basis of the single state history data.

Figure 58:
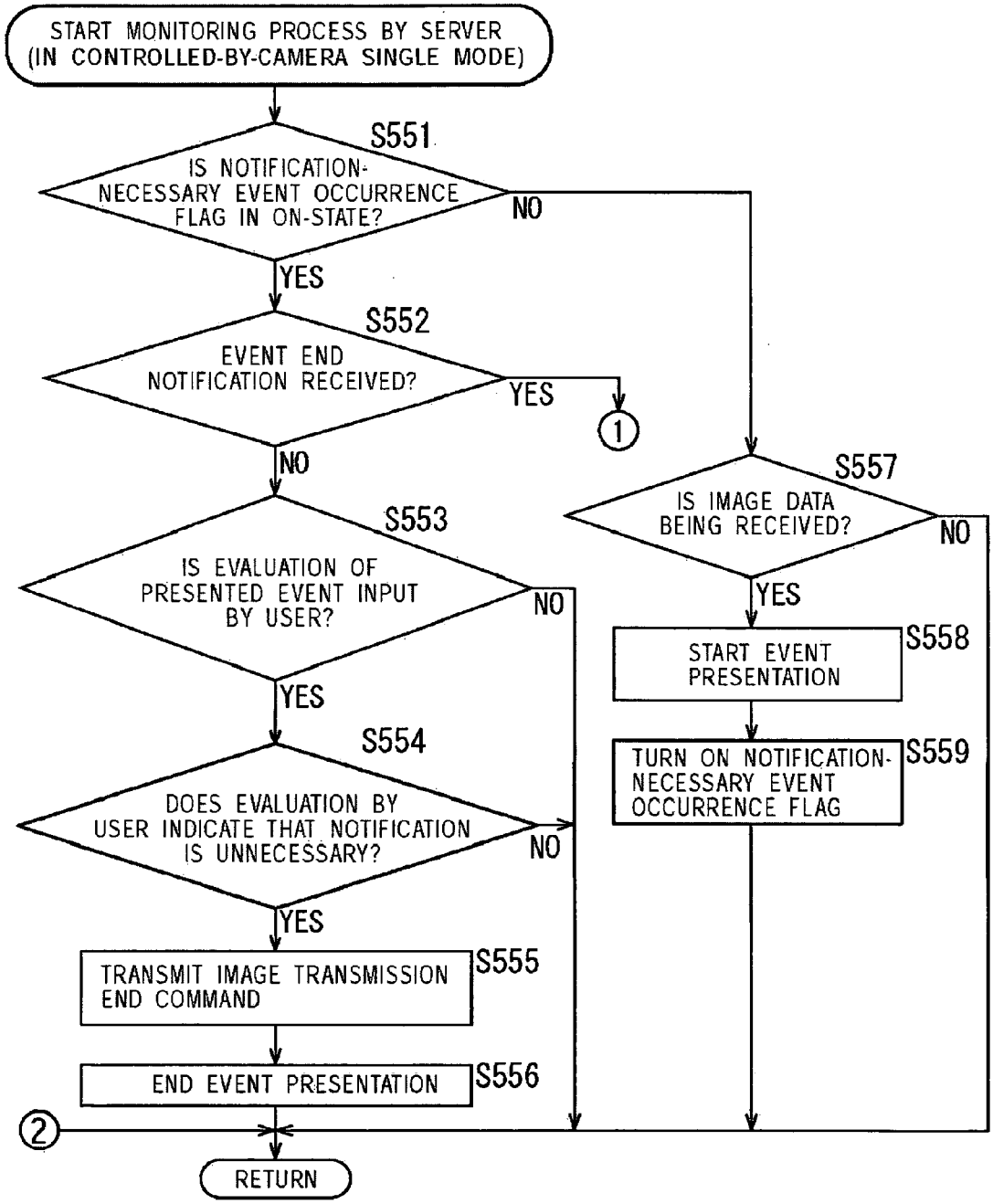
FIG. 58 is a flow chart showing a monitoring process performed by a server in step S25 in FIG. 15.
Figure 59:
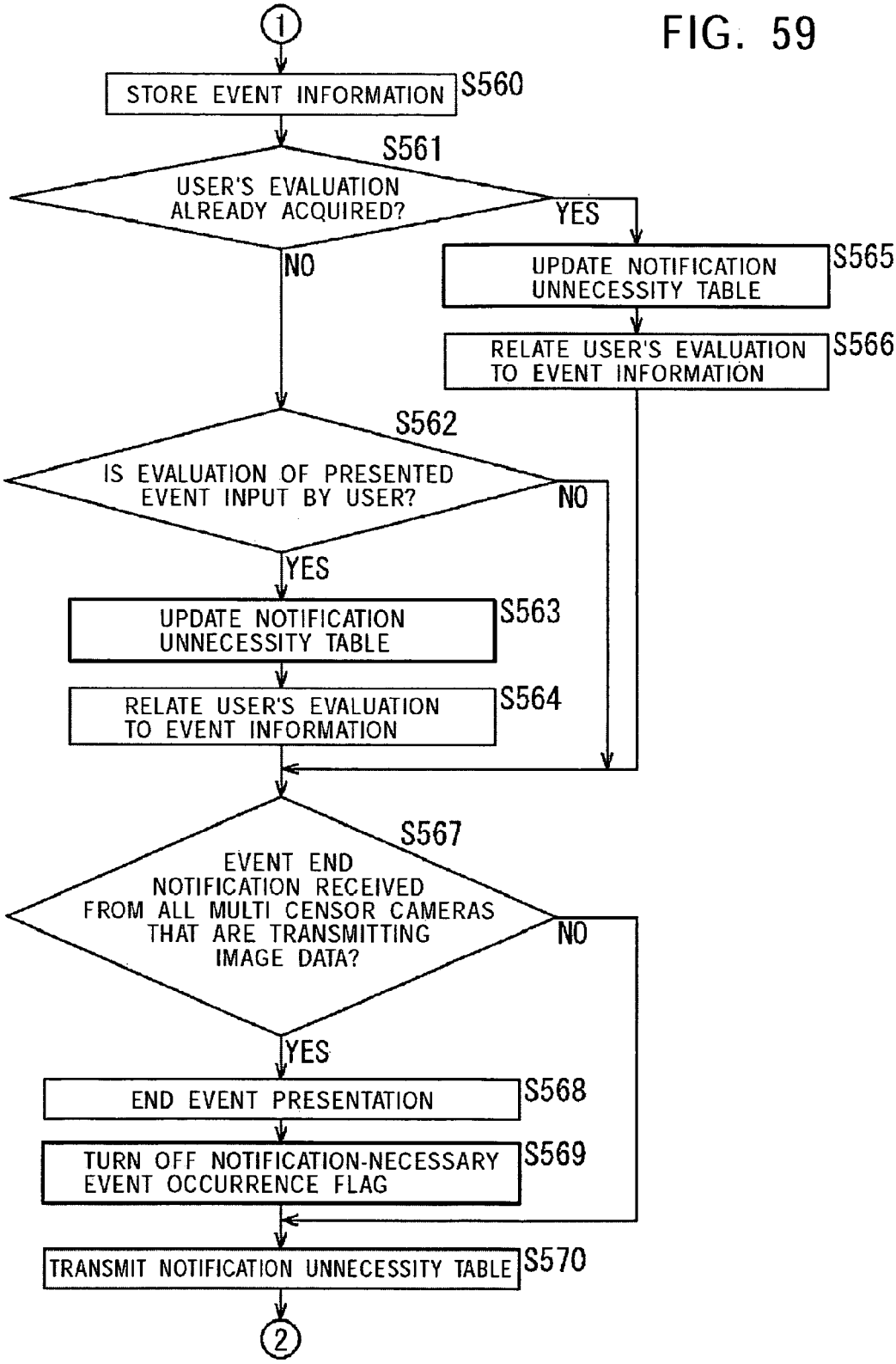
FIG. 59 is a flow chart showing a monitoring process performed by a server in step S25 in FIG. 15.

In the controlled-by-camera single mode, corresponding to the operation performed by the multi-sensor cameras 1-1 and 1-2 according to the flow chart shown in FIGS. 56 and 57, the monitoring operation (monitoring operation by server in step S25 in FIG. 15) is performed by the server 31 as described below with reference to FIGS. 58 and 59. At the beginning of the process, the notification-necessary event occurrence flag is in the off-state.

In step S551, the event notification controller 73 determines whether the notification-necessary event occurrence flag is in the on-state. In this specific case, it is determined that the notification-necessary event occurrence flag is in the off-state, and thus the process proceeds to step S557.

In step S557, the receiver 72 determines whether image data is being received from the multi-sensor cameras 1-1 and 1-2. In this specific case, no image data is being transmitted from the multi-sensor camera 1-1 or 1-2, and thus it is determined that no image data is being received. Thus, the process proceeds to step S26 in FIG. 15 without performing steps S558 and S559.

In this case, no particular processing is performed until image data is received.

In the controlled-by-camera single mode, if the state of the event changes into the state shown in FIG. 5, the monitoring operation is performed by the monitoring system 21 as described below. In the state shown in FIG. 5, as described earlier, the person 41 enters the monitored region 11-3 m sec after the state shown in FIG. 4, that is, at a time T=t+m.

First, the monitoring operation performed by the multi-sensor camera 1-1 (monitoring operation by multi-sensor camera in step S9 in FIG. 14) is described.

In step S501, the state detector 52 acquires sensor data from the photosensor 51. In step S502, the state detector 52 updates the single state history data of the present camera (multi-sensor camera 1-1). FIG. 24 shows the resultant updated single state history data associated with the multi-sensor camera 1-1.

In step S503, the event notification decision described earlier with reference to FIG. 13 is made on the basis of the single state history data (FIG. 24) and the notification-unnecessary event table. In this specific case, it is determined that there is no event whose occurrence should be notified to a user. In this case, the process proceeds to step S509.

Steps S509 to S514 are performed in a similar manner as in the case in which the event occurs as shown in FIG. 4. That is, the image transmission enable flag is turned off, and the process proceeds to step S10 in FIG. 14.

That is, in the case in which it is determined that no event is occurring that should be notified to a user, as is in the present situation, no particular processing is performed regardless of whether or not some event is detected by the multi-sensor camera 1-2.

Now, the monitoring operation performed by the multi-sensor camera 1-2 (monitoring operation by multi-sensor camera in step S9 in FIG. 14) is described.

In step S501, the state detector 52 acquires sensor data from the photosensor 51. In step S502, the state detector 52 updates the single state history data of the present camera (multi-sensor camera 1-2). FIG. 25 shows the resultant updated single state history data associated with the multi-sensor camera 1-2.

In step S503, the event notification decision described earlier with reference to FIG. 13 is made on the basis of the single state history data (FIG. 25) and the notification-unnecessary event table. In this specific case, it is determined that an event is occurring which should be notified to the user, and thus the process proceeds to step S504.

In step S504, the event notification controller 53 determines whether the notification-necessary event occurrence flag is in off-state. In this specific case, it is determined that the notification-necessary event occurrence flag is in the off-state, and thus the process proceeds to step S505.

In step S505, the event notification controller 53 turns on the notification-necessary event occurrence flag.

In step S506, the event notification controller 53 turns on the image transmission enable flag.

In step S507, the receiver 56 determines whether an image transmission end command has been received from the server 31. Note that the image transmission end command is transmitted in step S555 of FIG. 58 when the server 31 determines in step S554 (described later) of FIG. 58 that the event being presented to a user is evaluated by the user as not needing to be notified. In this specific case, no event is yet presented to the user, and thus the image transmission end command is not transmitted from the server 31. Thus, it is determined that the image transmission end command has not been received, and the process proceeds to step S513 without performing step S508.

In step S513, the event notification controller 53 determines whether image data is being transmitted to the server 31. In this specific case, it is determined that no image data is being transmitted, and thus the process proceeds to step S514.

In step S514, the event notification controller 53 determines whether (i) an event is occurring in the region 11-2 monitored by the present camera (multi-sensor camera 1-2), (ii) the notification-necessary event occurrence flag is in the on-state, and (iii) the image transmission enable flag is in the on-state. In this specific case, an event is occurring in the region 11-2 monitored by the present camera and both the notification-necessary event occurrence flag and the image transmission enable flag are in the on-state, and thus the process proceeds to step S515.

In step S515, as in step S111 (FIG. 17) in the controlled-by-server combined mode, the event notification controller 53 turns on the power of the camera 54. In response, transmission of image data taken by the camera 54 to the server 31 via the transmitter 55 is started. Thereafter, the process proceeds to step S10 in FIG. 14.

As described above, if the multi-sensor camera 1-2 determines that the event should be notified to the user, transmission of image data to the server 31 is started.

Now, the operation performed by the server 31 (monitoring operation by server in step S25 in FIG. 15) is described.

In step S551, in this specicfic example, it is determined that the notification-necessary event occurrence flag is in the off-state, and thus the process proceeds to step S557.

In step S557, the receiver 72 determines whether image data is being received from the multi-sensor cameras 1-1 and 1-2. As described above, transmission of image data from the multi-sensor camera 1-2 has already been started in step S515 in FIG. 57, and the server 31 is receiving the image data. Thus it is determined that image data is being received, and the process proceeds to step S558.

In step S558, the receiver 72 starts transferring of the image data received from the multi-sensor camera 1-2 to the event presentation controller 74. The event presentation controller 74 produces data to be presented to the user on the basis of the acquired image data and outputs the produced data to the presentation unit 32 shown in FIG. 3A. In response, the presentation unit 32 presents the event.

In step S559, the event notification controller 73 turns on the notification-necessary event occurrence flag. Thereafter, the process proceeds to step S26 in FIG. 15.

As described above, when transmission of image data from the multi-sensor camera 1-2 is started, the server 31 starts presentation of the event.

In the controlled-by-camera single mode, if the state of the event changes into the state shown in FIG. 6, the monitoring operation is performed by the monitoring system 21 as described below. In the state shown in FIG. 6, as described earlier, the person 41 goes out of the monitored regions 11-1 and enters the monitored region 11-2 at T=t+m+n, that is, n sec after the state shown in FIG. 5.

First, the monitoring operation performed by the multi-sensor camera 1-1 (monitoring operation by multi-sensor camera in step S9 in FIG. 14) is described.

In step S501, the state detector 52 acquires sensor data from the photosensor 51. In step S502, the state detector 52 updates the single state history data of the present camera (multi-sensor camera 1-1). FIG. 27 shows the resultant updated single state history data associated with the multi-sensor camera 1-1.

At the point of time shown in FIG. 6, no event occurs yet in the region 11-1 monitored by the multi-sensor camera 1-1, and thus, in step S503, it is determined that there is no event whose occurrence should be notified to a user. In this case, the process proceeds to step S509.

Steps S509 to S514 are performed in a similar manner as in the case in which the event occurs as shown in FIG. 4. That is, the image transmission enable flag is turned off, and the process proceeds to step S10 in FIG. 14.

That is, in the case in which it is determined that no event is occurring that should be notified to a user, as is in the present situation, no particular processing is performed regardless of whether or not an event is detected by the multi-sensor camera 1-2.

Now, the monitoring operation performed by the multi-sensor camera 1-2 (monitoring operation by multi-sensor camera in step S9 in FIG. 14) is described.

In step S501, the state detector 52 acquires sensor data from the photosensor 51. In step S502, the state detector 52 updates the single state history data of the present camera (multi-sensor camera 1-2). FIG. 28 shows the resultant updated single state history data associated with the multi-sensor camera 1-2.

In step S503, in this specific case, it is determined that an event is occurring which should be notified to the user, and thus the process proceeds to step S504.

In step S504, in this specific case, it is determined that the notification-necessary event occurrence flag is in the on-state, and thus the process proceeds to step S507 without performing steps S505 and S506.

In step S507, the receiver 56 determines whether an image transmission end command has been received from the server 31. If it is determined that the image transmission end command has been received, the process proceeds to step S508. In step S508, the event notification controller 53 turns off the image transmission enable flag. On the other hand, if it is determined that the image transmission end command is not received, the process proceeds to step S513 without performing step S508. In the following description, it is assumed that it is determined in step S507 that the image transmission end command is not received.

In step S513, in this specific case, it is determined that image data is being transmitted to the server 31, and thus the process proceeds to step S516.

In step S516, the event notification controller 53 determines whether (i) no event is occurring in the region 11-2 monitored by the present camera (multi-sensor camera 1-2), (ii) the notification-necessary event occurrence flag is in the off-state, or (iii) the image transmission enable flag is in the off-state. In this specific case, an event is occurring in the region 11-2 monitored by the present camera and both the notification-necessary event occurrence flag and the image transmission enable flag are in the on-state, and thus the process proceeds to step S10 in FIG. 14 without performing step S517.

Because the event is still occurring in the region 11-2 monitored by the multi-sensor camera 1-2, transmission of image data to the server 31 is continued without being stopped.

Now, the operation performed by the server 31 (monitoring operation by server in step S25 in FIG. 15) is described.

In step S551, in this specic example, it is determined that the notification-necessary event occurrence flag is in the on-state, and thus the process proceeds to step S552.

In step S552, the receiver 72 determines whether an end-of-event notification has been received from the multi-sensor cameras 1-1 and 1-2. In this specific case, no end-of-event notification is transmitted by the multi-sensor cameras 1-1 and 1-2, and thus it is determined that no end-of-event notification is received. Thus, the process proceeds to step S553.

Steps S553 to S556 are performed in a similar manner as in steps S155 to S158 in FIG. 20 in the controlled-by-server combined mode. That is, in step S553, the user inputs evaluation indicating whether a notification of the presented event is unnecessary. If it is determined in step S554 that the evaluation by the user indicates that notification is not necessary, then, in step S555, an image transmission end command is transmitted to the multi-sensor cameras 1-1 and 1-2. In response, in step S556, the event presentation is ended.

In the following description, it is assumed that it is determined in step S553 that user's evaluation indicating whether or not a notification is necessary is not acquired. If it is determined in step S553 that evaluation indicating whether or not a notification is necessary is not input by a user, the process proceeds to step S26 in FIG. 15.

If an end-of-event notification is not transmitted from the multi-sensor cameras 1-1 and 1-2 and an evaluation indicating that a notification is unnecessary is not input by a user, the presentation of the event is continued without being stopped.

In the controlled-by-camera combined mode, if the state of the event changes into the state shown in FIG. 7, the monitoring operation is performed by the monitoring system 21 as described below. In the state shown in FIG. 7, as described earlier, the person 41 goes out of the region covered by the monitoring system 21 and thus the event is over at T=t+m+n+p, that is, p sec after the state shown in FIG. 6.

First, the monitoring operation performed by the multi-sensor camera 1-1 (monitoring operation by multi-sensor camera in step S9 in FIG. 14) is described.

In step S501, the state detector 52 acquires sensor data from the photosensor 51. In step S502, the state detector 52 updates the single state history data of the present camera (multi-sensor camera 1-1). FIG. 30 shows the resultant updated single state history data associated with the multi-sensor camera 1-1.

At the point of time shown in FIG. 7, no event occurs yet in the region 11-1 monitored by the multi-sensor camera 1-1, and thus, in step S503, it is determined that there is no event whose occurrence should be notified to a user. In this case, the process proceeds to step S509.

Steps S509 to S514 are performed in a similar manner as in the case in which the event occurs as shown in FIG. 4. That is, the image transmission enable flag is turned off, and the process proceeds to step S10 in FIG. 14.

That is, in the case in which it is determined that no event is occurring that should be notified to a user, as is in the present situation, no particular processing is performed regardless of whether or not an event is detected by the multi-sensor camera 1-2.

Now, the monitoring operation performed by the multi-sensor camera 1-2 (monitoring operation by multi-sensor camera in step S9 in FIG. 14) is described.

In step S501, the state detector 52 acquires sensor data from the photosensor 51. In step S502, the state detector 52 updates the single state history data of the present camera (multi-sensor camera 1-2). FIG. 31 shows the resultant updated single state history data associated with the multi-sensor camera 1-2.

At the point of time shown in FIG. 7, the event in the region 11-2 monitored by the multi-sensor camera 1-2 is over, and thus, in step S503, it is determined that there is no event whose occurrence should be notified to a user. In this case, the process proceeds to step S509.

In step S509, the event notification controller 53 determines whether the notification-necessary event occurrence flag is in the on-state. In this specific case, it is determined that the notification-necessary event occurrence flag is in the on-state, and thus the process proceeds to step S510.

In step S510, the event notification controller 53 transmits an end-of-event notification to the server 31 via the transmitter 55. Note that the end-of-event notification includes single state history data of the multi-sensor camera 1-2 shown in FIG. 31.

In step S511, the event notification controller 53 turns off the notification-necessary event occurrence flag.

In step S512, the event notification controller 53 turns off the image transmission enable flag.

In step S513, in this specific case, it is determined that image data is being transmitted to the server 31, and thus the process proceeds to step S516.

In step S516, the event notification controller 53 determines whether (i) no event is occurring in the region 11-2 monitored by the present camera (multi-sensor camera 1-2), (ii) the notification-necessary event occurrence flag is in the off-state, or (iii) the image transmission enable flag is in the off-state. In this specific case, no event is occurring in the region 11-2 monitored by the present camera and both the notification-necessary event occurrence flag and the image transmission enable flag are in the off-state, and thus the process proceeds to step S517.

In step S517, the event notification controller 53 turns off the power of the camera 54 thereby stopping transmission of image data to the server 31. Thereafter, the process proceeds to step S10 in FIG. 14.

As described above, when the event whose image data is being transmitted is over, an end-of-event notification is transmitted to the server 31 and transmission of image data to the server 31 is stopped.

Now, the operation performed by the server 31 (monitoring operation by server in step S25 in FIG. 15) is described.

In step S551, in this specic example, it is determined that the notification-necessary event occurrence flag is in the on-state, and thus the process proceeds to step S552.

In step S552, the receiver 72 determines whether an end-of-event notification has been received from the multi-sensor camera 1-1 or 1-2. In this specific case, the end-of-event notification transmitted from the multi-sensor camera 1-2 in step S510 in FIG. 56 is received, and thus the process proceeds to step S560.

In step S560, the event information recording unit 75 stores event information in the event information storage unit 79 in a similar manner as in step S163 (FIG. 21) in the controlled-by-server combined mode. More specifically, the event information recording unit 75 acquires via the receiver 72 the end-of-event notification received in step S552 and generates the event information on the basis of the state history data of the multi-sensor camera 1-2 included in the end-of-event notification. As in the controlled-by-server combined mode, the event information includes an event number, state history data, an event occurrence time, and a user's evaluation. FIG. 31 shows an example of state history data used in the controlled-by-camera single mode. Note that, in the controlled-by-camera single mode, only single state history data of a multi-sensor camera (the multi-sensor camera 1-2 in this example) is allowed as the state history data.

Steps S561 to S566 are performed in a similar manner as in steps S165 to S170 in FIG. 21 in the controlled-by-server combined mode. If the user inputs evaluation indicating whether or not a notification of the presented event is necessary, the notification-unnecessary event table is updated based on the input evaluation, and the evaluation is stored in relationship to the event information stored in step S560.

In step S567, the event notification controller 73 determines whether an end-of-event notification has been received from all multi-sensor cameras from which image data was being received (that is, whether the event determined as needing to be notified to the user is over in all regions monitored by the multi-sensor cameras). If it is determined that the end-of-event notification has been received from all multi-sensor cameras that are transmitting image data, the process proceeds to step S568. If it is determined that an end-of-event notification has not yet been received from at least one of multi-sensor cameras from which image data is being received (that is, the event determined as needing to be notified to the user is still in progress at least in one of regions monitored by the multi-sensor cameras), the process proceeds to step S570 without performing steps S568 and S569 that are steps for stopping the presentation of the event. In this specific case, it is determined in step S552 that an end-of-event notification has been received from the multi-sensor camera 1-2 that was transmitting image data, and the multi-sensor camera 1-1 is not transmitting image data, and thus it is determined that the end-of-event notification has been received from all multi-sensor cameras that were transmitting image data. Thus, the process proceeds to step S568.

In step S568, as in step S173 in FIG. 21 in the controlled-by-server combined mode, the event presentation controller 74 stops the operation of presenting the event.

In step S569, the event notification controller 73 turns off the notification-necessary event occurrence flag.

In step S570, the transmitter 71 transmits the notification-unnecessary event table stored in the event classification information storage unit 80 to the multi-sensor cameras 1-1 and 1-2. Thereafter, the process proceeds to step S26 in FIG. 15. The notification-unnecessary event table transmitted in step S570 is received by the multi-sensor cameras 1-1 and 1-2 in step S4 in FIG. 14.

As described above, if an end-of-event notification is received from the multi-sensor camera 1-2, event information is stored. If an end-of-event notification is been received from all multi-sensor cameras which are transmitting image data, the presentation of the event is ended.

As described above, in the sequence of processing steps performed by the monitoring system 21 in the controlled-by-camera single mode, it is determined whether an event detected independently by the multi-sensor cameras 1-1 and/or 1-2 should be notified to a user. If the event is determined as an event that should be notified to the user, the event is presented to the user.

The configuration of the monitoring system 21 described above is one of many examples, and the monitoring system 21 can be configured in various manners. Some examples are described below.

The sensor is not limited to the single photosensor, but another type of sensor such as a CCD imaging device, a CMOS imaging device, a microphone, a microwave sensor, or an infrared sensor may also be used. The manner of classifying a detected event is not limited to that described above.

A plurality of sensors or a combination of a plurality of sensors may also be used.

Communication among the server 31 and the multi-sensor cameras 1-1 and 1-2 is not limited to wireless communication but wired communication may also be employed.

The number of presentation unit 32 is not limited to one, but a plurality of presentation units may be used.

The server 31 does not necessarily need to be disposed separately from the presentation unit 32, but the server 31 and the presentation unit 32 may be integrated together.

The sequence of processing steps described above may be performed by means of hardware or software. When the sequence of processing steps is executed by software, a program forming the software may be installed from a storage medium or the like onto a computer which is provided as dedicated hardware or may be installed onto a general-purpose computer capable of performing various processes based on various programs installed thereon. For example, a personal computer 500 shown in FIG. 60 may be used to execute the sequence of processing steps.

Figure 60:
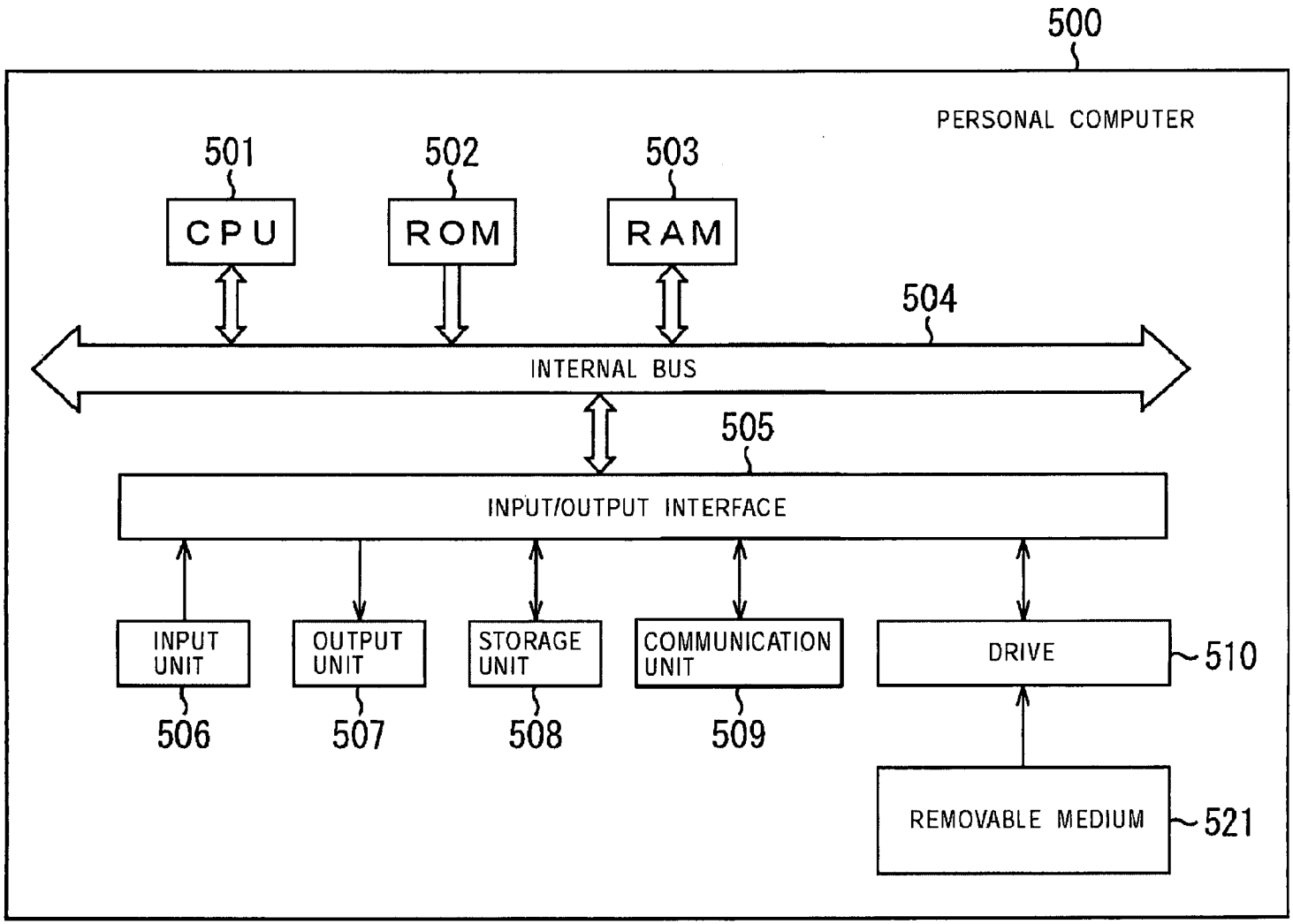
FIG. 60 is a block diagram of a personal computer.

In the example shown in FIG. 60, a CPU (Central Processing Unit) 501 executes various processes based on a program stored in a ROM (Read Only Memory) 502 or a program loaded from a storage unit 508 into a RAM (Random Access Memory) 503. The RAM 503 is also used to store data used by the CPU 501 in the execution of various processes.

The CPU 501, the ROM 502, and the RAM 503 are connected with each other via an internal bus 504. The internal bus 504 is also connected to an input/output interface 505.

The input/output interface 505 is connected to an input unit 506 including a keyboard and a mouse, an output unit 507 including a display such as a CRT (Cathode Ray Tube) or an LCD (Liquid Crystal Display) and a loudspeaker, a storage unit 508 such as a hard disk, and a communication unit 509 such as a modem or a terminal adapter. The communication unit 509 is responsible for communication via a network such as telephone line or a CATV.

Furthermore, the input/output interface 505 is also connected with a drive 510, as required. A removable storage medium 521 such as a magnetic disk, an optical disk, a magnetooptical disk, or a semiconductor memory is mounted on the drive 510 as required, and a computer program is read from the removable storage medium 521 and installed into the storage unit 508, as required.

When the processing sequence is executed by software, a program forming the software may be installed from a storage medium or via a network onto a computer which is provided as dedicated hardware or may be installed onto a general-purpose computer capable of performing various processes based on various programs installed thereon.

A specific example of storage medium usable for the above purpose is, as shown in FIG. 60, a removable storage medium (package medium) 521 on which a program is stored and which is supplied to a user separately from a computer. The program may also be supplied to a user by preinstalling it on a built-in ROM 502 or a storage unit 508 such as a hard disk disposed in a computer.

As described above, the present invention is capable of notifying of an occurrence of an event and presenting the event. In particular, information of an event that really needs to be notified and/or presented to a user is notified and/or presented. This makes it possible to provide necessary and sufficient information to a user with minimized power.

In the present description, the steps described in the program may be performed either in time sequence based on the order described in the program or in a parallel or separate fashion.

Note that the term "system" is used in the present description to represent a total construction including a plurality of apparatuses, devices, means, and/or the like.

Note that the term "property" used in the present description can be replaced with the term "characteristics".

What is claimed is:

1. A monitoring system comprising:

a first sensor for outputting first data based on monitoring of a region monitored by the first sensor;

a second sensor for outputting first data based on monitoring of a region monitored by the second sensor;

a third sensor for outputting first data based on monitoring of a region monitored by the third sensor;

a fourth sensor for outputting first data based on monitoring of a region monitored by the fourth sensor;

a first event detector for detecting, on the basis of the first data output from the first sensor, an occurrence and an property of a first event in response to a change in state of the region being monitored;

a second event detector for detecting, on the basis of the second data output from the second sensor, an occurrence and a property of a second event in response to a change in state of the monitored region;

a notification controller for controlling a notification of the first event and the second event based on data indicating the property of the first event detected by the first event detector and data indicating the property of the second event detected by the second event detector; and a presentation controller for controlling presentation of data such that if the first event and/or the second event are controlled, by the notification controller, to be notified, the third data, relating to the first event, output by the third sensor and/or the fourth data, relating to the second event, output by the fourth sensor are presented.

2. A monitoring system according to claim 1, further comprising an input acquisition unit for acquiring information input by a user.

3. A monitoring system according to claim 2, wherein the input acquisition unit acquires an input of user's evaluation on a presentation provided under the control of the presentation controller;

the monitoring system further comprises an event classification information generator for generating event classification information on the basis of data indicating a property of the first event, data indicating a property of the second event, combined data produced by combining the data indicating the property of the first event and the data indicating the property of the second event, and the input of the user's evaluation acquired by the input acquisition unit; and the notification controller controls the notification of the first event and the second event based on the event classification information.

4. A monitoring system according to claim 3, wherein the input acquisition unit acquires an input of user's evaluation as to whether or not a notification is necessary at least for one of the third data and the fourth data presented under the control of the presentation controller; and the event classification information generator generates event classification information indicating whether or not a notification of an event is necessary, on the basis of not only the data indicating the property of the first event, the data indicating the property of the second event, and the combined data, but also the input of the evaluation as to whether or not the notification is necessary.

5. A monitoring system according to claim 3, further comprising an event classification information storage unit for storing the event classification information generated by the event classification information generator.

6. A monitoring system according to claim 3, further comprising an information recording unit for recording, as event information, at least one of the data indicating the property of the first event, the data indicating the property of the second event, and the combined data, in relationship to the input of user's evaluation acquired by the input acquisition unit.

7. A monitoring system according to claim 6, further comprising a mode selector for selecting a mode in which a notification of an event is controlled, on the basis of the event information recorded by the information recording unit and the event classification information, wherein the notification controller determines, based on the mode selected by the mode selection, which one of the data indicating the property of the first event, the data indicating the property of the first event, and the combined data should be used as data according to which to control the event notification.

8. A monitoring system according to claim 7, wherein the input acquisition unit acquires a command associated with the mode issued by a user; and the mode selector selects a mode based on the command issued by the user and acquired by the input acquisition unit.

9. A monitoring system according to claim 1, wherein the notification controller controls the notification of the first event and the second event based on combined data obtained by combining the data indicating the property of the first event detected by the first event detector and the data indicating the property of the second event detected by the second event detector.

10. A monitoring system according to claim 1, wherein the first sensor and the second sensor each include a photosensor.

11. A monitoring system according to claim 1, wherein the third sensor and the fourth sensor each include a camera.

12. A monitoring system according to claim 1, wherein the first sensor, the second sensor, the third sensor, the fourth sensor, the first event detector, the second event detector, the notification controller, and the presentation controller are disposed separately in a first information processing apparatus, a second information processing apparatus, or a third information processing apparatus.

13. A monitoring system according to claim 12, wherein communication among the first information processing apparatus the second information processing apparatus and the third information processing apparatus is performed by means of wireless communication.

14. A monitoring system according to claim 12, wherein the first information processing apparatus and the second information processing apparatus are driven by a battery.

15. A monitoring system according to claim 7, wherein the event notification controller includes a first notification controller, a second notification controller, and a third notification controller;

the first sensor, the third sensor, the first event detector, and the first notification controller are disposed in the first information processing apparatus;

the second sensor, the fourth sensor, the second event detector, and the second notification controller are disposed in the second information processing apparatus; and the third notification controller, the presentation controller, the input acquisition unit, the event classification information generator, the information recording unit, and the mode selector are disposed in the third information processing apparatus.

16. A monitoring system according to claim 15, wherein communication among the first information processing apparatus the second information processing apparatus and the third information processing apparatus is performed by means of wireless communication.

17. A monitoring system according to claim 15, wherein the first information processing apparatus and the second information processing apparatus are driven by a battery.

18. A monitoring system according to claim 15, wherein at least one notification controller selected, depending on the mode, from the first notification controller, the second notification controller, and the third notification controller controls the notification of the first event and the second event.

19. A monitoring system according to claim 15, wherein the first event detector determines to which one of the first, second, and third notification controllers the data indicating the property of the first event should be transmitted, based on the mode; and the second event detector determines to which one of the first, second, and third notification controllers the data indicating the property of the second event should be transmitted, based on the mode.

20. A monitoring system according to claim 15, wherein the mode selector selects a mode based on the power consumption of the first information processing apparatus and the second information processing apparatus.

21. A monitoring system according to claim 15, wherein the mode selector selects a mode based on the remaining capacity of the battery of the first information processing apparatus and the second information processing apparatus.

22. A method of processing information comprising:

a first event detection step of detecting an occurrence and a property of a first event in response to a change in state of a region being monitored, on the basis of first data output from a first sensor based on monitoring the region monitored by the first sensor;

a second event detection step of detecting an occurrence and a property of a second event in response to a change in state of a region being monitored, on the basis of second data output from a second sensor based on monitoring the region monitored by the second sensor;

a notification control step of controlling a notification of the first event and the second event based on data indicating the property of the first event detected in the first event detection step and data indicating the property of the second event detected in the second event detection step; and a presentation control step of controlling presentation of data such that if, in the notification control step, the first event and/or the second event are controlled to be notified, third data relating to the first event output by a third sensor based on monitoring of a region monitored by the third sensor and/or fourth data relating to the second event output by a fourth sensor based on monitoring of a region monitored by the fourth sensor are presented.

23. A storage medium in which a computer-readable program is stored, the program comprising:

a first event detection step of detecting an occurrence and a property of a first event in response to a change in state of a region being monitored, on the basis of first data output from a first sensor based on monitoring the region monitored by the first sensor;

a second event detection step of detecting an occurrence and a property of a second event in response to a change in state of a region being monitored, on the basis of second data output from a second sensor based on monitoring the region monitored by the second sensor;

a notification control step of controlling a notification of the first event and the second event based on data indicating the property of the first event detected in the first event detection step and data indicating the property of the second event detected in the second event detection step; and a presentation control step of controlling presentation of data such that if, in the notification control step, the first event and/or the second event are controlled to be notified, third data relating to the first event output by a third sensor based on monitoring of a region monitored by the third sensor and/or fourth data relating to the second event output by a fourth sensor based on monitoring of a region monitored by the fourth sensor are presented.

24. A program for causing a computer to execute a process comprising:

a first event detection step of detecting an occurrence and a property of a first event in response to a change in state of a region being monitored, on the basis of first data output from a first sensor based on monitoring the region monitored by the first sensor;

a second event detection step of detecting an occurrence and a property of a second event in response to a change in state of a region being monitored, on the basis of second data output from a second sensor based on monitoring the region monitored by the second sensor;

a notification control step of controlling a notification of the first event and the second event based on data indicating the property of the first event detected in the first event detection step and data indicating the property of the second event detected in the second event detection step; and a presentation control step of controlling presentation of data such that if, in the notification control step, the first event and/or the second event are controlled to be notified, third data relating to the first event output by a third sensor based on monitoring of a region monitored by the third sensor and/or fourth data relating to the second event output by a fourth sensor based on monitoring of a region monitored by the fourth sensor are presented.

25. A monitoring system comprising:

a first sensor for outputting first data based on monitoring of a region monitored by the first sensor;

a second sensor for outputting first data based on monitoring of a region monitored by the second sensor;

a third sensor for outputting first data based on monitoring of a region monitored by the third sensor;

a fourth sensor for outputting first data based on monitoring of a region monitored by the fourth sensor;

first event detecting means for detecting, on the basis of the first data output from the first sensor, an occurrence and a property of a first event in response to a change in state of the monitored region;

second event detecting means for detecting, on the basis of the second data output from the second sensor, an occurrence and a property of a second event in response to a change in state of the monitored region;

notification control means for controlling a notification of the first event and the second event based on data indicating the property of the first event detected by the first event detecting means and data indicating the property of the second event detected by the second event detecting means; and presentation control means for controlling presentation of data such that if the first event and/or the second event are controlled, by the notification control means, to be notified, the third data, relating to the first event, output by the third sensor and/or the fourth data, relating to the second event, output by the fourth sensor are presented.

26. An information processing apparatus-comprising:

a first sensor for outputting first data based on monitoring of a region monitored by the first sensor;

a second sensor for outputting first data based on monitoring of a region monitored by the second sensor;

an event detector for detecting, on the basis of the first data output from the first sensor, an occurrence and a property of a first event in response to a change in state of the monitored region;

a receiver for receiving data indicating a property of a second event detected by a first information processing apparatus other than the present information processing apparatus;

a notification controller for controlling a notification of the first event based on the data indicating the property of the first event and the data indicating the property of the second event; and a transmitter for transmitting such that if the first event is controlled, by the notification controller, to be notified, the second data, relating to the first event, output by the second sensor is transmitted to a second information processing apparatus other than the present information processing apparatus, and the data indicating the property of the first event is also transmitted to the second information processing apparatus.

27. An information processing apparatus according to claim 26, wherein the notification controller controls the notification of the first event detected by the event detector, on the basis of the data indicating the property of the first event, the data indicating the property of the second event, combined data obtained by combining the data indicating the property of the first event and the data indicating the property of the second event, and event classification information based on a command issued by a user.

28. An information processing apparatus according to claim 26, wherein the notification controller determines whether the notification of an event should be controlled on the basis of the data indicating the property of the first event or combined data, based on the data indicating the property of the first event, the data indicating the property of the second event, combined data obtained by combining the data indicating the property of the first event and the data indicating the property of the second event, and an event notification control mode selected based on a command issued by a user.

29. An information processing apparatus according to claim 26, wherein the notification controller determines whether the first event should be notified, based on the data indicating the property of the first event, the data indicating the property of the second event, combined data obtained by combining the data indicating the property of the first event and the data indicating the property of the second event, and an event notification control mode selected based on a command issued by a user.

30. An information processing apparatus according to claim 26, wherein the notification controller controls the notification of the first event based on combined data obtained by combining the data indicating the property of the first event and the data indicating the property of the second event.

31. An information processing apparatus according to claim 26, wherein the event detector controls whether or not to transmit the data indicating the property of the first event to the first information processing apparatus other than the present information processing apparatus or the second information processing apparatus other than the present information processing apparatus, based on the data indicating the property of the first event, the data indicating the property of the second event, combined data obtained by combining the data indicating the property of the first event and the data indicating the property of the second event, and an event notification control mode selected based on a command issued by a user.

32. An information processing apparatus according to claim 26, wherein the transmitter transmits the data indicating the property of the first event to the first information processing apparatus other than the present information processing apparatus.

33. An information processing apparatus according to claim 26, wherein communication by the transmitter is performed by means of wireless communication.

34. An information processing apparatus according to claim 26, wherein the information processing apparatus is driven by a battery.

35. An information processing apparatus according to claim 26, wherein the first sensor includes a photosensor.

36. An information processing apparatus according to claim 26, wherein the second sensor includes a camera.

37. An information processing apparatus comprising a first sensor for outputting first data based on monitoring of a region monitored by the first sensor;

a second sensor for outputting first data based on monitoring of a region monitored by the second sensor;

event detection means for detecting, on the basis of the first data output from the first sensor, an occurrence and a property of a first event in response to a change in state of the monitored region;

receiving means for receiving data indicating a property of a second event detected by a first information processing apparatus other than the present information processing apparatus;

notification control means for controlling a notification of the first event based on the data indicating the property of the first event and the data indicating the property of the second event; and presentation control means for controlling presentation of data such that if the first event and/or the second event are controlled, by the notification control means, to be notified, the second data, relating to the first event, output by the second sensor is transmitted to a second information processing apparatus other than the present information processing apparatus and the data indicating the property of the first event is also transmitted to the second information processing apparatus.

38. A method of processing information, comprising:

an event detection step of detecting an occurrence and a property of a first event in response to a change in state of a region being monitored, on the basis of first data output from a first sensor based on monitoring of the region monitored by the first sensor;

a receiving step of receiving data indicating a property of a second event detected by a first information processing apparatus other than a present information processing apparatus;

a notification control step of controlling a notification of the first event based on the data indicating the property of the first event and the data indicating the property of the second event; and a transmission step of transmitting data such that if, in the notification control step, the first event is controlled to be notified, second data relating to the first event output by a second sensor based on monitoring of a region monitored by the second sensor is transmitted to a second information processing apparatus other than the present information processing apparatus, and the data indicating the property of the first event is transmitted to the first information processing apparatus and the second information processing apparatus.

39. A storage medium in which a computer-readable program is stored, the program comprising:

an event detection step of detecting an occurrence and a property of a first event in response to a change in state of a region being monitored, on the basis of first data output from a first sensor based on monitoring of the region monitored by the first sensor;

a receiving step of receiving data indicating a property of a second event detected by a first information processing apparatus other than a present information processing apparatus;

a notification control step of controlling a notification of the first event based on the data indicating the property of the first event and the data indicating the property of the second event; and a transmission step of transmitting data such that if, in the notification control step, the first event is controlled to be notified, second data relating to the first event output by a second sensor based on monitoring of a region monitored by the second sensor is transmitted to a second information processing apparatus other than the present information processing apparatus, and the data indicating the property of the first event is transmitted to the first information processing apparatus and the second information processing apparatus.

40. A program for causing a computer to execute a process comprising:

an event detection step of detecting an occurrence and a property of a first event in response to a change in state of a region being monitored, on the basis of first data output from a first sensor based on monitoring of the region monitored by the first sensor;

a receiving step of receiving data indicating a property of a second event detected by a first information processing apparatus other than a present information processing apparatus;

a notification control step of controlling a notification of the first event based on the data indicating the property of the first event and the data indicating the property of the second event; and a transmission step of transmitting data such that if, in the notification control step, the first event is controlled to be notified, second data relating to the first event output by a second sensor based on monitoring of a region monitored by the second sensor is transmitted to a second information processing apparatus other than the present information processing apparatus, and the data indicating the property of the first event is transmitted to the first information processing apparatus and the second information processing apparatus.

41. An information processing apparatus comprising:

a first sensor for outputting first data based on monitoring of a region monitored by the first sensor;

a second sensor for outputting first data based on monitoring of a region monitored by the second sensor;

an event detector for detecting, on the basis of the first data output from the first sensor, an occurrence and a property of a first event in response to a change in state of the monitored region;

a receiver for receiving event classification information from a second information processing apparatus different from the present processing apparatus;

a notification controller for controlling a notification of the first event based on the received event classification information; and a transmitter for transmitting data such that if the first event is controlled to be notified by the notification controller, the second data, relating to the first event, output by the second sensor and the data indicating the property of the first event are transmitted to the second information processing apparatus.

42. An information processing method comprising:

an event detection step of detecting an occurrence and a property of a first event in response to a change in state of a region being monitored, on the basis of first data output from a first sensor based on monitoring of the region monitored by the first sensor;

a receiving step of receiving event classification information from a second information processing apparatus different from the present processing apparatus;

a notification control step of controlling a notification of the first event based on the received event classification information; and a transmission step of transmitting data such that if, in the notification control step, the first event is controlled to be notified, second data relating to the first event output by a second sensor based on monitoring of a region monitored by the second sensor and the data indicating the property of the first event are transmitted to the second information processing apparatus.

43. An information processing apparatus comprising:

a receiver for receiving first data produced according to monitoring of a region monitored by a first sensor so as to indicate a property of a first event, second data produced according to monitoring of a region monitored by a second sensor so as to indicate a property of a second event, third data produced by a third sensor in response to a change in a region monitored by the third sensor, and fourth data produced by a fourth sensor in response to a change in a region monitored by the fourth sensor;

a notification controller for controlling a notification of the first event and the second event based on the data indicating the property of the first event and the data indicating the property of the second event; and presentation control means for controlling presentation of data such that if the first event and/or the second event are controlled, by the notification control means, to be notified, the third data, relating to the first event, output by the third sensor and/or the fourth data, relating to the second event, output by the fourth sensor are presented.

44. An information processing apparatus according to claim 43, further comprising an input acquisition unit for acquiring information input by a user.

45. An information processing apparatus according to claim 44, wherein the input acquisition unit acquires an input of user's evaluation on a presentation provided under the control of the presentation controller;

the monitoring system further comprises an event classification information generator for generating event classification information on the basis of data indicating a property of the first event, data indicating a property of the second event, combined data produced by combining the data indicating the property of the first event and the data indicating the property of the second event, and the input of the user's evaluation acquired by the input acquisition unit; and the notification controller controls the notification of the first event and the second event based on the event classification information.

46. An information processing apparatus according to claim 45, wherein the input acquisition unit acquires an input of user's evaluation as to whether or not a notification is necessary at least for one of the third data and the fourth data presented under the control of the presentation controller.

47. An information processing apparatus according to claim 45, further comprising an event classification information storage unit for storing the event classification information generated by the event classification information generator.

48. An information processing apparatus according to claim 45, further comprising an information recording unit for recording, as event information, at least one of the data indicating the property of the first event, the data indicating the property of the second event, and the combined data, in relationship to the input of user's evaluation acquired by the input acquisition unit.

49. An information processing apparatus according to claim 48, further comprising a mode selector for selecting a mode in which a notification of an event is controlled, on the basis of the event information recorded by the information recording unit and the event classification information, wherein the notification controller determines, based on the mode selected by the mode selection, which one of the data indicating the property of the first event, the data indicating the second event detected by the second event detector, and the combined data should be used as data according to which to control the event notification.

50. An information processing apparatus according to claim 49, wherein the input acquisition unit acquires a command associated with the mode issued by a user; and the mode selector selects a mode based on the command issued by the user and acquired by the input acquisition unit.

51. An information processing apparatus according to claim 49, wherein the notification controller controls the notification of the first event and the second event based on the mode.

52. An information processing apparatus according to claim 49, wherein the mode selector selects a mode based on the power consumption of a second information processing apparatus different from the present information processing apparatus.

53. An information processing apparatus according to claim 43, wherein the notification controller controls a notification of the first event and the second event based on combined data obtained by combining the data indicating the property of the first event and the data indicating the property of the second event.

54. An information processing apparatus comprising:

receiving means for receiving first data produced according to monitoring of a region monitored by a first sensor so as to indicate a property of a first event, second data produced according to monitoring of a region monitored by a second sensor so as to indicate a property of a second event, third data produced by a third sensor in response to a change in a region monitored by the third sensor, and fourth data produced by a fourth sensor in response to a change in a region monitored by the fourth sensor;

notification control means for controlling a notification of the first event and the second event based on the data indicating the property of the first event and the data indicating the property of the second event; and presentation control means for controlling presentation of data such that if the first event and/or the second event are controlled, by the notification control means, to be notified, the third data, relating to the first event, output by the third sensor and/or the fourth data, relating to the second event, output by the fourth sensor are presented.

55. A method of processing information comprising:

an acquisition step of acquiring first data produced according to monitoring of a region monitored by a first sensor so as to indicate a property of a first event, second data produced according to monitoring of a region monitored by a second sensor so as to indicate a property of a second event, third data produced by a third sensor in response to a change in a region monitored by the third sensor, and fourth data produced by a fourth sensor in response to a change in a region monitored by the fourth sensor;

a notification control step of controlling a notification of the first event and the second event based on the data indicating the property of the first event and the data indicating the property of the second event; and a presentation control step of controlling presentation of data such that if, in the notification control step, the first event and/or the second event are controlled to be notified, the third data, relating to the first event, output by the third sensor and/or the fourth data, relating to the second event, output by the fourth sensor are presented.

56. A storage medium in which a computer-readable program is stored, the program comprising:

an acquisition step of acquiring first data produced according to monitoring of a region monitored by a first sensor so as to indicate a property of a first event, second data produced according to monitoring of a region monitored by a second sensor so as to indicate a property of a second event, third data produced by a third sensor in response to a change in a region monitored by the third sensor, and fourth data produced by a fourth sensor in response to a change in a region monitored by the fourth sensor;

a notification control step of controlling a notification of the first event and the second event based on combined data obtained by combining the data indicating the property of the first event and the data indicating the property of the second event; and a presentation control step of controlling presentation of data such that if, in the notification control step, the first event and/or the second event are controlled to be notified, the third data, relating to the first event, output by the third sensor and/or the fourth data, relating to the second event, output by the fourth sensor are presented.

57. A program for causing a computer to execute a process comprising;

an acquisition step of acquiring first data produced according to monitoring of a region monitored by a first sensor so as to indicate a property of a first event, second data produced according to monitoring of a region monitored by a second sensor so as to indicate a property of a second event, third data produced by a third sensor in response to a change in a region monitored by the third sensor, and fourth data produced by a fourth sensor in response to a change in a region monitored by the fourth sensor;

a notification control step of controlling a notification of the first event and the second event based on the data indicating the property of the first event and the data indicating the property of the second event;

a presentation control step of controlling presentation of data such that if, in the notification control step, the first event and/or the second event are controlled to be notified, the third data, relating to the first event, output by the third sensor and/or the fourth data, relating to the second event, output by the fourth sensor are presented.

58. A monitoring system comprising:

a first sensor for outputting first data based on monitoring of a region monitored by the first sensor;

a second sensor for outputting first data based on monitoring of a region monitored by the second sensor;

a third sensor for outputting first data based on monitoring of a region monitored by the third sensor;

a fourth sensor for outputting first data based on monitoring of a region monitored by the fourth sensor;

a first event detector for detecting, on the basis of the first data output from the first sensor, a first event in response to a change in state of the region being monitored;

a second event detector for detecting, on the basis of the second data output from the second sensor, a second event in response to a change in state of the monitored region;

a notification controller for controlling a notification of the first event and the second event based on data indicating the first event detected by the first event detector and data indicating the second event detected by the second event detector; and a presentation controller for controlling presentation of data such that if the first event and/or the second event are controlled, by the notification controller, to be notified, the third data, relating to the first event, output by the third sensor and/or the fourth data, relating to the second event, output by the fourth sensor are presented.

59. A monitoring system according to claim 58, wherein said first event detector detects at least characteristics of the first event; and said second event detector detects at least characteristics of the second event.

60. A method of processing information comprising:

a first event detection step of detecting a first event in response to a change in state of a region being monitored, on the basis of first data output from a first sensor based on monitoring the region monitored by the first sensor;

a second event detection step of detecting a second event in response to a change in state of a region being monitored, on the basis of second data output from a second sensor based on monitoring the region monitored by the second sensor;

a notification control step of controlling a notification of the first event and the second event based on data indicating the first event detected in the first event detection step and data indicating the second event detected in the second event detection step; and a presentation control step of controlling presentation of data such that if, in the notification control step, the first event and/or the second event are controlled to be notified, third data relating to the first event output by a third sensor based on monitoring of a region monitored by the third sensor and/or fourth data relating to the second event output by a fourth sensor based on monitoring of a region monitored by the fourth sensor are presented.

* * * * *

UNITED STATES PATENT AND TRADEMARK OFFICE

CERTIFICATE OF CORRECTION

PATENT NO. : 7,102,503 B2
APPLICATION NO. : 10/918338
DATED : September 5, 2006
INVENTOR(S) : Tetsujiro Kondo et al.

It is certified that error appears in the above-identified patent and that said Letters Patent is hereby corrected as shown below:

Column 36, line 32, change ";" to --,--.

Column 37, line 61, change "user's the evaluation" to --user's evaluation--.

Column 47, line 59, change "SB" to --S8--.

Column 53, line 45, change "SB" to --S8--.

Column 58, line 43, change "specicfic" to --specific--.

Column 68, line 34, change "apparatus-comprising" to --apparatus comprising--.

Signed and Sealed this

Twenty-ninth Day of May, 2007

JON W. DUDAS
*Director of the United States Patent and Trademark Office*